US008498007B2

(12) United States Patent
Ito

(10) Patent No.: US 8,498,007 B2
(45) Date of Patent: Jul. 30, 2013

(54) IMAGE FORMING APPARATUS

(75) Inventor: Mitsuhiro Ito, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 787 days.

(21) Appl. No.: 12/502,945

(22) Filed: Jul. 14, 2009

(65) Prior Publication Data

US 2010/0020354 A1 Jan. 28, 2010

(30) Foreign Application Priority Data

Jul. 23, 2008 (JP) ..... 2008-189811

(51) Int. Cl.
*H04N 1/04* (2006.01)
*G06F 3/12* (2006.01)
*B65H 3/44* (2006.01)

(52) U.S. Cl.
USPC ..... 358/1.15; 358/498; 358/496; 271/9.01

(58) Field of Classification Search
USPC ..... 358/1.15, 486, 496, 498; 399/385, 399/396, 23, 82, 401, 389; 271/9.02, 9.11, 271/9.01
See application file for complete search history.

(56) References Cited

U.S. PATENT DOCUMENTS 6,002,906 A * 12/1999 Hino et al. ..... 399/303
7,556,254 B2 * 7/2009 Wada ..... 271/9.02
7,866,653 B2 * 1/2011 Tu ..... 271/3.01
2005/0082737 A1 * 4/2005 Sasaki et al. ..... 271/9.12
2005/0084278 A1 * 4/2005 Kimura et al. ..... 399/82
2005/0168768 A1 8/2005 Ito
2006/0104688 A1 * 5/2006 Motoyama et al. ..... 399/396
2006/0228126 A1 * 10/2006 Nihei ..... 399/82
2007/0120313 A1 * 5/2007 Wada ..... 271/9.02
2007/0176955 A1 * 8/2007 Yoshida ..... 347/16
2008/0112746 A1 * 5/2008 Yamamoto ..... 399/385
2009/0283955 A1 * 11/2009 Kawachi et al. ..... 271/3.23

FOREIGN PATENT DOCUMENTS

JP 09-193508 7/1997
JP 2001-195217 A 7/2001
JP 2002-103735 A 4/2002
JP 2006-133996 5/2006
JP 2006-225108 8/2006
JP 2006-270447 10/2006

OTHER PUBLICATIONS

Japanese Office Action dated Dec. 4, 2012 issued in corresponding Japanese Patent Application No. 2008-189811.

* cited by examiner

*Primary Examiner* — Jerome Grant, II
(74) *Attorney, Agent, or Firm* — Fitzpatrick, Cella, Harper & Scinto

(57) ABSTRACT

This invention provides an image forming apparatus capable of smoothly controlling option apparatuses while suppressing power consumed by conveyance, compared to a conventional technique. To achieve this, the control unit of the image forming apparatus issues a control instruction by serial communication via a common communication line to drive not all but two or more option apparatuses at once.

34 Claims, 50 Drawing Sheets

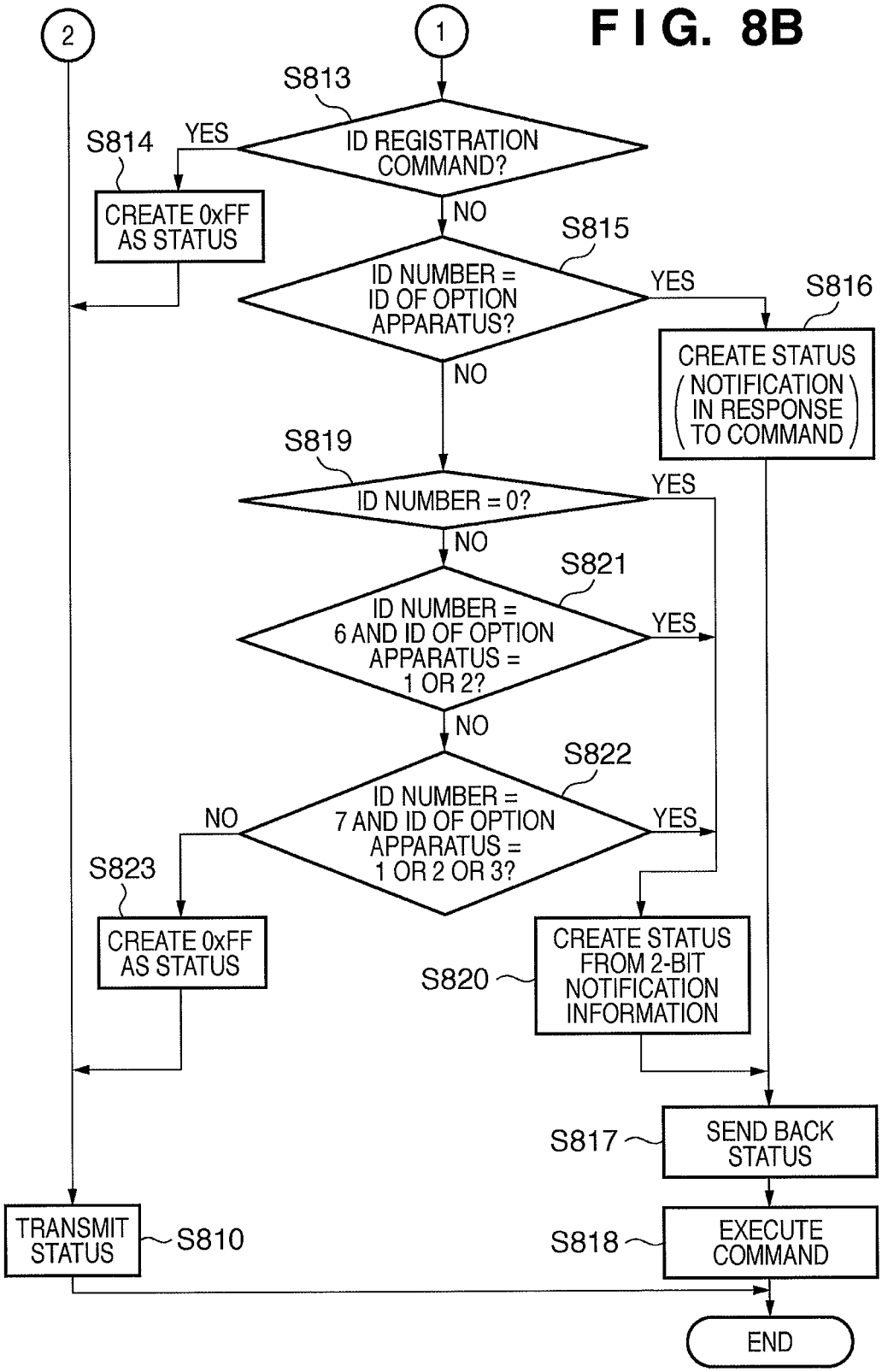
FIG. 8B
1
2
S813
ID REGISTRATION COMMAND?
YES
S814
CREATE 0xFF AS STATUS
NO
S815
ID NUMBER = ID OF OPTION APPARATUS?
YES
S816
CREATE STATUS (NOTIFICATION IN RESPONSE TO COMMAND)
NO
S819
ID NUMBER = 0?
YES
NO
S821
ID NUMBER = 6 AND ID OF OPTION APPARATUS = 1 OR 2?
YES
NO
S822
ID NUMBER = 7 AND ID OF OPTION APPARATUS = 1 OR 2 OR 3?
NO
YES
S823
CREATE 0xFF AS STATUS
S820
CREATE STATUS FROM 2-BIT NOTIFICATION INFORMATION
S817
SEND BACK STATUS
TRANSMIT STATUS
S810
S818
EXECUTE COMMAND
END

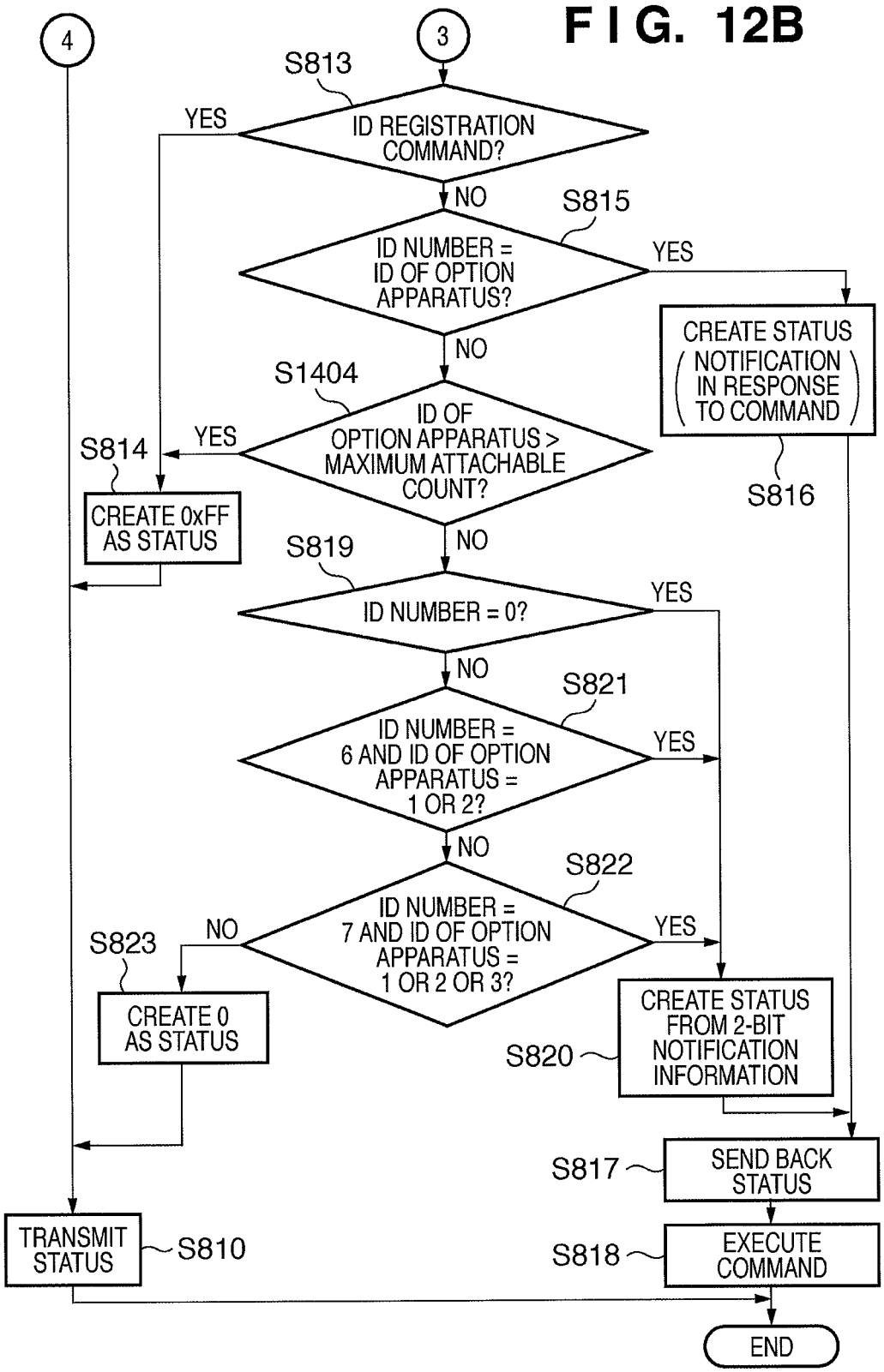
FIG. 12B
4
3
S813
ID REGISTRATION COMMAND?
YES
NO
S815
ID NUMBER = ID OF OPTION APPARATUS?
YES
CREATE STATUS (NOTIFICATION IN RESPONSE TO COMMAND)
S816
NO
S1404
ID OF OPTION APPARATUS > MAXIMUM ATTACHABLE COUNT?
YES
S814
CREATE 0xFF AS STATUS
NO
S819
ID NUMBER = 0?
YES
NO
S821
ID NUMBER = 6 AND ID OF OPTION APPARATUS = 1 OR 2?
YES
NO
S822
ID NUMBER = 7 AND ID OF OPTION APPARATUS = 1 OR 2 OR 3?
YES
NO
S823
CREATE 0 AS STATUS
S820
CREATE STATUS FROM 2-BIT NOTIFICATION INFORMATION
S817
SEND BACK STATUS
S818
EXECUTE COMMAND
TRANSMIT STATUS
S810
END 6
5
S813
ID REGISTRATION COMMAND?
YES
S814
CREATE 0xFF AS STATUS
NO
S815
ID NUMBER = ID OF OPTION APPARATUS?
YES
S816
CREATE STATUS (NOTIFICATION IN RESPONSE TO COMMAND)
NO
S819
ID NUMBER = 0?
YES
NO
S2202
ID NUMBER = 6?
NO
YES
S823
CREATE 0xFF AS STATUS
S820
CREATE STATUS FROM 2-BIT NOTIFICATION INFORMATION
S817
SEND BACK STATUS
TRANSMIT STATUS
S810
S818
EXECUTE COMMAND
END 8
7
S813
ID REGISTRATION COMMAND?
YES
S814
CREATE 0xFF AS STATUS
NO
S815
ID NUMBER = ID OF OPTION APPARATUS?
YES
S816
CREATE STATUS (NOTIFICATION IN RESPONSE TO COMMAND)
NO
S819
ID NUMBER = 0?
YES
NO
S2202
ID NUMBER = 6?
NO
YES
S823
CREATE 0xFF AS STATUS
S820
CREATE STATUS FROM 2-BIT NOTIFICATION INFORMATION
S817
SEND BACK STATUS
TRANSMIT STATUS
S810
S818
EXECUTE COMMAND
END

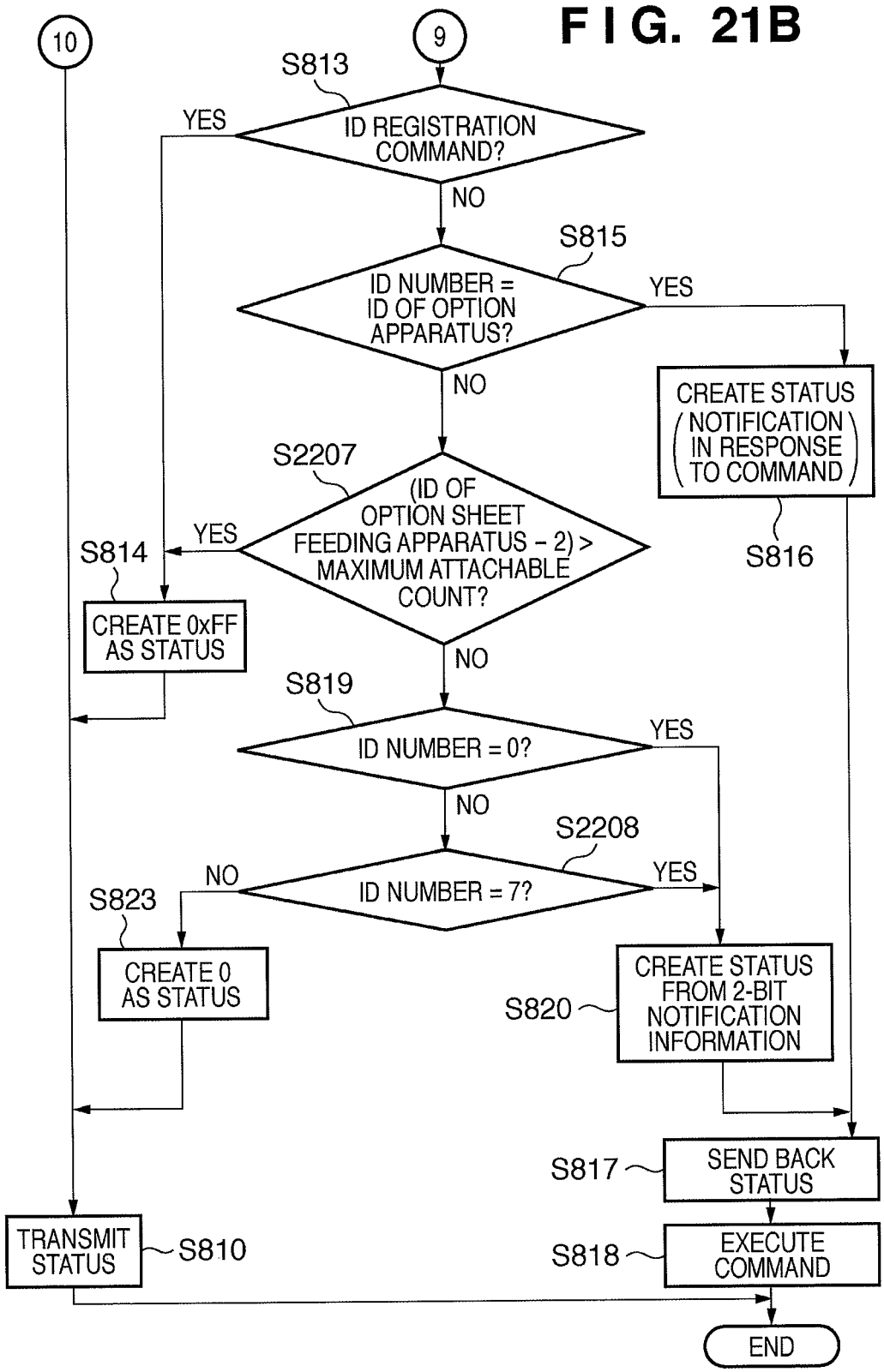
FIG. 21B
10
9
S813
ID REGISTRATION COMMAND?
YES
NO
S815
ID NUMBER = ID OF OPTION APPARATUS?
YES
NO
CREATE STATUS (NOTIFICATION IN RESPONSE TO COMMAND)
S816
S2207
(ID OF OPTION SHEET FEEDING APPARATUS - 2) > MAXIMUM ATTACHABLE COUNT?
YES
S814
CREATE 0xFF AS STATUS
NO
S819
ID NUMBER = 0?
YES
NO
S2208
ID NUMBER = 7?
NO
YES
S823
CREATE 0 AS STATUS
S820
CREATE STATUS FROM 2-BIT NOTIFICATION INFORMATION
S817
SEND BACK STATUS
S818
EXECUTE COMMAND
TRANSMIT STATUS
S810
END

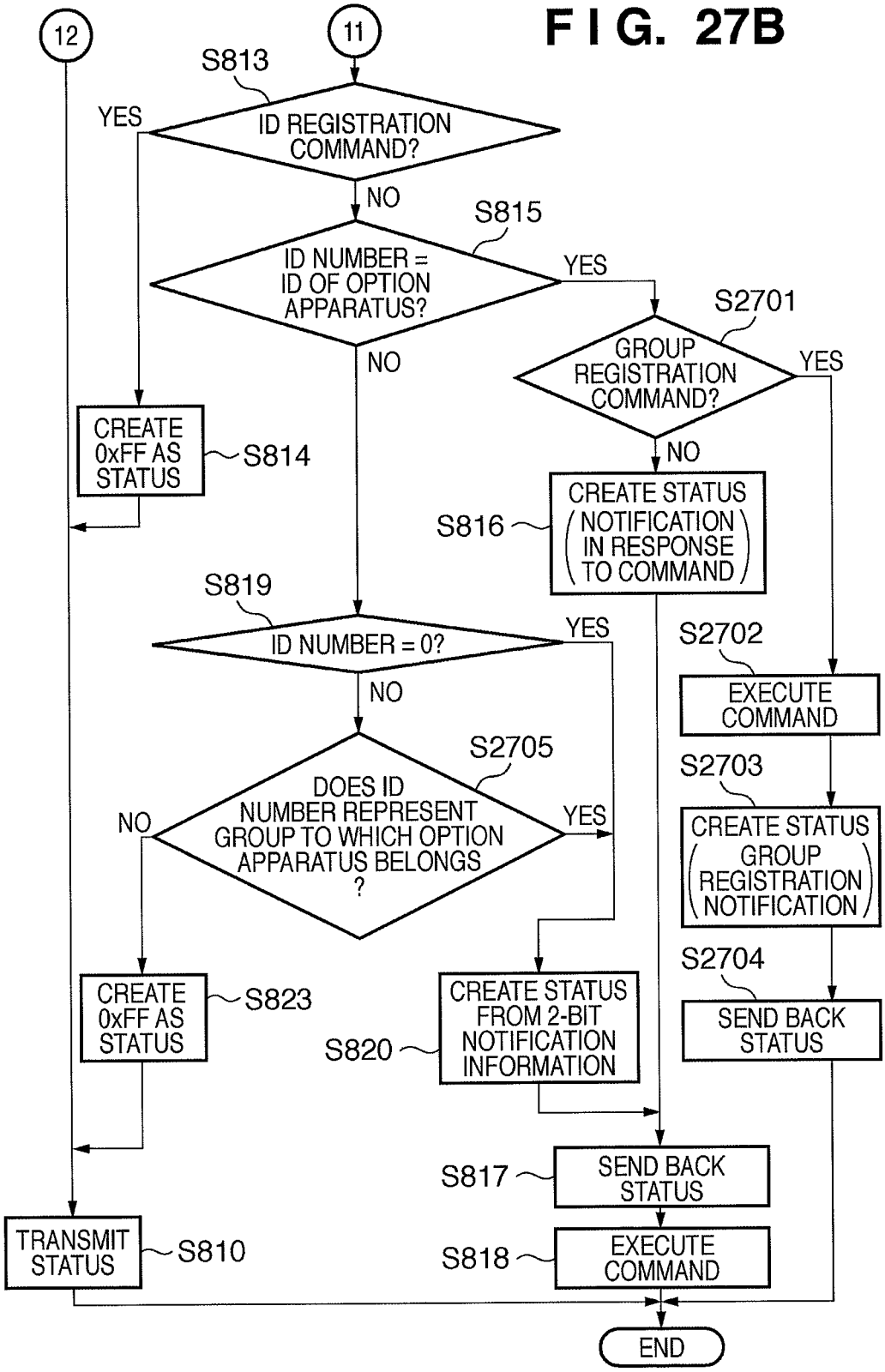
FIG. 27B
12
11
S813
ID REGISTRATION COMMAND?
YES
NO
S815
ID NUMBER = ID OF OPTION APPARATUS?
YES
NO
S2701
GROUP REGISTRATION COMMAND?
YES
NO
CREATE 0xFF AS STATUS
S814
S816
CREATE STATUS (NOTIFICATION IN RESPONSE TO COMMAND)
S819
ID NUMBER = 0?
YES
NO
S2702
EXECUTE COMMAND
S2705
DOES ID NUMBER REPRESENT GROUP TO WHICH OPTION APPARATUS BELONGS ?
NO
YES
S2703
CREATE STATUS (GROUP REGISTRATION NOTIFICATION)
S2704
SEND BACK STATUS
CREATE 0xFF AS STATUS
S823
S820
CREATE STATUS FROM 2-BIT NOTIFICATION INFORMATION
S817
SEND BACK STATUS
TRANSMIT STATUS
S810
S818
EXECUTE COMMAND
END

FIG. 32

3200

| | ID = 0 (BROADCAST) | ID = 1 | ID = 2 | ID = 3 | ID = 4 | ID =5 | ID = 6 (GROUPCAST) | ID = 7 (GROUPCAST) |
|---|---|---|---|---|---|---|---|---|
| OPTION SHEET FEEDING APPARATUS 101 (ID NUMBER 1) | TARGET | TARGET | | | | | TARGET | TARGET |
| OPTION SHEET FEEDING APPARATUS 102 (ID NUMBER 2) | TARGET | | TARGET | | | | TARGET | TARGET |
| OPTION SHEET FEEDING APPARATUS 103 (ID NUMBER 3) | TARGET | | | TARGET | | | | TARGET |
| OPTION SHEET FEEDING APPARATUS 104 (ID NUMBER 4) | TARGET | | | | TARGET | | | |

FIG. 33

3300

| | ID = 0 (BROADCAST) | ID = 1 | ID = 2 | ID = 3 | ID = 4 | ID =5 | ID = 6 (GROUPCAST) | ID = 7 (GROUPCAST) |
|---|---|---|---|---|---|---|---|---|
| OPTION SHEET FEEDING APPARATUS 101 (ID NUMBER 1) | TARGET | TARGET | | | | | TARGET | TARGET |
| OPTION SHEET FEEDING APPARATUS 102 (ID NUMBER 2) | TARGET | | TARGET | | | | TARGET | TARGET |
| OPTION SHEET FEEDING APPARATUS 103 (ID NUMBER 3) | TARGET | | | TARGET | | | | TARGET |
| OPTION SHEET FEEDING APPARATUS 104 (ID NUMBER 4) | TARGET | | | | TARGET | | | |
| OPTION SHEET FEEDING APPARATUS 105 (ID NUMBER 5) | | | | | | TARGET | | |

FIG. 34

3400

| | ID = 0 (BROADCAST) | ID = 1 | ID = 2 | ID = 3 | ID = 4 | ID =5 | ID = 6 (GROUPCAST) | ID = 7 (GROUPCAST) |
|---|---|---|---|---|---|---|---|---|
| OPTION INTERMEDIATE CONVEYING APPARATUS 111 (ID NUMBER 1) | TARGET | TARGET | | | | | TARGET | |
| OPTION DELIVERY APPARATUS 112 (ID NUMBER 2) | TARGET | | TARGET | | | | TARGET | |
| OPTION SHEET FEEDING APPARATUS 101 (ID NUMBER 3) | TARGET | | | TARGET | | | | TARGET |
| OPTION SHEET FEEDING APPARATUS 102 (ID NUMBER 4) | TARGET | | | | TARGET | | | TARGET |
| OPTION SHEET FEEDING APPARATUS 103 (ID NUMBER 5) | | | | | | TARGET | | |

FIG. 35

3500a

| | ID = 0 (BROADCAST) | ID = 1 | ID = 2 | ID = 3 | ID = 4 | ID =5 | ID = 6 (GROUPCAST) | ID = 7 (GROUPCAST) |
|---|---|---|---|---|---|---|---|---|
| OPTION SHEET FEEDING APPARATUS 101 (ID NUMBER 1) | TARGET | TARGET | | | | | TARGET | TARGET |
| OPTION SHEET FEEDING APPARATUS 102 (ID NUMBER 2) | TARGET | | TARGET | | | | TARGET | TARGET |
| OPTION SHEET FEEDING APPARATUS 103 (ID NUMBER 3) | TARGET | | | TARGET | | | | TARGET |
| OPTION SHEET FEEDING APPARATUS 104 (ID NUMBER 4) | TARGET | | | | TARGET | | | |

3500b

| | ID = 0 (BROADCAST) | ID = 1 | ID = 2 | ID = 3 | ID = 4 | ID = 5 (GROUP-CAST) | ID = 6 (GROUP-CAST) | ID = 7 (GROUP-CAST) |
|---|---|---|---|---|---|---|---|---|
| OPTION SHEET FEEDING APPARATUS 101 (ID NUMBER 1) | TARGET | TARGET | | | | TARGET | | |
| OPTION SHEET FEEDING APPARATUS 102 (ID NUMBER 2) | TARGET | | TARGET | | | TARGET | TARGET | |
| OPTION SHEET FEEDING APPARATUS 103 (ID NUMBER 3) | TARGET | | | TARGET | | | TARGET | TARGET |
| OPTION SHEET FEEDING APPARATUS 104 (ID NUMBER 4) | TARGET | | | | TARGET | | | TARGET |

FIG. 36

3600a

| | APPARATUS 104 | APPARATUS 103 | APPARATUS 102 | APPARATUS 101 |
|---|---|---|---|---|
| ID = 8 | 1 | 0 | 0 | 0 |
| ID = 12 | 1 | 1 | 0 | 0 |
| ID = 6 | 0 | 1 | 1 | 0 |
| ID = 3 | 0 | 0 | 1 | 1 |
| ID = 1 | 0 | 0 | 0 | 1 |

3600b

| | APPARATUS 104 | APPARATUS 103 | APPARATUS 102 | APPARATUS 101 |
|---|---|---|---|---|
| ID = 4 | 0 | 1 | 0 | 0 |
| ID = 6 | 0 | 1 | 1 | 0 |
| ID = 3 | 0 | 1 | 1 | 1 |
| ID = 1 | 0 | 0 | 0 | 1 |

3600c

| | APPARATUS 104 | APPARATUS 103 | APPARATUS 102 | APPARATUS 101 |
|---|---|---|---|---|
| ID = 2 | 0 | 0 | 1 | 0 |
| ID = 3 | 0 | 0 | 1 | 1 |
| ID = 1 | 0 | 0 | 0 | 1 |

3600d

| | APPARATUS 104 | APPARATUS 103 | APPARATUS 102 | APPARATUS 101 |
|---|---|---|---|---|
| ID = 1 | 0 | 0 | 0 | 1 |

FIG. 37

3700a

| | APPARATUS 104 | APPARATUS 103 | APPARATUS 102 | APPARATUS 101 |
|---|---|---|---|---|
| ID = 8 | 1 | 0 | 0 | 0 |
| ID = 12 | 1 | 1 | 0 | 0 |
| ID = 14 | 1 | 1 | 1 | 0 |
| ID = 7 | 0 | 1 | 1 | 1 |
| ID = 3 | 0 | 0 | 1 | 1 |
| ID = 1 | 0 | 0 | 0 | 1 |

3700b

| | APPARATUS 104 | APPARATUS 103 | APPARATUS 102 | APPARATUS 101 |
|---|---|---|---|---|
| ID = 4 | 0 | 1 | 0 | 0 |
| ID = 6 | 0 | 1 | 1 | 0 |
| ID = 7 | 0 | 1 | 1 | 1 |
| ID = 3 | 0 | 0 | 1 | 1 |
| ID = 1 | 0 | 0 | 0 | 1 |

3700c

| | APPARATUS 104 | APPARATUS 103 | APPARATUS 102 | APPARATUS 101 |
|---|---|---|---|---|
| ID = 2 | 0 | 0 | 1 | 0 |
| ID = 3 | 0 | 0 | 1 | 1 |
| ID = 1 | 0 | 0 | 0 | 1 |

3700d

| | APPARATUS 104 | APPARATUS 103 | APPARATUS 102 | APPARATUS 101 |
|---|---|---|---|---|
| ID = 1 | 0 | 0 | 0 | 1 |

IMAGE FORMING APPARATUS

BACKGROUND OF THE INVENTION

1. Field of the Invention

The present invention relates to a communication technique between an image forming apparatus main body and an option apparatus attached to it.

2. Description of the Related Art

Conventionally, a plurality of option apparatuses attachable to an image forming apparatus main body are connected to the image forming apparatus. While communicating with the option apparatuses, the image forming apparatus main body controls them to execute a cooperative operation for sheet feeding/conveyance or sheet delivery/conveyance.

For example, according to Japanese Patent Laid-Open No. 09-193508 (patent reference 1), an image forming apparatus main body communicates with a plurality of option apparatuses to transmit/receive data by serial communication synchronized with common clocks.

Signal lines for clocks and data are commonly connected to a plurality of option apparatuses. In addition, an individual signal line is arranged for each option apparatus to identify a specific option apparatus to be communicated among a plurality of option apparatuses.

When communicating with one specific option apparatus at once, the image forming apparatus main body activates only an individual signal line connected to it and executes communication.

When communicating with all option apparatuses, the image forming apparatus main body activates all signal lines individually arranged for them and performs communication.

Image forming apparatuses in Japanese Patent Laid-Open Nos. 2006-133996 (patent reference 2) and 2006-225108 (patent reference 3) omit individual signal lines, which are arranged for respective option apparatuses in patent reference 1. The image forming apparatus communicates with cascade-connected option apparatuses via a common communication line.

More specifically, when communicating with one specific option apparatus, the image forming apparatus sets an option apparatus identifier in communication data. Upon receiving the communication data, only one of option apparatuses that matches the identifier processes communication.

Japanese Patent Laid-Open No. 2006-270447 (patent reference 4) proposes a method of simultaneously communicating with all option apparatuses. More specifically, an image forming apparatus sets an identifier (also called a broadcast ID) representing all apparatuses in a send command, in addition to an identifier meaning each option. Upon receiving the command, each option apparatus recognizes the broadcast ID and responds to the command.

When accelerating/decelerating a print sheet throughout a plurality of option apparatuses, a conventional image forming apparatus issues an instruction to successively drive the option apparatuses according to, for example, the technique disclosed in patent reference 2 or 3.

In this case, a higher conveyance speed makes "tension" or "flexion" of a print sheet large between option apparatuses and sometimes causes "jamming" because the control instruction communication speed is not so high. These problems are negligible at low conveyance speeds of image forming apparatuses, but become serious at higher conveyance speeds of recent image forming apparatuses.

These problems can be suppressed by simultaneously driving all option apparatuses using a broadcast ID, as described in patent reference 4.

However, as an environmental measure, even image forming apparatuses are recently requested to minimize power consumption.

More specifically, the image forming apparatus needs to simultaneously control conveyance of a print sheet over the first option apparatus group containing some option apparatuses while keeping the remaining option apparatus group still without conveying the print sheet and affecting the conveyance. For example, the first option apparatus group can include option apparatuses 1 and 2, whereas the remaining option apparatus group can include option apparatuses 3 and 4.

The present invention can solve at least one of the above-described problems and others. For example, the present invention controls option apparatuses to smoothly convey a recording medium while suppressing power consumed by conveyance, compared to a conventional technique. The other problems will become apparent throughout the specification.

SUMMARY OF THE INVENTION

According to one aspect of the present invention, an image forming apparatus which allows connecting at least three option apparatuses each having a conveying unit for conveying a recording medium, and communicates with the at least three option apparatuses via a common serial communication line, the image forming apparatus comprises an instruction unit which instructs the at least three option apparatuses via the common serial communication line on an operation, wherein when conveying a recording medium by driving at least two option apparatuses which are smaller in number than all the option apparatuses, the instruction unit outputs a command via the serial communication line to drive at once the at least two option apparatuses which are smaller in number than all the option apparatuses.

For example, the present invention can control option apparatuses to smoothly convey a recording medium while suppressing power consumed by conveyance, compared to a conventional technique.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 8A and 8B are flowcharts of communication command execution control in an option sheet feeding apparatus;

FIGS. 12A and 12B are flowcharts of communication command execution control in an option sheet feeding apparatus;

FIGS. 21A and 21B are flowcharts of communication command execution control in an option sheet feeding apparatus;

FIGS. 27A and 27B are flowcharts of communication command execution control in an option sheet feeding apparatus;

FIG. 32 is a table showing an example of the correspondence between an ID added to a command and each option sheet feeding apparatus;

FIG. 33 is a table showing an example of the correspondence between an ID added to a command and each option sheet feeding apparatus;

FIG. 34 is a table showing an example of the correspondence between an ID added to a command and each option sheet feeding apparatus;

FIG. 35 is a table showing an example of the correspondence between an ID added to a command and each option sheet feeding apparatus;

FIG. 36 is a table showing an example of the correspondence between an ID added to a command and each option sheet feeding apparatus; and FIG. 37 is a table showing an example of the correspondence between an ID added to a command and each option sheet feeding apparatus.

DESCRIPTION OF THE EMBODIMENTS

Preferred exemplary embodiments of the present invention will be described in detail below with reference to the accompanying drawings. Constituent elements described in the embodiments are merely examples, and the scope of the invention is not limited to them.

A first exemplary embodiment will be described as follows.

<Sectional View of Image Forming Apparatus>

Figure 1:
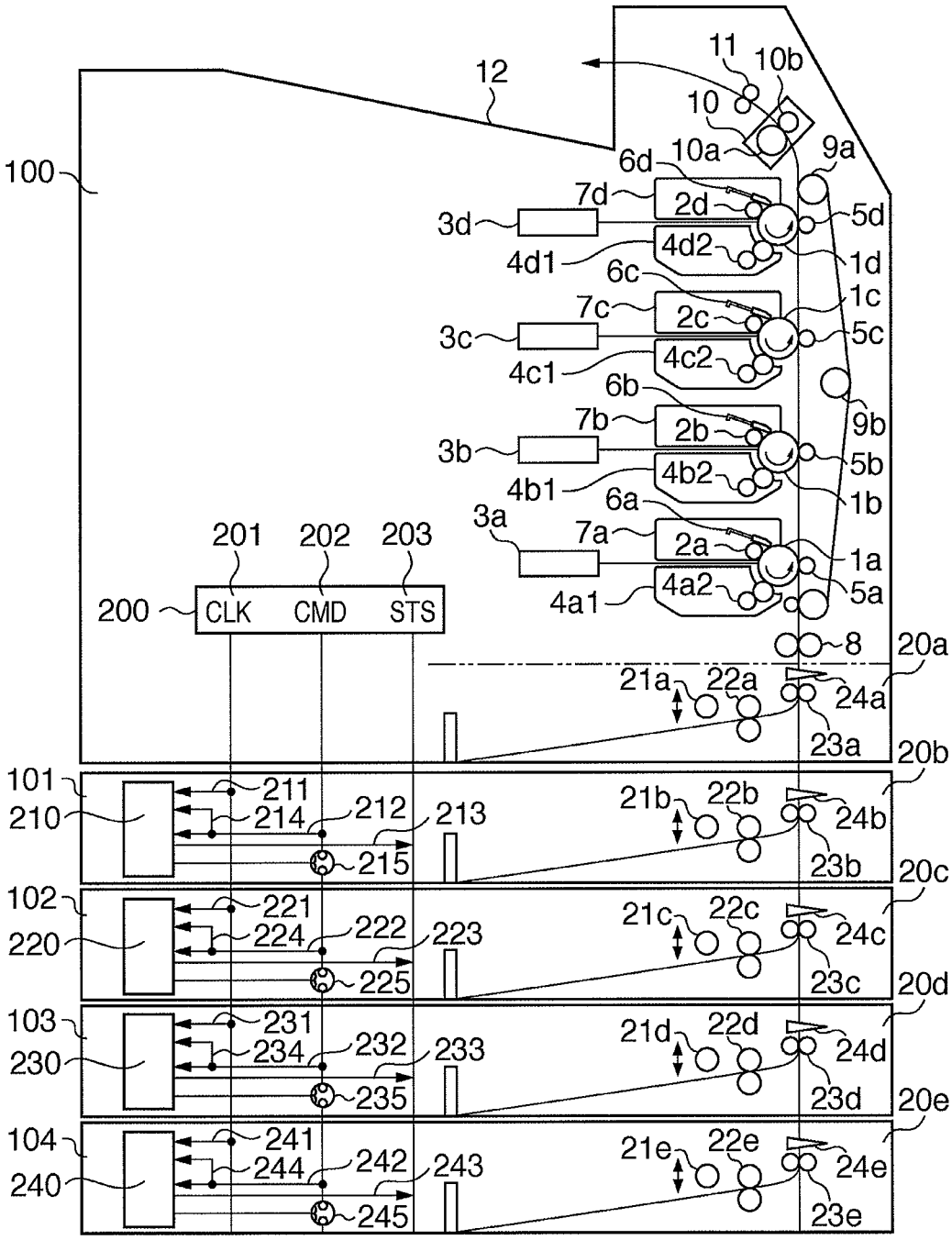
FIG. 1 is a sectional view showing an exemplary embodiment of an image forming apparatus (image forming apparatus main body and option apparatuses) and communication interface.

FIG. 1 is a sectional view showing the arrangement of an image forming apparatus capable of connecting three or more option apparatuses according to the first exemplary embodiment. In FIG. 1, four option sheet feeding apparatuses 101, 102, 103, and 104 are attached to an image forming apparatus main body 100.

The whole arrangement will be explained first. The image forming apparatus main body 100 includes four photosensitive members 1, that is, 1*a* to 1*d* each serving as an image carrier. Charging units 2, that is, 2*a* to 2*d* each for uniformly charging the surface of the photosensitive member, and exposure units 3, that is, 3*a* to 3*d* each for emitting a laser beam based on image information to form an electrostatic latent image on the photosensitive member are arranged near the photosensitive members 1*a* to 1*d*, respectively. Developing units 4, that is, 4*a* to 4*d* each for applying toner to an electrostatic latent image to visualize it as a toner image, and transfer members 5, that is, 5*a* to 5*d* each for transferring a toner image on the photosensitive body onto a sheet are also arranged. Further, cleaning units 6, that is, 6*a* to 6*d* each for removing toner left on the surface of the photosensitive member after transfer, and the like are arranged. These units which operate during the image forming process will be called an image forming unit as a whole. The photosensitive members 1*a* to 1*d*, charging units 2*a* to 2*d*, developing units 4*a* to 4*d*, and cleaning units 6*a* to 6*d* are integrated into cartridges, forming process cartridges 7, that is, 7*a* to 7*d*.

A sheet fed from each of feeding units 20*a* to 20*e* is conveyed to the image forming unit by a conveying unit 9 formed from a conveying belt. Toner images of respective colors are sequentially transferred onto the sheet, forming a multicolor image. A fixing unit 10 heats the sheet to fix the image, and a pair of discharge rollers 11 discharge the sheet to a delivery tray 12.

The option sheet feeding apparatuses 101, 102, 103, and 104 include the option feeding units 20*b*, 20*c*, 20*d*, and 20*e*, respectively.

When feeding a sheet from an option sheet feeding apparatus to form an image, pickup rollers 21*b*, 21*c*, 21*d*, and 21*e* and separation/conveying rollers 22*b*, 22*c*, 22*d*, and 22*e* of the option sheet feeding apparatuses separately feed sheets one by one. The fed sheets are conveyed by option cassette conveying rollers 23*b*, 23*c*, 23*d*, and 23*e*. The print sheets are detected by conveyance sensors 24*b*, 24*c*, 24*d*, and 24*e*, and conveyed to the conveying unit 9 via conveying rollers 23*a* and registration rollers 8. Although not shown, each option sheet feeding apparatus also includes a sheet sensor for detecting whether a print sheet exits in each feeding unit.

<Functional Block Diagram of Image Forming Apparatus>

The functional arrangement of the image forming apparatus shown in the block diagram of FIGS. 2A-2C will be explained together with the building components in FIG. 1.

For example, an image forming unit 31 of FIG. 2A will be explained. The photosensitive member 1 serving as an image carrier is rotatably supported at its two ends by flanges. A driving motor (not shown) transfers a driving force to one end to drive the photosensitive member 1 to rotate counterclockwise in FIG. 2A.

The charging unit 2 is a conductive roller. The charging unit 2 comes into contact with the surface of the photosensitive member 1, and uniformly charges it by applying a charging bias voltage from a power supply (not shown). The exposure unit 3 includes a polygon mirror. A laser diode (not shown) emits image light corresponding to an image signal, and the polygon mirror scans it.

The developing units 4*a* to 4*d* include toner containers 4*a*1 to 4*d*1 which respectively store black, cyan, magenta, and yellow color toners, and developing rollers 4*a*2 to 4*d*2 which are adjacent to the surfaces of the corresponding photosensitive members, are driven to rotate by driving units (not shown), and develop images by applying developing bias voltages from developing bias power supplies (not shown).

The transfer members 5*a* to 5*d* are arranged in contact with the inner surface of the transfer/conveying belt 9 (to be described later) to face the four photosensitive members 1*a* to 1*d*. The transfer members 5*a* to 5*d* are connected to a transfer bias power supply (not shown). The transfer members 5*a* to 5*d* apply positive charges to a sheet via the transfer/conveying belt 9. By the charges, negatively charged toner images of the respective colors on the photosensitive members 1*a* to 1*d* are sequentially transferred onto the sheet in contact with the photosensitive members 1*a* to 1*d*, forming a multicolor image.

A sheet conveying unit 32 of FIG. 2A will be explained. As described above, a sheet fed from each of the feeding units 20*a* to 20*e* is conveyed to the image forming area via the registration rollers 8 and conveying unit 9 serving as a conveying unit. The transfer/conveying belt serving as a recording medium carrier which forms the conveying unit 9 is looped and supported by a driving roller 9*a* and driven rollers 9*b* and 9*c*, and faces all the photosensitive members 1*a* to 1*d*.

The driving roller 9*a* circulates the transfer/conveying belt 9 to electrostatically attract a sheet on the outer surface facing the photosensitive member 1 and bring the sheet into contact with the photosensitive member 1. The transfer/conveying belt 9 conveys the sheet to a transfer position where the toner image on the photosensitive member 1 is transferred onto the sheet.

An attraction roller 9*e* is arranged most upstream of the transfer/conveying belt 9 to clamp a sheet together with the belt 9 and attract it to the belt 9.

When conveying a sheet, a voltage is applied to the attraction roller 9*e* to generate an electric field between the attraction roller 9*e* and the driven roller 9*c* facing it. This causes dielectric polarization between the transfer/conveying belt 9 and the sheet, generating an electrostatic attraction force between them.

A fixing unit 33 of FIG. 2A will be explained. The fixing unit 10 fixes a toner image by applying heat and pressure to the image formed on a sheet. The fixing unit 10 includes a fixing belt 10*a* and elastic press roller 10*b*. The elastic press roller 10*b* is in contact with the fixing belt 10*a*, and forms a fixing nip of a predetermined width together with a belt guide at a predetermined pressure.

While the temperature of the fixing nip rises to a predetermined value and keeps it, a sheet which is conveyed from the image forming unit and bears an unfixed toner image enters the fixing nip. More specifically, the sheet is introduced into the fixing nip between the fixing belt 10*a* and the elastic press roller 10*b* with its image surface facing up, that is, facing the fixing belt surface. At the fixing nip, the image surface comes into tight contact with the outer surface of the fixing belt 10*a*. The sheet is nipped at the fixing nip and conveyed along with the fixing belt 10*a*.

While the sheet is nipped at the fixing nip and conveyed along with the fixing belt 10*a*, it is heated by the fixing belt 10*a* to heat and fix the unfixed toner image on the sheet.

A delivery unit 34 of FIG. 2A including the pair of discharge rollers 11 will be explained. A sheet conveyed from the fixing unit 10 is delivered and stacked on the delivery tray 12.

Figure 2A:
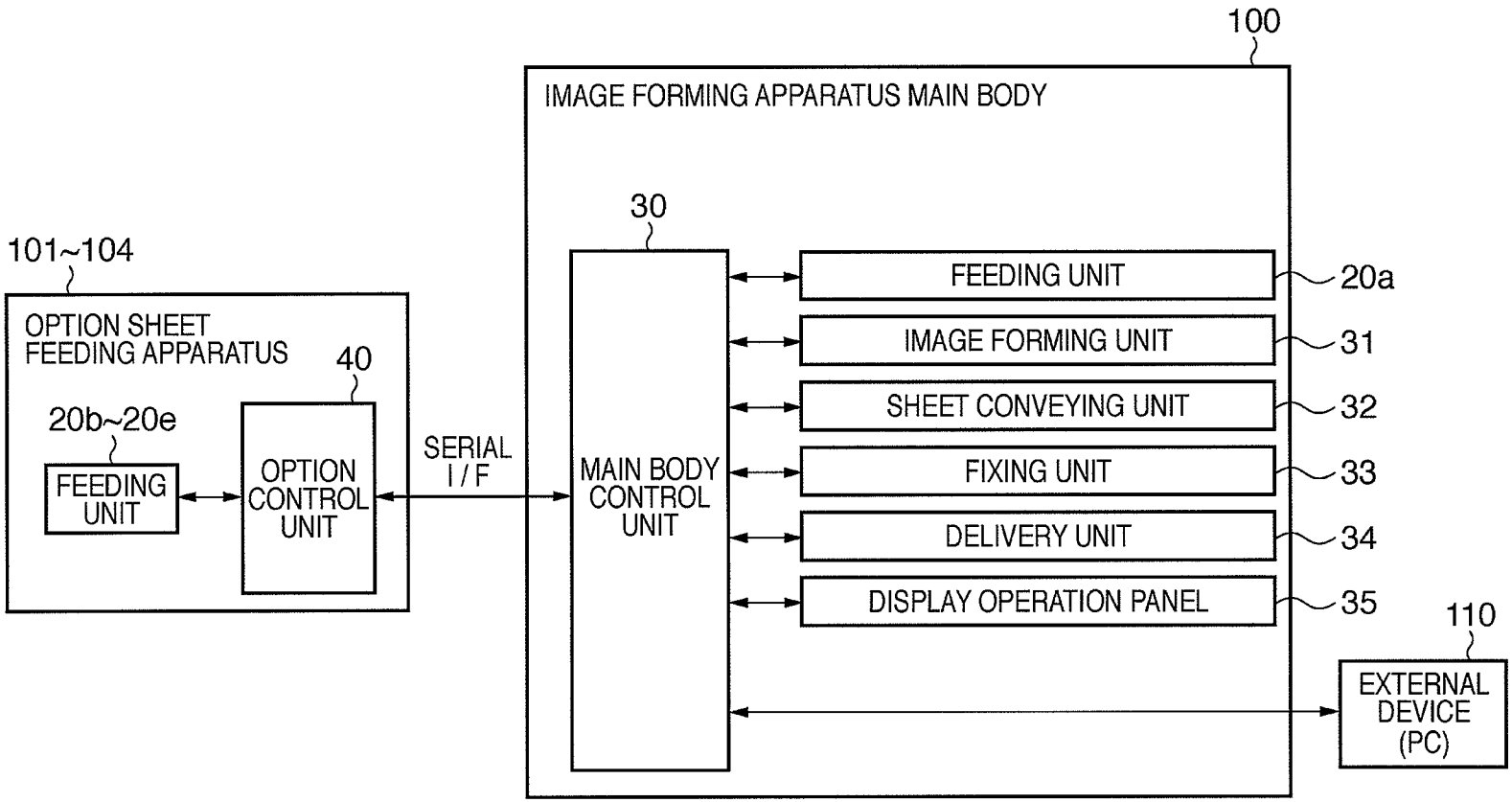
FIGS. 2A-2C are block diagrams showing exemplary embodiments of the functional arrangement of the image forming apparatus.

In the example of FIG. 2A, a main body control unit 30 includes a microcomputer (control CPU 200 in FIG. 1). The main body control unit 30 may be formed from the control CPU 200 in FIG. 1 and another ASIC. The main body control unit 30 may also be formed from only the ASIC. When the main body control unit 30 and control CPU 200 are described as a main processor in the following description, the main processor is not limited to them.

The main body control unit 30 receives print image data transmitted from an external device 110 such as a PC via a communication interface. The main body control unit 30 transmits the state of the image forming apparatus to the external device 110 such as a PC.

The main body control unit 30 functions as an instruction unit which issues a variety of control instructions, including a print sheet feeding instruction to control the feeding unit 20*a* to feed a print sheet. The main body control unit 30 causes the image forming unit 31 to form an image by controlling an electrophotographic process including laser driving and high-voltage driving. The main body control unit 30 causes the sheet conveying unit 32 to convey a print sheet to the image forming unit and form a toner image. The main body control unit 30 causes the fixing unit 33 to control its fixing temperature and heat and fix the toner image on the print sheet. The main body control unit 30 causes the delivery unit 34 to control discharge and conveyance of the print sheet and discharge the printed sheet. Part or all of a series of print sheet moving control from feeding to delivery by an option apparatus will be called conveyance control.

The image forming apparatus main body 100 includes a display operation panel 35 connected to the main body control unit 30. The display operation panel 35 accepts an operation from a user, and notifies him of a message.

The option sheet feeding apparatuses 101 to 104 include option control units 40, which are formed from microcomputers (control CPUs 210, 220, 230, and 240 in FIG. 2A). While communicating with the main body control unit 30 via a serial interface, the option control units 40 cause the feeding units 20*b*, 20*c*, 20*d*, and 20*e* to control feeding of print sheets and feed them into the image forming apparatus main body.

<Communication Interface Between Image Forming Apparatus Main Body and Option Apparatus>

Referring back to FIG. 1, FIG. 1 is also a view for explaining a communication interface between the image forming apparatus main body 100 and each option apparatus.

The option sheet feeding apparatuses 101, 102, 103, and 104 include at least the control CPUs 210, 220, 230, and 240, and switches 215, 225, 235, and 245, respectively.

The control CPU 200 of the image forming apparatus main body 100 is cascade (series)-connected to the control CPUs 210, 220, 230, and 240 of the option sheet feeding apparatuses. As shown in FIG. 1, the control CPU 200 can communicate with the control CPUs 210, 220, 230, and 240 via a common serial communication line.

Interface signals are as follows. The control CPU 200 outputs a CLK transmission signal 201 as a clock signal (to be also referred to as a "CLK signal") for establishing synchronization of communication. The control CPUs 210, 220, 230, and 240 receive the CLK transmission signal 201 as CLK reception signals 211, 221, 231, and 241, respectively.

The control CPU 200 outputs a CMD transmission signal 202 as a command signal (to be also referred to as a "CMD signal") transmitted from the image forming apparatus main body to the option sheet feeding apparatus. The control CPUs 210, 220, 230, and 240 receive the CMD transmission signal 202 as CMD reception signals 212, 222, 232, and 242, respectively.

The control CPU 200 receives an STS reception signal 203 as a status signal (to be also referred to as an "STS signal") transmitted (sent back) from the option sheet feeding apparatus to the image forming apparatus main body. The control CPUs 210, 220, 230, and 240 output STS transmission signals 213, 223, 233, and 243 which are input as the STS reception signal 203 to the control CPU 200.

Each of the CMD reception signals 212, 222, 232, and 242 is divided into two signals in the option sheet feeding apparatus. One serves as a command interrupt signal (to be also referred to as "CMD interrupt signals") 214, 224, 234, or 244, and the other serves as a CMD reception signal. The command interrupt signals 214, 224, 234, and 244 are input to the interrupt ports of the control CPUs 210, 220, 230, and 240. It is set to generate an interrupt when the command interrupt signal changes to Low level.

The switches 215, 225, 235, and 245 can switch the communication connection states (connected or non-connected) of the cascade-connected control CPUs 210, 220, 230, and 240.

A method of sequentially exchanging CMD signals with the option sheet feeding apparatuses 101, 102, 103, and 104 and adding individual IDs (also called option apparatus identifiers) to the respective option sheet feeding apparatuses while connecting/disconnecting the switches will be described.

Upon power-on, none of the option sheet feeding apparatuses registers (sets) an ID. In this case, the switches of the option sheet feeding apparatuses are non-connected (OFF) not to receive the CMD signal. That is, all the switches 215, 225, 235, and 245 are open.

The image forming apparatus main body 100 transmits a command designating ID=1 by the CMD signal. Only the option sheet feeding apparatus 101 can receive this command, and the option sheet feeding apparatuses 102, 103, and 104 cannot receive it because their switches are non-connected.

Upon receiving the command designating ID=1 while no identifier is registered (set), the option apparatus 101 stores its ID=1 and connects the switch 215. Then, the option sheet feeding apparatus 101 transmits (sends back) the STS signal to the image forming apparatus main body 100 to notify it that the option sheet feeding apparatus 101 has registered ID=1.

After confirming from the STS signal that the option sheet feeding apparatus 101 has registered ID=1, the image forming apparatus main body 100 transmits a command designating ID=2.

In the current switch state, the switch 215 has been connected, so the option sheet feeding apparatuses 101 and 102 can receive the command.

The option sheet feeding apparatus 101 has already stored (set) its ID, and ignores the new ID registration command.

In contrast, the option apparatus 102 receives the command designating ID=2 while no identifier is registered. Thus, the option apparatus 102 stores its ID=2 and connects the switch 225. The option apparatus 102 transmits (sends back) the STS signal to the image forming apparatus main body 100 to notify it that the option apparatus 102 has registered ID=2.

Subsequently, the switches 235 and 245 are sequentially connected to register ID=3 in the option apparatus 103 and ID=4 in the option apparatus 104.

<Simultaneous Driving of Option Apparatuses>

Figure 3:
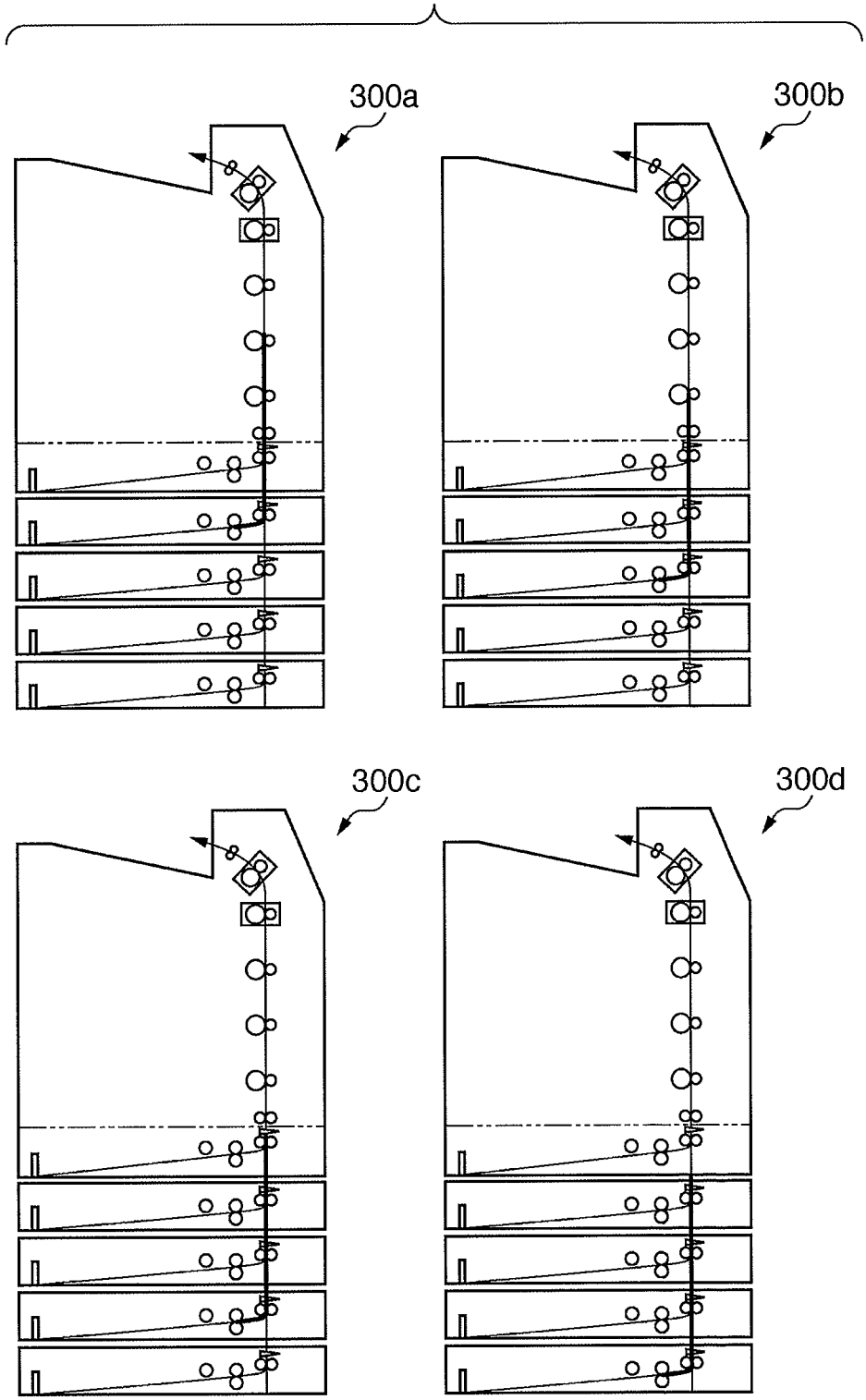
FIG. 3 is a view showing an exemplary embodiment of grouping driving of option apparatuses.

FIG. 3 is a view for explaining a method of designating and driving a plurality of option apparatuses at once by the image forming apparatus. Although reference numerals are omitted, the same reference numerals as those in FIG. 1 are assumed to be assigned.

In 300*a*, the feeding unit 20*b* of the option sheet feeding apparatus 101 feeds a print sheet. A thick line represents a fed print sheet. Only the option sheet feeding apparatus 101 among a plurality of option sheet feeding apparatuses is driven for conveyance.

In 300*b*, the option sheet feeding apparatuses 101 and 102 among a plurality of option sheet feeding apparatuses are driven for conveyance.

In 300*c*, the option sheet feeding apparatuses 101, 102, and 103 among a plurality of option sheet feeding apparatuses are driven for conveyance.

In 300*d*, all the option sheet feeding apparatuses 101, 102, 103, and 104 are driven for conveyance.

The exemplary embodiment executes conveyance driving of option sheet feeding apparatuses by adding an identifier to a conveyance instruction command to identify option sheet feeding apparatuses to be driven. FIG. 32 shows an example of identifiers to be added.

In 300*a*, the image forming apparatus main body 100 issues conveyance-related commands (e.g., driving, stop, and speed change of the conveyance motor) with ID=1.

In 300*d*, the image forming apparatus main body 100 issues conveyance-related commands (e.g., driving, stop, and speed change of the conveyance motor) with the broadcast ID=0 to simultaneously convey print sheets from the respective option sheet feeding apparatuses in synchronization with each other. A print sheet extending over the option sheet feeding apparatuses 101, 102, 103, and 104 can be stably conveyed without pulling or thrusting it between the apparatuses.

If priority is given to synchronization in operating only two or three of the option sheet feeding apparatuses, like 300*b* or 300*c*, the image forming apparatus main body 100 issues a broadcast ID to designate all the option apparatuses. In this case, the option apparatuses 103 and 104 in 300*b* and the option apparatus 104 in 300*c* rotate their conveyance motors irrespective of conveyance, wastefully consuming power.

When priority is given to suppressing unnecessary power consumption, the image forming apparatus main body 100 issues not a broadcast ID but an individual ID. The image forming apparatus main body 100 sequentially communicates with the option sheet feeding apparatuses 101 and 102 in 300*b*, and the option sheet feeding apparatuses 101, 102, and

103 in 300*c*. In the sequential communication, a time lag occurs between the communications, failing in conveyance synchronization. Especially at high conveyance speed, a sheet is pulled or thrust between the apparatuses and may be jammed in the worst case.

To prevent this, according to the exemplary embodiment, option apparatuses which convey a print sheet throughout them, like 300*b* or 300*c*, are grouped out of a plurality of option apparatuses. A group ID is assigned to the group, and the grouped option apparatuses simultaneously operate in response to a command containing the group ID. In other words, the image-forming apparatus can use the group ID-containing command to simultaneously communicate (to be also referred to as groupcast) with a plurality of option apparatuses in a group. The number of option apparatuses to be grouped is smaller than the total number of option apparatuses and is equal to or larger than two.

Grouping will be explained in more detail. In 300*b*, the option sheet feeding apparatuses 101 and 102 are grouped to assign ID=6 to the group. In 300*c*, the option sheet feeding apparatuses 101, 102, and 103 are grouped to assign ID=7 to the group. The identifier "6" or "7" is issued when driving not all but two or more option apparatuses to convey a recording medium.

<Various Communication Timing Charts>

Figure 4A:
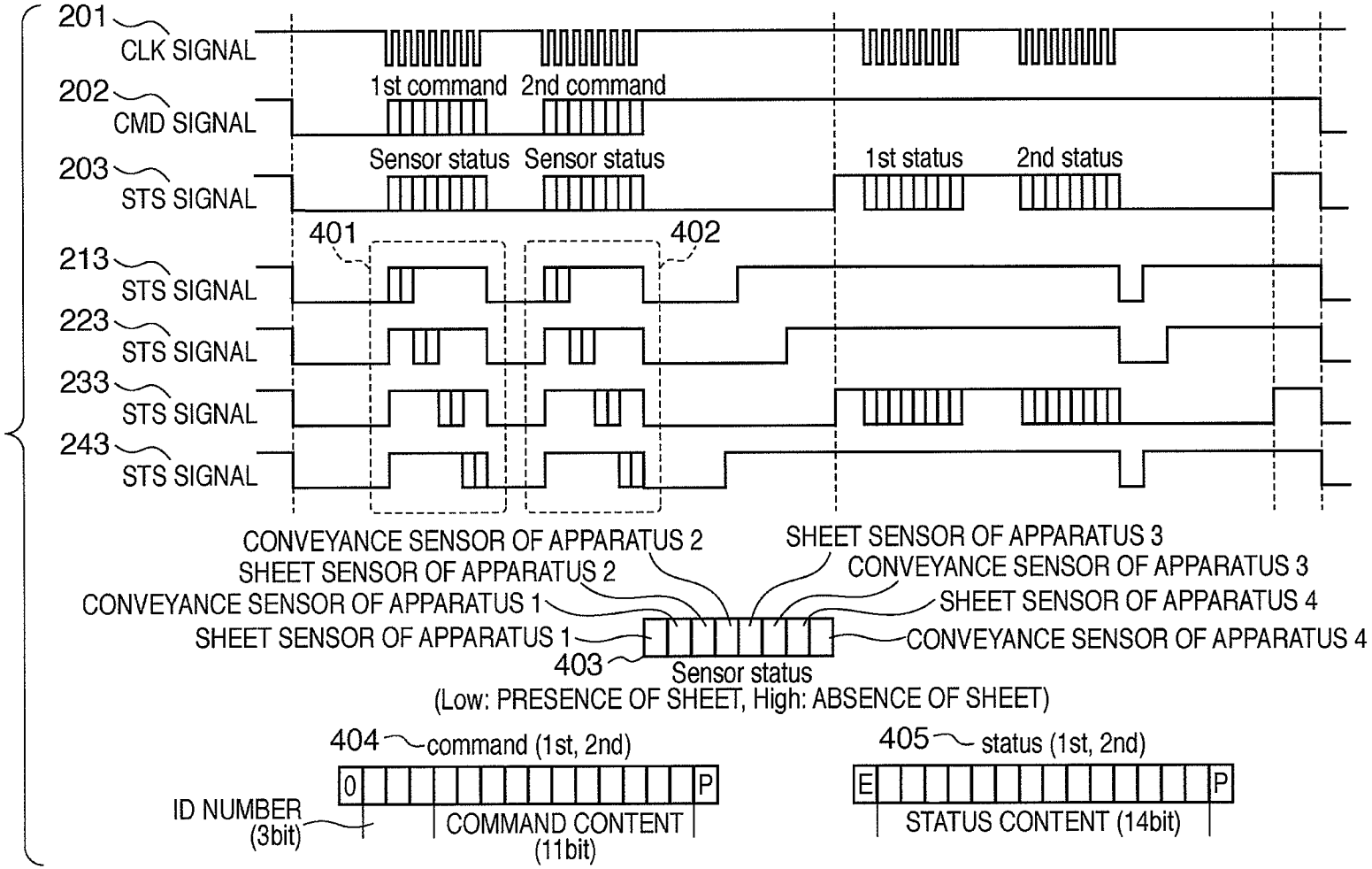
FIGS. 4A and 4B are communication timing charts between the image forming apparatus main body and option apparatuses.
Figure 4B:
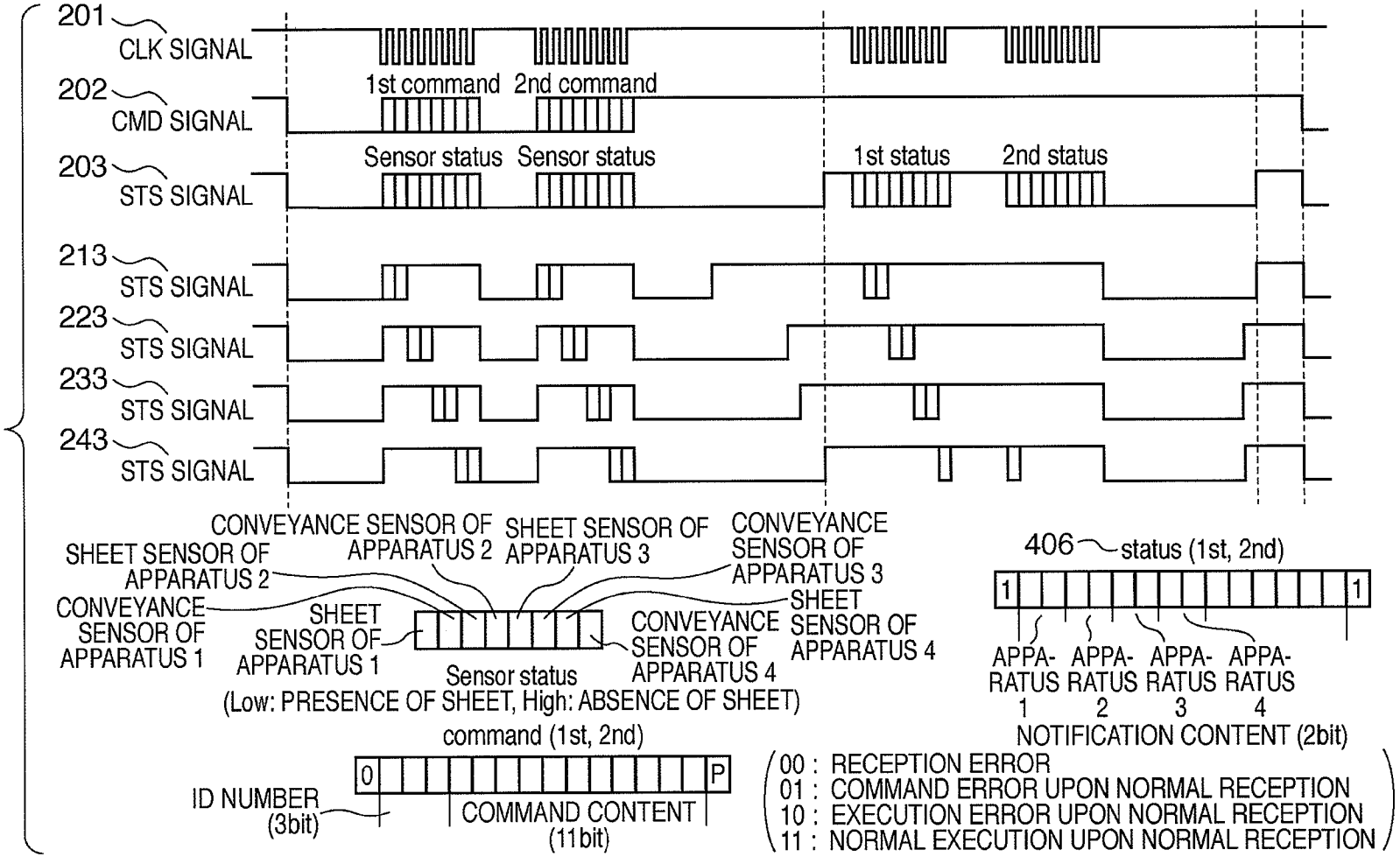

FIGS. 4A and 4B are communication timing charts of the image forming apparatus. The communication timing chart will be explained in detail below.

A timing chart of FIG. 4A shows individual communication with the option apparatuses. Before the start of communication, the option sheet feeding apparatuses 101, 102, 103, and 104 permit interrupts by the CMD interrupt signals 214, 224, 234, and 244.

The image forming apparatus main body 100 starts communication by changing the CMD signal 202 to Low. Then, interrupts occur by the CMD interrupt signals 214, 224, 234, and 244, and the option sheet feeding apparatuses 101, 102, 103, and 104 determine that the communication has started.

After determining that the communication has started, the option apparatuses prepare for transmission of sensor statuses and reception of commands, and change the STS signals 213, 223, 233, and 243 to Low level in order to send back information on their conveyance sensors and sheet sensors.

The image forming apparatus main body 100 sends command data by the CMD signal in synchronization with CLK, and receives status data as sensor information from the option apparatuses by the STS signals.

Simultaneously when the CPU 200 sends the CMD signal, the option sheet feeding apparatuses receive the command data by the CMD signal in synchronization with CLK, and transmit status data by the STS signals.

The status data STS signals output from the respective option apparatuses are represented in dotted frames 401 and 402 in the timing chart of FIG. 4A. In the dotted frames 401 and 402, the respective option apparatuses sequentially send back data of bits. As the STS signal 203, the control CPU 200 receives an STS signal output from each option apparatus via a negative-logic OR gate (Wired OR connection). For example, when the STS signal 213 is output, the outputs of the remaining STS signals 223, 233, and 243 are at High. The contents of the STS signal 203 are represented in 403 in the timing chart of FIG. 4A.

In the exemplary embodiment, 8-bit data are communicated twice, obtaining 16-bit data. Command data and status data each are 16-bit data as a unit obtained by communicating 8-bit data twice. Command data 404 of 16 bits contains an ID, command content, and parity bit P, as shown in FIG. 4A. Upon completion of transmitting and receiving 8 bits twice, the option sheet feeding apparatus checks the parity and determines whether an ID added to the command data 404 matches its ID.

In the example of the timing chart of FIG. 4A, the STS signal 233 is sent back. As is apparent from this, a command containing ID=3 targets the option sheet feeding apparatus 103.

The remaining option apparatuses 101, 102, and 104 determine that the ID does not match their IDs, prepare status data at FFh (all bits are at High), and prepare for the next status transmission. After the end of the preparation, the option apparatuses 101, 102, and 104 change the STS signals 213, 223, and 243 to High.

The target option apparatus 103 checks whether the added ID matches its ID, and determines whether the received command data is addressed to the option sheet feeding apparatus 103. If the option sheet feeding apparatus 103 determines that the received command data is addressed to it, it analyzes the command content, understands the meaning of the command, and prepares status data 405 to respond to the command. Then, the option sheet feeding apparatus 103 prepares for transmission of the status, and changes the STS signal 233 to High.

As shown in FIG. 4A, the status data 405 contains an error bit E representing the presence/absence of an error, a 14-bit status content, and a parity bit P.

The option apparatus 103 performs command analysis and status creation, and thus delays in changing the STS signal to High, compared to the remaining option apparatuses.

The STS signal is wired-OR-connected for low-true. When the STS signals 213, 223, 233, and 243 of all the option sheet feeding apparatuses change to High, the STS signal 203 also changes to High. After confirming that the STS signal 203 has changed to High, the image forming apparatus main body 100 receives status data by the STS signal in synchronization with CLK.

The option sheet feeding apparatuses 101, 102, 103, and 104 transmit status data by the STS signals 213, 223, 233, and 243 in synchronization with CLK.

As the wired-OR-connected STS signal 203, the image forming apparatus main body 100 receives the same data as status data of the option sheet feeding apparatus 103, and analyzes the status data.

The option apparatuses 101, 102, 103, and 104 change the STS signals 213, 223, 233, and 243 to Low after the end of status transmission, and upon completion of preparation for the next communication, change the STS signals to High.

The option apparatus 103 subjected to the command sometimes executes a received command. In this case, the option apparatus 103 delays in preparing for the next communication and changing the STS signal to High in comparison with the remaining apparatuses. After confirming that the STS signal 203 has changed to High for all the option apparatuses, the image forming apparatus main body 100 shifts to the next communication.

<Broadcast Communication Timing Chart>

A communication timing chart of FIG. 4B shows broadcast communication. "ID=0" attached to a command is a broadcast ID specially targeting all the option apparatuses. Upon receiving a command with ID=0, all the option apparatuses determine that the command is addressed to them, and analyze and execute the command.

A return status data 406 to the image forming apparatus main body 100 is different from the return status data 405 in the timing chart of FIG. 4A. In the returns status, "00" represents a reception error generated when a command could not be received normally. "01" represents a command error generated when a command was received but cannot be coped with. "10" represents an execution error generated when a command was received and can be coped with, but no execution condition is satisfied. "11" represents a normal state when a command was received, the condition is satisfied, and the command can be executed. The 2-bit notification information is set in correspondence with each option apparatus, and a predetermined bit position is defined in advance for each option apparatus.

Since all the apparatuses execute the command, the time until the STS signal changes to High upon completion of preparation for the next communication become long in all the apparatuses.

<Groupcast Communication Timing Chart 1>

Figure 5A:
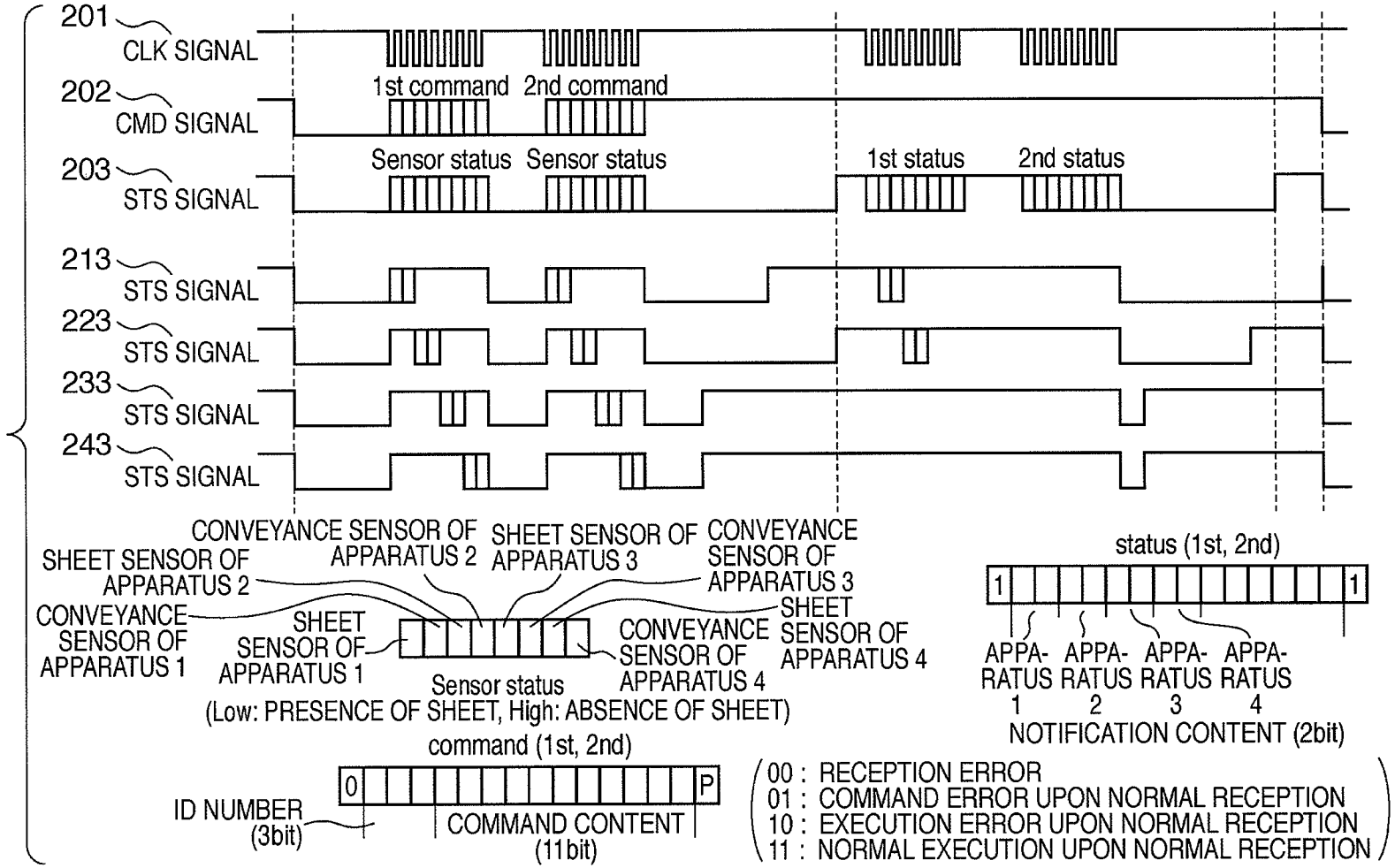
FIGS. 5A and 5B are communication timing charts between the image forming apparatus main body and option apparatuses.
Figure 5B:
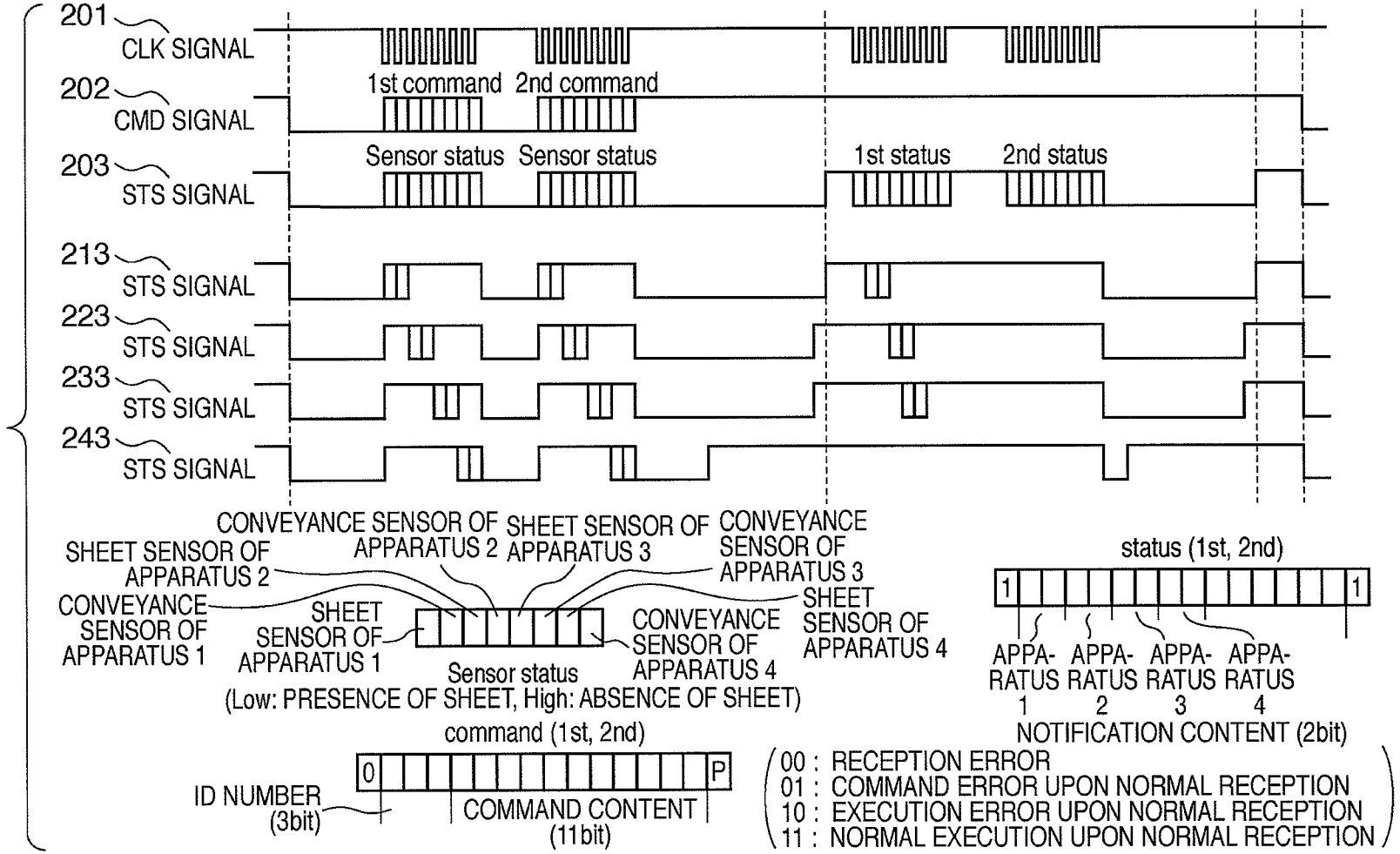

FIGS. 5A and 5B are communication timing charts of groupcast communication.

A timing chart of FIG. 5A shows a case in which the option apparatuses 101 and 102 are grouped. When the image forming apparatus main body 100 transmits a command containing ID=6, the option sheet feeding apparatuses 101 and 102 determine that the command is addressed to them, and analyze and execute the command.

As a return status to the image forming apparatus main body 100, each of only these two option sheet feeding apparatuses sends back 2-bit notification information at a predetermined position as status data.

In groupcasting as well as broadcasting, each target option sheet feeding apparatus sends back the return status 406 shown in the timing chart of FIG. 4B.

The remaining option apparatuses 103 and 104 send back FFh as a status. Since the target option apparatuses 101 and 102 execute the command, the time until the STS signal changes to High upon completion of preparation for the next communication become long in these two apparatuses.

<Groupcast Communication Timing Chart 2>

A timing chart of FIG. 5B shows a case in which the option apparatuses 101, 102, and 103 are grouped. When the image forming apparatus main body 100 transmits a command containing ID=7, the option sheet feeding apparatuses 101, 102, and 103 determine that the command is addressed to them, and analyze and execute the command.

As a return status to the image forming apparatus main body 100, each of only these three option sheet feeding apparatuses sends back 2-bit notification information at a predetermined position as status data. The remaining option apparatus 104 sends back FFh as a status. Since the target option apparatuses 101, 102, and 103 execute the command, the time until the STS signal changes to High upon completion of preparation for the next communication becomes long in these three apparatuses.

<ID Registration Command Communication Control Flowchart>

Figure 6:
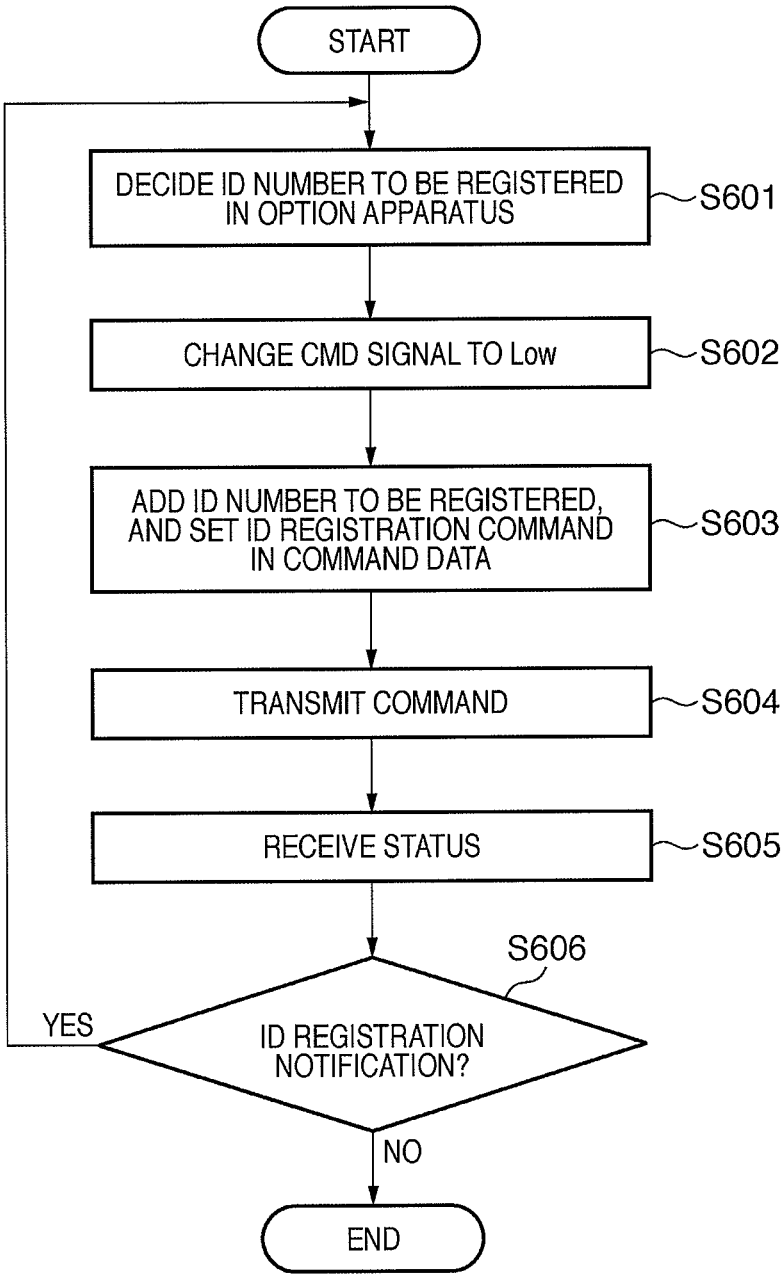
FIG. 6 is a flowchart of ID registration command communication control in the image forming apparatus main body.

FIG. 6 is a flowchart of ID registration command communication control in the image forming apparatus main body. The processes of respective steps are executed based on the operation of the main body control unit 30 shown in FIGS. 2A-2C.

In step S601, the image forming apparatus main body 100 decides an ID to be registered in an option apparatus.

More specifically, the image forming apparatus main body 100 sets ID=1 at the beginning. To notify the start of communication, the image forming apparatus main body 100 changes the CMD signal to Low (step S602).

In step S603, the image forming apparatus main body 100 sets, as command data, an ID registration command containing the ID (ID=1 at first) to be registered.

In step S604, the image forming apparatus main body 100 transmits the command data by the CMD signal in synchronization with the CLK signal.

In step S605, the image forming apparatus main body 100 waits until the STS signal changes to High, and then receives a status in synchronization with the CLK signal.

In step S606, the image forming apparatus main body 100 analyzes the received status to determine whether it is an ID registration notification status meaning that the ID has successfully been registered.

If the image forming apparatus main body 100 has received the ID registration notification status, another option apparatus may have been connected. Thus, the process returns to step S600 to set ID=2.

The image forming apparatus main body 100 repeats this operation to register ID=1 in the option apparatus 101, ID=2 in the option apparatus 102, ID=3 in the option apparatus 103, and ID=4 in the option apparatus 104. No ID registration notification status is sent back in response to an ID registration command containing ID=5. Thus, the image forming apparatus main body 100 determines that the IDs of all the option apparatuses have been registered (YES in step S606), and ends the process.

<Command Communication Control Flowchart>

Figure 7:
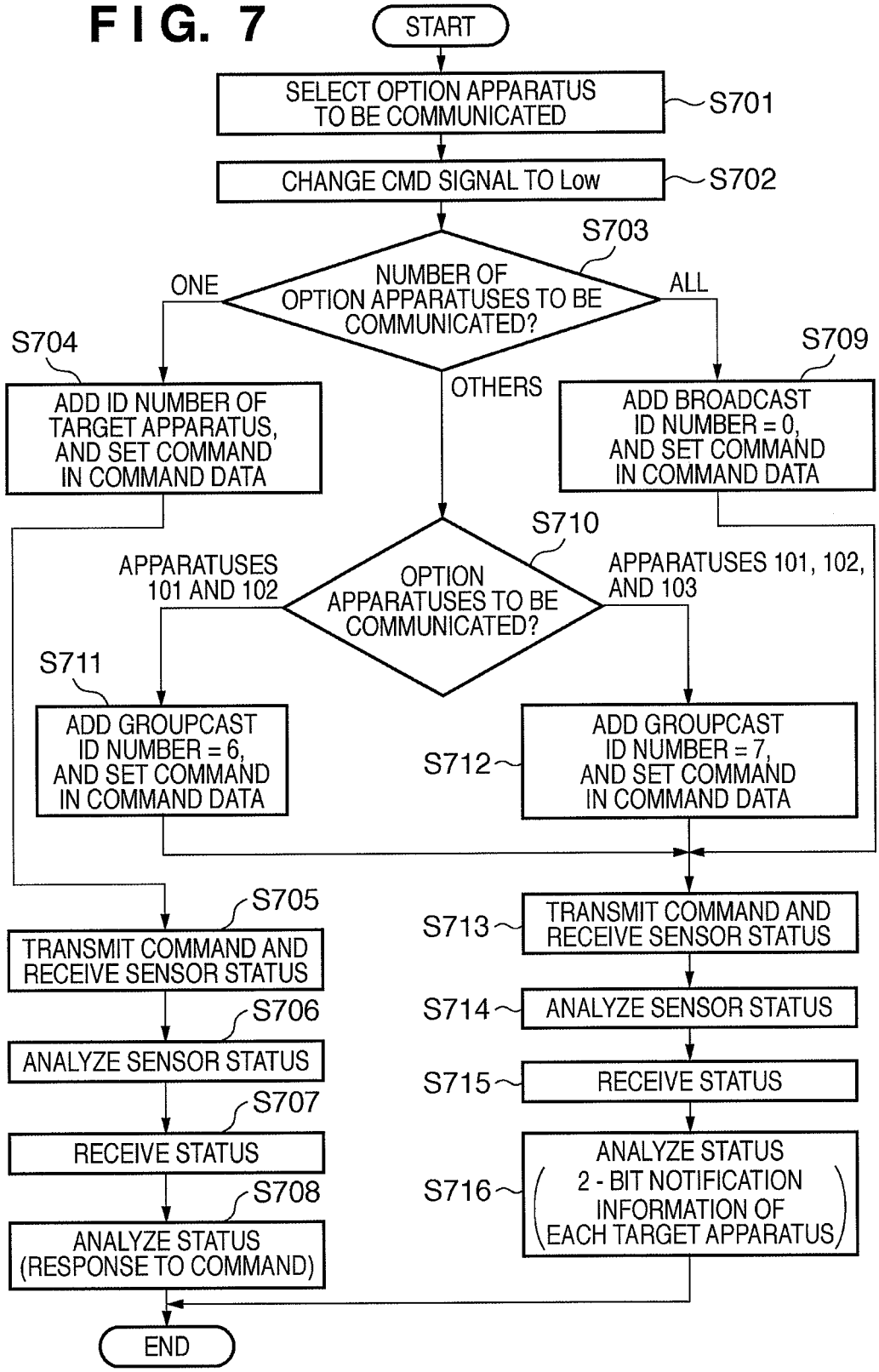
FIG. 7 is a flowchart of communication command transmission control in the image forming apparatus main body.

FIG. 7 is a flowchart of command communication control in the image forming apparatus main body.

The image forming apparatus main body 100 selects an option apparatus to be communicated (step S701).

More specifically, when feeding a print sheet from the feeding unit of each option apparatus, the image forming apparatus main body 100 selects the "option sheet feeding apparatus 101" for feeding from option sheet feeding apparatus 1. The image forming apparatus main body 100 selects an option group of the "option sheet feeding apparatuses 101 and 102" for feeding from option sheet feeding apparatus 2. The image forming apparatus main body 100 selects an option group of the "option sheet feeding apparatuses 101, 102, and 103" for feeding from option sheet feeding apparatus 3. The image forming apparatus main body 100 selects an option group of the "option sheet feeding apparatuses 101, 102, 103, and 104", that is, all the apparatuses to be driven for feeding from option sheet feeding apparatus 4.

To notify the start of communication, the image forming apparatus main body 100 changes the CMD signal to Low (step S702).

In step S703, the image forming apparatus main body 100 determines a combination of option apparatuses to be communicated.

If the image forming apparatus main body 100 determines in step S703 that the communication targets apparatus 1, it sets, as command data, a command containing the ID of the target apparatus (step S704). For example, when communicating with only the "option sheet feeding apparatus 101", the image forming apparatus main body 100 adds ID=1 to commands (e.g., feeding start command, feeding stop command, acceleration command, and deceleration command).

The image forming apparatus main body 100 transmits the command data by the CMD signal in synchronization with the CLK signal, and receives a sensor status by the STS signal (step S705). The image forming apparatus main body 100 analyzes the received sensor status to recognize the statuses of the conveyance sensor and sheet sensor of the apparatus (step S706). The image forming apparatus main body 100 waits until the STS signal changes to High, and then receives a status in synchronization with the CLK signal (step S707). The image forming apparatus main body 100 analyzes the received status to determine whether it means that the command has successfully been executed (step S708). Then, the process ends. If the status means that execution of the command has failed, the option sheet feeding apparatus 101 performs error processing such as communication retry, a description of which will be omitted.

If the image forming apparatus main body 100 determines in step S703 that the communication targets all the apparatuses, it sets, as command data, a command containing ID=0 meaning broadcasting (step S709). The image forming apparatus main body 100 adds ID=0 to commands (e.g., feeding start command, feeding stop command, acceleration command, and deceleration command).

If the image forming apparatus main body 100 determines "others" in step S703 and determines in step S710 that the communication targets the "option sheet feeding apparatuses 101 and 102", it adds a command meaning groupcasting. More specifically, the image forming apparatus main body 100 sets, as command data, a command containing ID=6 (step S711) The image forming apparatus main body 100 adds ID=6 to commands (e.g., feeding start command, feeding stop command, acceleration command, and deceleration command).

If the communication targets the "option sheet feeding apparatuses 101, 102, and 103" (step S710), the image forming apparatus main body 100 sets, as command data, a command containing ID=7 meaning groupcasting (step S712).

The image forming apparatus main body 100 adds ID=7 to commands (e.g., feeding start command, feeding stop command, acceleration command, and deceleration command).

After that, the image forming apparatus main body 100 performs the processes of steps S713 to S716. These steps are identical to steps S705 to S708 described above, and a detailed description thereof will not be repeated.

<Communication Command Execution Control Flowchart in Option Sheet Feeding Apparatus>

Figure 8A:
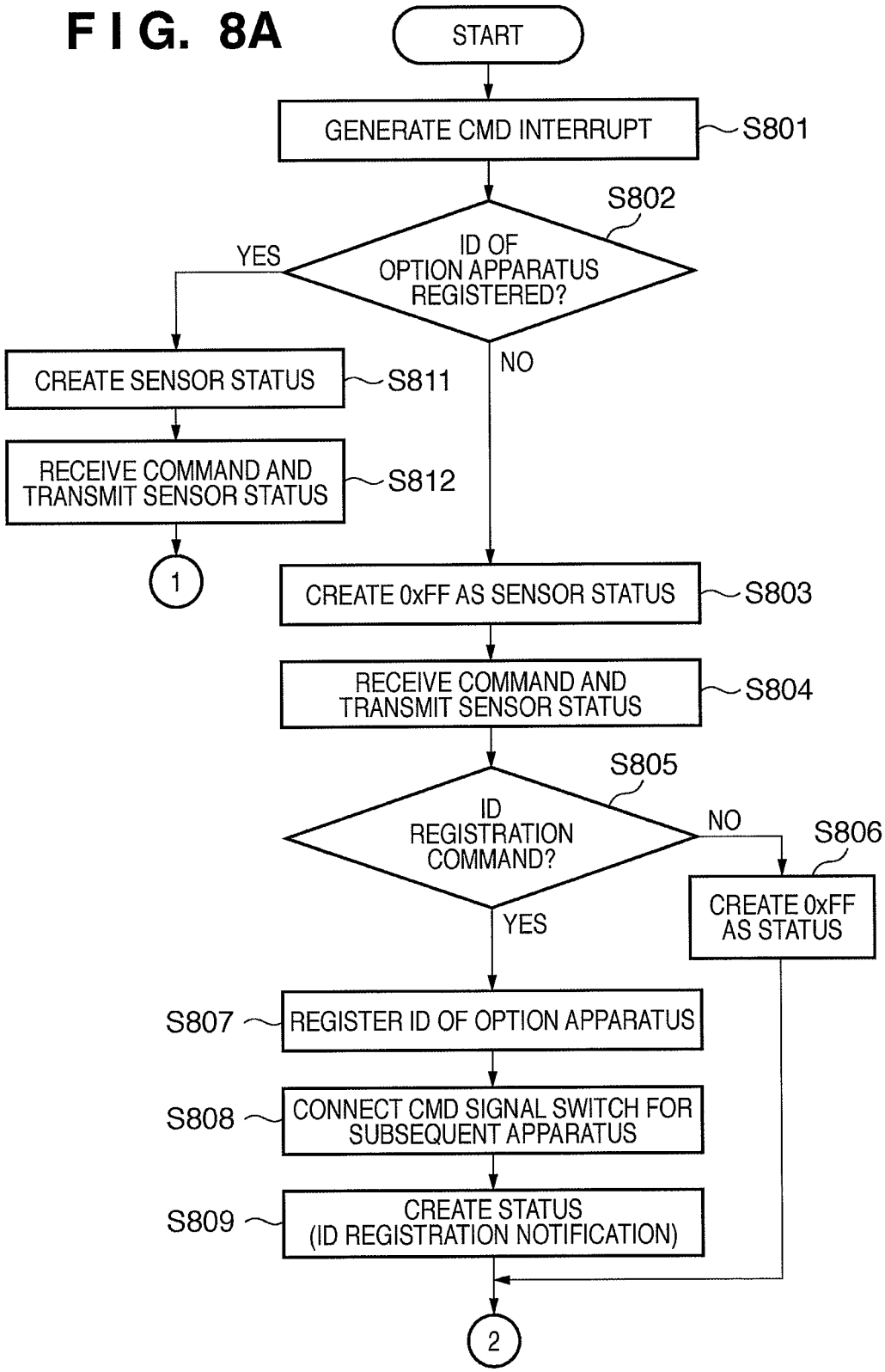

FIGS. 8A and 8B are flowcharts of communication command execution control in the option sheet feeding apparatus, unlike the flowchart of FIG. 7 showing control in the image forming apparatus main body.

The option sheet feeding apparatuses 101, 102, 103, and 104 are identical to each other, and attached by stacking them. The control CPUs 210, 220, 230, and 240 have the same control program, and the control changes depending on a registered ID.

When the image forming apparatus main body 100 changes the CMD signal to Low to notify the start of communication, each option sheet feeding apparatus detects that an interrupt has occurred by the CMD interrupt signal (step S801).

For preparation for communication, the option apparatus determines whether its ID has already been registered (step S802). If no ID has been registered, the option apparatus creates 0xFF as a sensor status (step S803).

The option apparatus receives command data by the CMD signal in synchronization with the CLK signal, and transmits the sensor status (0xFF in this case) by the STS signal (step S804).

The option apparatus analyses the received command data to determine whether it is an ID registration command (step S805). If the received command data is the ID registration command, the option apparatus registers the ID (step S807). In this case, the ID is registered by storing/setting a designated ID in the memory (not shown) of the option control unit so as to be able to refer it to later. This also applies to "registration" of another data.

The option sheet feeding apparatus connects the CMD signal switch for a cascade-connected option sheet feeding apparatus (step S808). The option sheet feeding apparatus creates an ID registration notification status and changes the STS signal to High (step S809). The option sheet feeding apparatus transmits the status in synchronization with the CLK signal, changes the STS signal to High (step S810), and then ends the process.

If the received command data is not the ID registration command (NO in step S805), the option sheet feeding apparatus creates 0xFF as a status, and changes the STS signal to High (step S806). The option sheet feeding apparatus transmits the status in synchronization with the CLK signal, changes the STS signal to High (step S810), and then ends the process.

If the option sheet feeding apparatus has already registered its ID (YES in step S802), it creates a sensor status in which information on the conveyance sensor and sheet sensor is set at a predetermined position determined by the ID of the option sheet feeding apparatus (step S811). The option sheet feeding apparatus receives the CMD signal in synchronization with the CLK signal, and transmits the sensor status by the STS signal (step S812). At this time, the option sheet feeding apparatus sequentially transmits the sensor status as bit data to the image forming apparatus main body 100 in response to reception of the CMD signal bit by bit.

The option sheet feeding apparatus analyses the received command data to determine whether it is an ID registration command (step S813). If the received command data is the ID registration command, the option sheet feeding apparatus creates 0xFF as a status to ignore the received ID command because the ID of the option sheet feeding apparatus has already been registered. After that, the option sheet feeding apparatus changes the STS signal to High (step S814). The option sheet feeding apparatus transmits the status in synchronization with the CLK signal, changes the STS signal to High (step S810), and ends the process.

If the received command data is not the ID registration command (NO in step S813), the option sheet feeding apparatus determines whether the ID added to the command matches its ID registration number (step S815). If the ID matches the ID registration number, the command targets only the option sheet feeding apparatus, so the option sheet feeding apparatus creates a notification status in response to the command and changes the STS signal to High (step S816). The option sheet feeding apparatus transmits the status in synchronization with the CLK signal (step S817), executes the command, changes the STS signal to High (step S818), and ends the process.

If the ID added to the command is 0 meaning broadcasting (YES in step S819), the option sheet feeding apparatus executes the process of step S820. Also when the groupcast ID=6 and the individual ID=1 or 2 (YES in step S821), the option sheet feeding apparatus executes the process of step S820. Also when the groupcast ID=7 and the individual ID=1, 2, or 3 (YES in step S822), the option sheet feeding apparatus executes the process of step S820.

In step S820, the option sheet feeding apparatus creates a status in which 2-bit notification information is set at a predetermined position determined by the ID of the option sheet feeding apparatus, and changes the STS signal to High. Thereafter, the option sheet feeding apparatus transmits the status in synchronization with the CLK signal (step S817), executes the command, changes the STS signal to High (step S818), and ends the process.

If the ID added to the command means neither broadcasting nor groupcasting, the option sheet feeding apparatus creates 0xFF as a status and changes the STS signal to High (step S823). The option sheet feeding apparatus transmits the created status in synchronization with the CLK signal, changes the STS signal to High again (step S810), and ends the process.

<Effects>

As described above, when conveying a recording medium by driving not all but two or more option apparatuses, a group identifier is added to designate and drive them at once. Accordingly, a print sheet conveyed throughout the option apparatuses can be controlled synchronously between the apparatuses while saving power not used for conveyance. In other words, while saving power not used for conveyance, a print sheet can be conveyed stably without pulling or thrusting it between the apparatuses. This control includes the start, stop, and speed change of conveyance of a recording medium.

A second exemplary embodiment will be described as follows.

Option sheet feeding apparatuses of the same type are attached by stacking them, so the user may erroneously attach more than the maximum number of option sheet feeding apparatuses.

The maximum number of connectable options is limited to prevent shortage of the power capacity, and fall of an image forming apparatus which becomes excessively high as a whole. As described with reference to the communication timing charts of FIGS. 4A, 4B, 5A and 5B in the first exemplary embodiment, the number of option apparatuses is limited to four in terms of the number of bits of information on the conveyance sensor and sheet sensor of each apparatus. In this way, there are various reasons for limiting the maximum number of connectable options.

In an image forming apparatus according to the second exemplary embodiment, processing when the user erroneously adds one more option sheet feeding apparatus to the image forming apparatus according to the first exemplary embodiment and the option sheet feeding apparatuses exceed the maximum connectable count will be described.

<Sectional View of Image Forming Apparatus>

Figure 9:
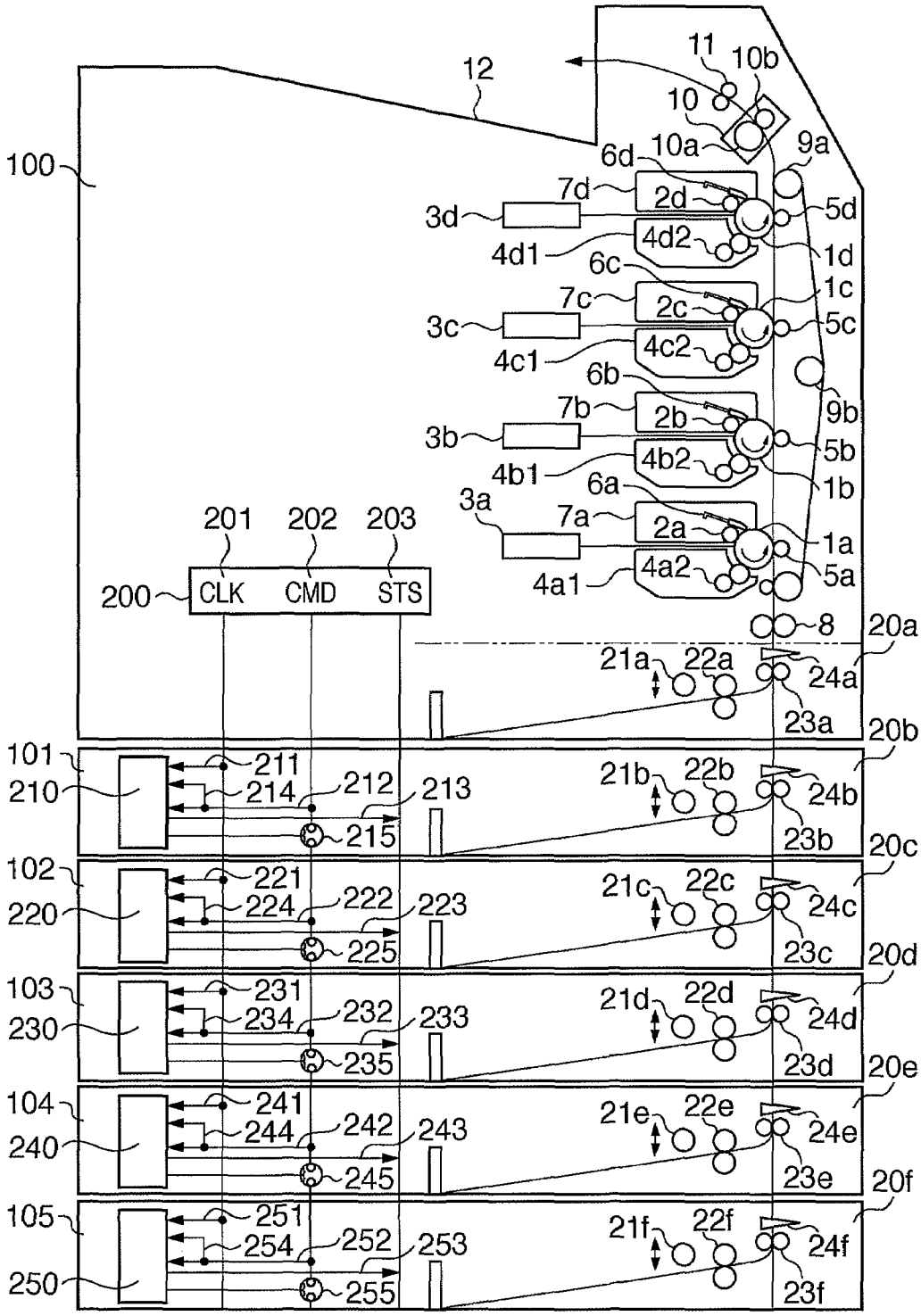
FIG. 9 is a sectional view showing an exemplary embodiment of an image forming apparatus (image forming apparatus main body and option apparatuses) and communication interface.

FIG. 9 is a sectional view of the image forming apparatus. In FIG. 9, the user erroneously attaches an option sheet feeding apparatus 105 below an option sheet feeding apparatus 104 in FIG. 1. The second exemplary embodiment is different from the first exemplary embodiment in that five option sheet feeding apparatuses are attached though the image forming apparatus can cope with a maximum of four option sheet feeding apparatuses. The remaining arrangement is the same as that in FIG. 1, and a description thereof will hot be repeated.

<Functional Block Diagram of Image Forming Apparatus>

Figure 2B:
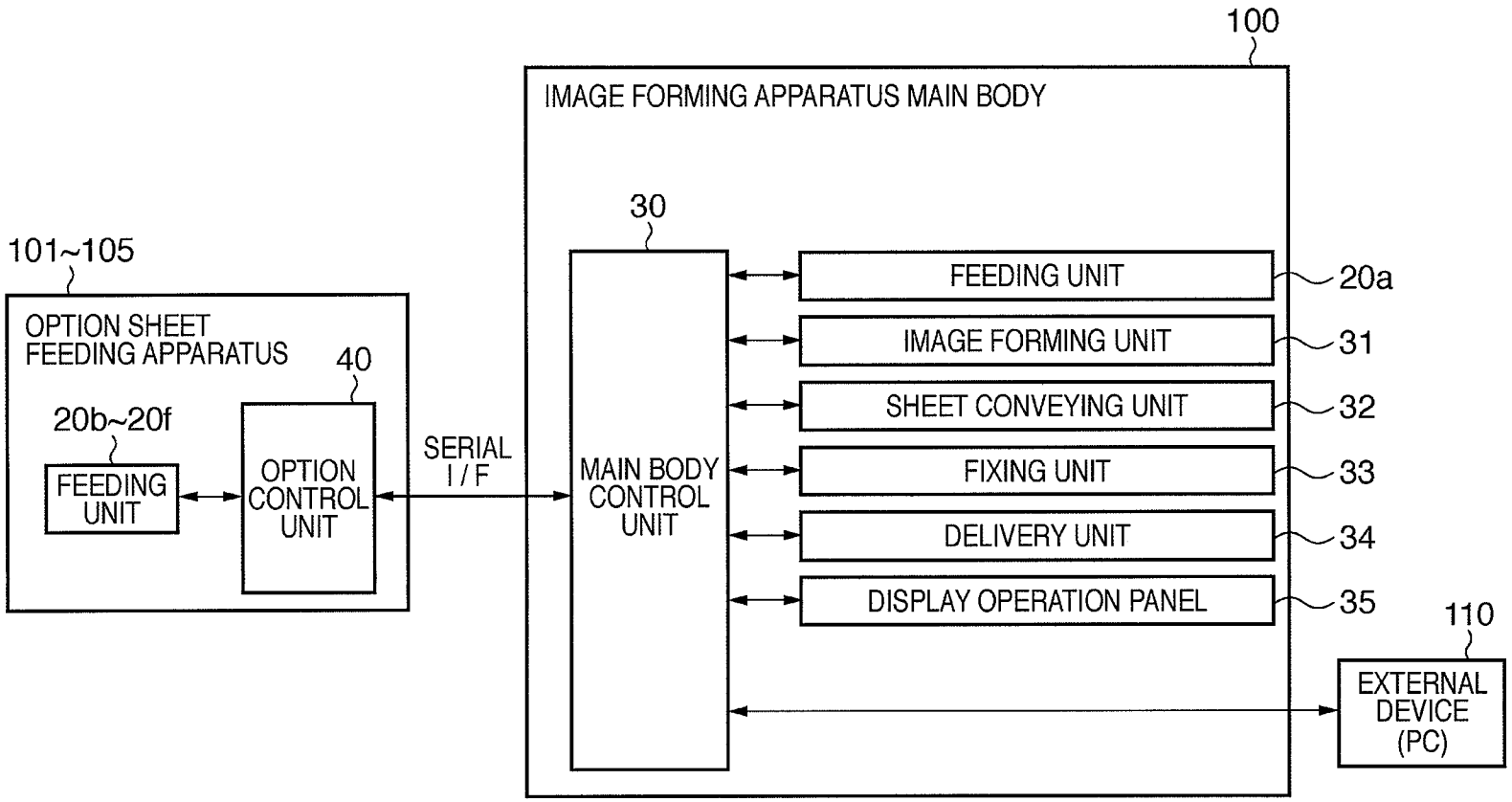

FIG. 2B represents the functional arrangement of the image forming apparatus. The arrangement of FIG. 2B is different from that of FIG. 2A in that the option sheet feeding apparatus 105 and a feeding unit 20*f* are added.

<Communication Interface Between Image Forming Apparatus Main Body and Option Apparatus>

Referring back to FIG. 9, a communication interface will be explained.

Since the option sheet feeding apparatus 105 is added, a control CPU 250, CLK reception signal 251, CMD reception signal 252, STS transmission signal 253, CMD interrupt signal 254, and switch 255 are added to FIG. 1. The communication method, the ID registration method while connecting/disconnecting the switch, and the like are the same as those in the first exemplary embodiment, and a description thereof will not be repeated.

<Simultaneous Driving of Option Apparatuses>

A method of designating and driving a plurality of option apparatuses at once by the image forming apparatus of the second exemplary embodiment will be explained with reference to FIG. 3 of the first exemplary embodiment. In the second exemplary embodiment, the option sheet feeding apparatus 105 is further added below the option sheet feeding apparatus 104 in 300*a* to 300*d* of FIG. 3.

The image forming apparatus cannot cope with one more option sheet feeding apparatus 105 exceeding the limit of four, and does not feed a sheet from it. Feeding from option sheet feeding apparatuses 101, 102, and 103 and the option sheet feeding apparatus 104 is the same as that in the first exemplary embodiment. Grouping of option apparatuses for synchronously conveying a print sheet throughout them is also the same.

FIG. 33 shows a list of IDs to be added to commands and target option sheet feeding apparatuses in the second exemplary embodiment. The image forming apparatus main body 100 does not cope with the option sheet feeding apparatus 105, and excludes it from broadcasting specially designating ID=0.

If one more noncompliant option sheet feeding apparatus 105 is attached, the five apparatuses cannot operate simultaneously because the power capacity will run short, but the four remaining option sheet feeding apparatuses may not operate unless the fifth apparatus operates. If one more noncompliant option sheet feeding apparatus 105 is attached, feeding of the fifth apparatus cannot be controlled because notification of its sensor status cannot be given, but the four remaining option sheet feeding apparatuses may operate. In these cases, all the apparatuses subjected to broadcasting with ID=0 are limited to the four remaining apparatuses. With this setting, feeding from the four option sheet feeding apparatuses can be done similarly to the first exemplary embodiment. This will be explained in detail with reference to the flowcharts of FIGS. 12A and 12B to be described later.

<Communication Timing Chart>

Figure 10:
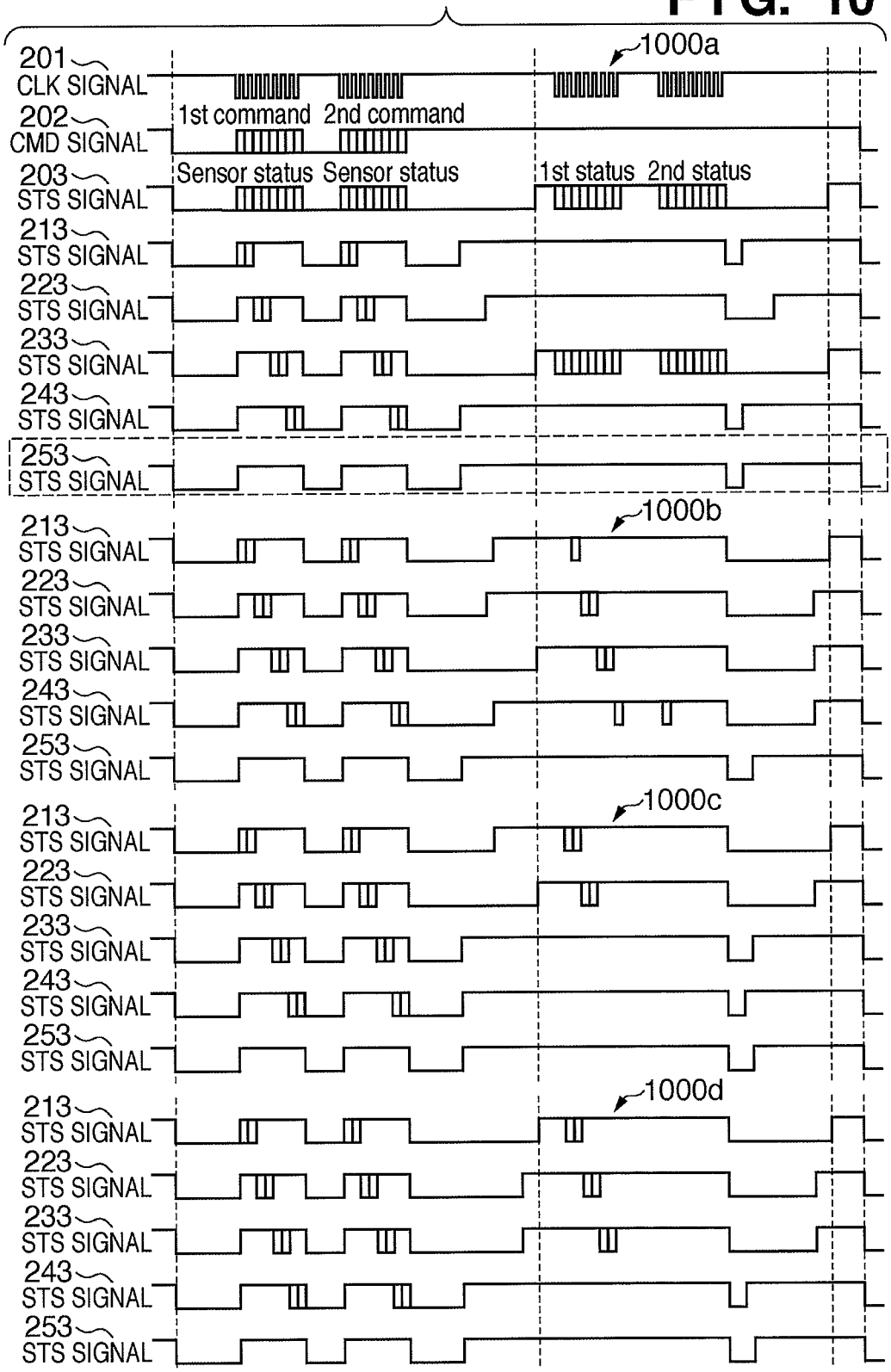
FIG. 10 is a communication timing chart between the image forming apparatus main body and option apparatuses.

FIG. 10 is a communication timing chart of the image forming apparatus.

A timing chart 1000*a* shows communication by designating the ID of only a specific option apparatus.

In the chart 1000*a*, the STS signal 253 of the option sheet feeding apparatus 105 is added to the chart of FIG. 4A. The difference will be mainly explained. Although a CLK signal 201, CMD signal 202, and STS signal 203 are not shown in 1000*b* to 1000*d*, the same signals as those in 1000*a* exist in practice.

A sensor status for exchanging information about the conveyance sensor and sheet sensor of each apparatus for every communication includes 1-bit conveyance sensor information and 1-bit sheet sensor information of each option apparatus. The sensor status is made up of 8 bits for four option apparatuses.

The sensor status having the same contents is communicated successively twice. If the two sensor statuses match each other, an image forming apparatus main body 100 adopts them. If the two sensor statuses do not match each other, the image forming apparatus main body 100 determines that data have changed, and does not employ them.

The sensor status does not have bits for arranging information on the conveyance sensor and sheet sensor of the option apparatus 105. Thus, the option apparatus 105 always outputs 0xff (all bits are at High) as the sensor status. This can prevent an adverse effect on the sensor statuses of the four remaining option apparatuses in the wired-OR-connected STS signal 203.

<Broadcast Communication Timing Chart>

A communication timing chart 1000*b* shows broadcast communication.

In the chart 1000*b*, the chart of the STS of the option sheet feeding apparatus 105 is added to the chart of FIG. 4B. Only the difference will be explained.

The sensor status does not have bits for assigning information on the conveyance sensor and sheet sensor of the option apparatus 105. Thus, the option apparatus 105 always outputs 0xff (all bits are at High) as the sensor status so as not to adversely affect the sensor statuses of the four remaining option apparatuses. Even broadcasting does not target the option sheet feeding apparatus 105, as described with reference to FIG. 33. The option apparatus 105 outputs 0xff (all bits are at High) as the status so as not to adversely affect notification information of the remaining option apparatuses.

<Groupcast Communication Timing Chart>

Timing charts 1000*c* and 1000*d* show groupcast communication. In the charts 1000*c* and 1000*d*, the chart of the STS signal 253 of the option sheet feeding apparatus 105 is added to the charts in FIG. 5A and 5B. The sensor status is also the same as that shown in the chart 100*b*, and a detailed description thereof will not be repeated.

<ID Registration Command Communication Control Flowchart>

Figure 11:
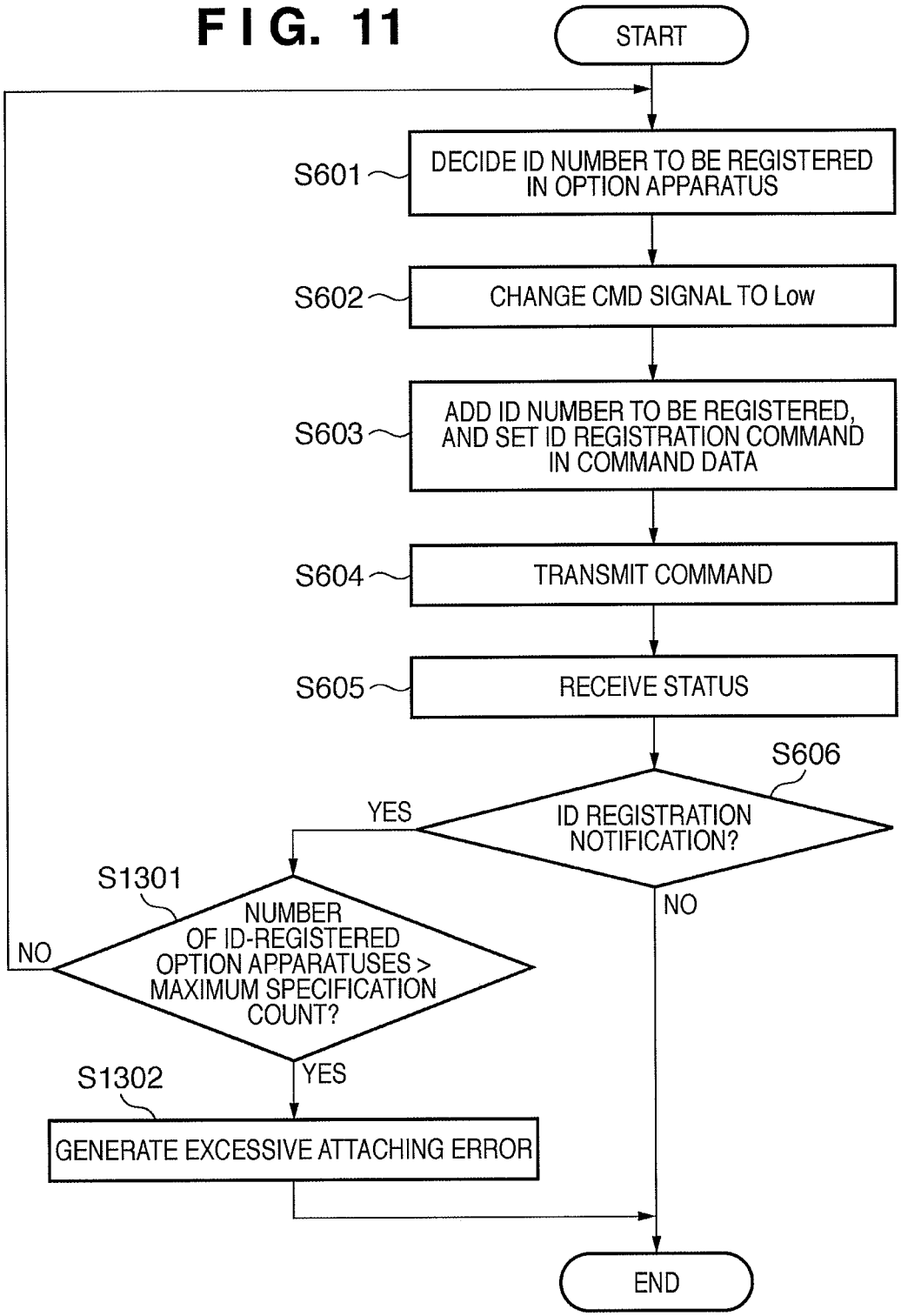
FIG. 11 is a flowchart of ID registration command communication control in the image forming apparatus main body.

FIG. 11 is a flowchart of ID registration command communication control in the image forming apparatus main body.

This sequence is different from the first exemplary embodiment (FIG. 6) in that steps S1301 and S1302 are added. Steps S601 to S606 are the same as those in the first exemplary embodiment, and a description thereof will not be repeated.

When the image forming apparatus main body 100 registers ID=1 in the first option apparatus 101 and receives a registration notification, the number of attached option apparatuses does not exceed the maximum number of four in step S1301, so the process returns to step S601. The image forming apparatus main body 100 repeats the same operation to register ID=2 in the option apparatus 102, ID=3 in the option apparatus 103, and ID=4 in the option apparatus 104.

When the image forming apparatus main body 100 registers ID=5 in the option apparatus 105 and receives a registration notification, the number of attached option apparatuses exceeds the maximum number of four in step S1301. Thus, the image forming apparatus main body 100 determines that an excessive attaching error has occurred (step S1301), and ends the process without registering ID=6.

According to this method, even if the user attaches as many as six option sheet feeding apparatuses, the image forming apparatus main body 100 does not transmit a registration command of ID=6. This prevents a confusion between ID=6 to be registered in the sixth apparatus and the groupcast ID=6.

If the image forming apparatus main body 100 determines that an excessive attaching error has occurred, it displays a warning error message to the user on a display operation panel 35 (step S1302). An example of the warning error message is "A maximum of four option sheet feeding apparatuses are attachable. Detach the fifth or more option sheet feeding apparatuses." Instead of the error notification display, an error message may be sent to an external computer via a communication line.

Even when five or more option sheet feeding apparatuses are attached, the option sheet feeding apparatuses 101, 102, 103, and 104 can normally perform a feeding operation, and can achieve feeding and printing, excluding the option sheet feeding apparatus 105.

For example, attaching five or more option sheet feeding apparatuses is inhibited because the image forming apparatus becomes excessively high as a whole and highly likely falls. In this case, sheet feeding and printing from all feeding units may also be inhibited until the user detaches excessively attached apparatuses.

<Command Communication Control Flowchart>

The command communication control flowchart in the image forming apparatus main body according to the second exemplary embodiment is basically the same as that in FIG. 7. Only a difference will be described.

"All" as a choice in step S703 is rewritten into "all except for an option apparatus causing an excessive attaching error".

<Communication Command Execution Control Flowchart in Option Sheet Feeding Apparatus>

Figure 12A:
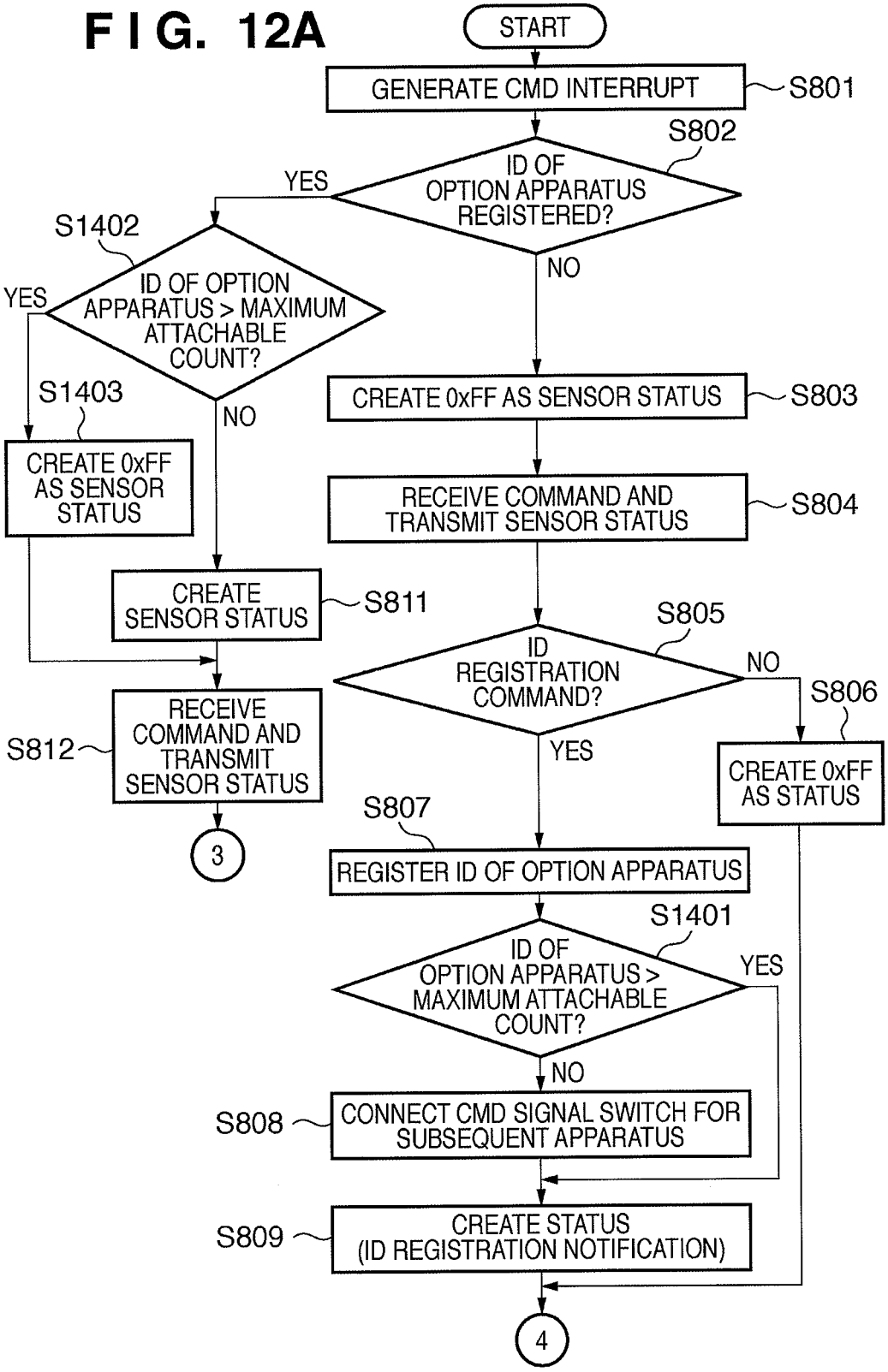

FIGS. 12A and 12B are flowcharts of communication command execution control in the option sheet feeding apparatus. This sequence is different from FIGS. 8A and 8B in that steps S1401 to S1404 are added. Only a difference will be described.

In step S1401, the option sheet feeding apparatus determines whether the ID has exceeded the maximum attachable count. If the option sheet feeding apparatus determines that the ID does not exceed the maximum attachable count (ID=1, 2, 3, and 4 representing the option sheet feeding apparatuses 101, 102, 103, and 104), it connects the switch to a subsequent apparatus (step S808).

If the option sheet feeding apparatus determines in step S1401 that the ID has exceeded the maximum attachable count (ID=5 representing the option sheet feeding apparatus 105), it keeps the switch non-connected to a subsequent apparatus without executing step S808.

Even when the user attaches as many as six option sheet feeding apparatuses, no CMD signal line is connected to the sixth option sheet feeding apparatus. No interrupt occurs in the CMD interrupt signal line of the sixth option sheet feeding apparatus, and the sixth option sheet feeding apparatus does not participate in the communication between the apparatuses. It is prevented to register ID=6 in the sixth option sheet feeding apparatus so as not to confuse a command containing ID=6 as the individual ID=6 for the sixth option sheet feeding apparatus or the groupcast ID=6. The groupcast ID means an identifier simultaneously designating not all but two or more option apparatuses attached to the image forming apparatus.

In step S1402, the option sheet feeding apparatus determines whether its registered ID has reached the maximum attachable count. If the option sheet feeding apparatus determines that its registered ID does not exceed the maximum attachable count (ID=1, 2, 3, and 4 for the option sheet feeding apparatuses 101, 102, 103, and 104), it creates a sensor status (step S811), and continues communication.

If the option sheet feeding apparatus determines in step S1402 that its registered ID has exceeded the maximum attachable count (e.g., ID=5 for the option sheet feeding apparatus 105), it creates 0xFF as a sensor status, and continues communication. This is because there is no bit for assigning information on the conveyance sensor and sheet sensor.

In step S1404, the option sheet feeding apparatus determines whether its ID has exceeded the maximum attachable count. If the option sheet feeding apparatus determines that the ID does not exceed the maximum attachable count (ID=1, 2, 3, and 4 for the option sheet feeding apparatuses 101, 102, 103, and 104), it determines whether it is a target of broadcasting or groupcasting, and then continues communication.

If the option sheet feeding apparatus determines in step S1404 that the ID has exceeded the maximum attachable count (e.g., ID=5 for the option sheet feeding apparatus 105), it is not designated as a broadcast or groupcast target and thus sets 0xFF as a status (step S814). Then, the option sheet feeding apparatus transmits the set status (step S810), and ends the process without executing the command.

In the process of step S1404, an option apparatus having an ID exceeding the maximum attachable count ignores broadcast communication designated by the broadcast ID. As a result, the remaining option apparatuses falling within the maximum attachable count can operate to normally print.

<Effects>

As described above, if option apparatuses are attached more than the attachable count, the image forming apparatus can detect an excessive apparatus error to output a warning message to the user to detach an excessively attached apparatus.

An excessively attached option apparatus ignores broadcasting and groupcasting, and the remaining option apparatuses can operate normally.

It can be prevented that option apparatuses are connected more than the connectable count to the image forming apparatus and cannot be operated normally by the supported power capacity.

No communication is established when option apparatuses are connected by two or three more than the maximum attachable count. This can prevent wasteful communication.

An option apparatus having an ID exceeding the maximum attachable count remains non-connected without switching either the clock signal or data signal from a connected state to a non-connected state to a downstream cascade-connected option apparatus. This maintenance unit can prevent erroneous communication because communication with an apparatus further exceeding (maximum attachable count+1) is not established.

A third exemplary embodiment will be described as follows.

In the third exemplary embodiment, different kinds of option apparatuses are attached. The above-described processing is also applicable to different kinds of option apparatuses.

<Sectional View of Image Forming Apparatus>

Figure 13:
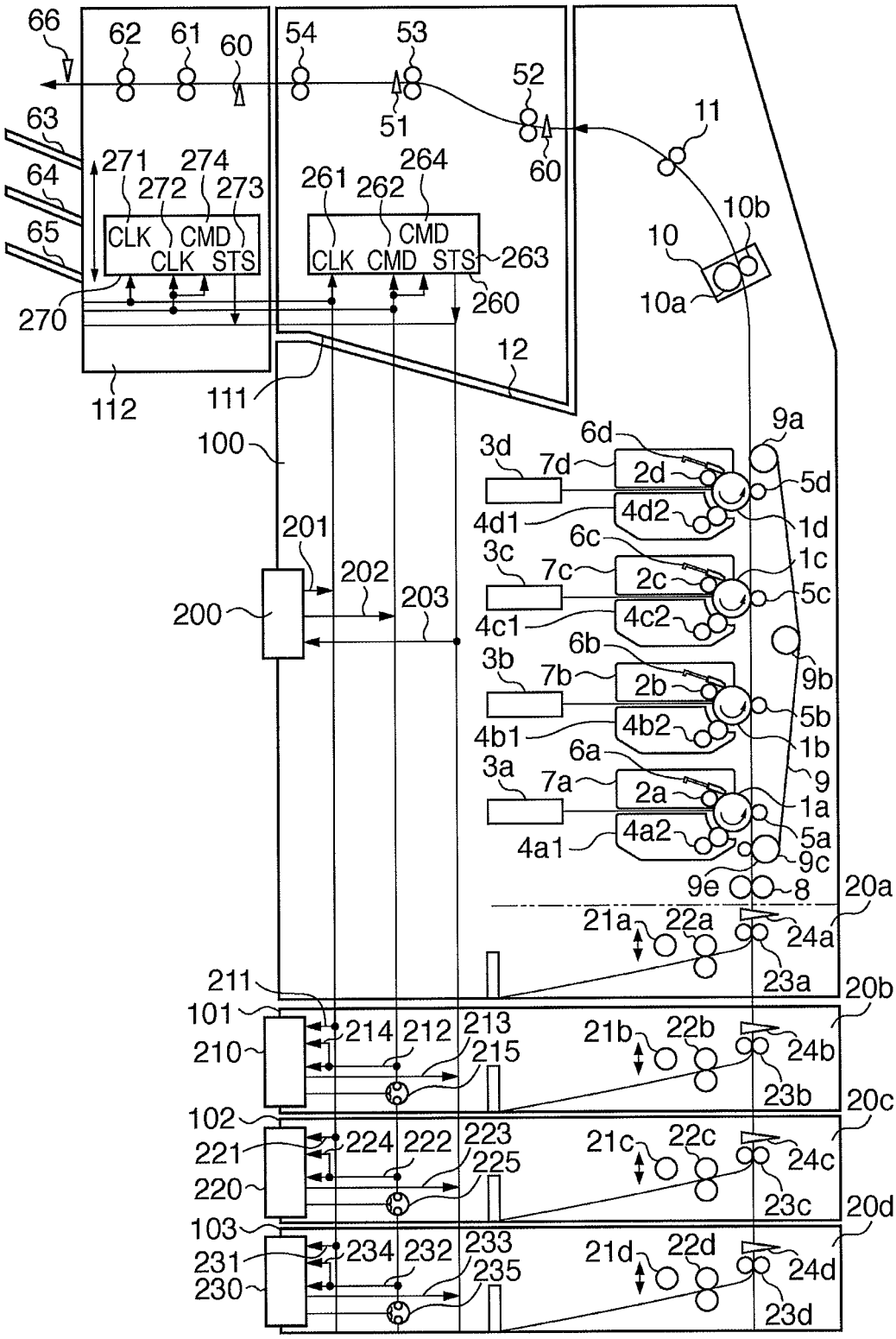
FIG. 13 is a sectional view showing an exemplary embodiment of an image forming apparatus (image forming apparatus main body and option apparatuses) and communication interface.

FIG. 13 is a sectional view of an image forming apparatus. Option sheet feeding apparatuses 101, 102, and 103, an option delivery apparatus 112, and an option intermediate conveying apparatus 111 are connected to an image forming apparatus main body 100. The intermediate conveying apparatus 111 has a function of conveying a print sheet between the image forming apparatus main body 100 and the option delivery apparatus 112.

In FIG. 13, a maximum of two option sheet feeding apparatuses can operate, and the user erroneously attaches one more option sheet feeding apparatus 103.

The image forming apparatus main body 100 and the option sheet feeding apparatuses 101, 102, and 103 are the same as those in the above-described embodiments. The option intermediate conveying apparatus 111 and option delivery apparatus 112 will be explained.

The option intermediate conveying apparatus 111 receives a print sheet from the image forming apparatus main body 100, conveys it by conveying rollers 52, 53, and 54, and transfers it to the option delivery apparatus 112. An intermediate entrance sensor 50 and intermediate conveyance sensor 51 detect the leading and trailing ends of a print sheet, grasping its positional relationship. After the print sheet passes through the rear end of the image forming apparatus main body, the option intermediate conveying apparatus 111 accelerates the print sheet and transfers it to the option delivery apparatus 112. While the print sheet extends over the option intermediate conveying apparatus 111 and the option delivery apparatus 112, the option intermediate conveying apparatus 111 accelerates and conveys the print sheet in synchronization with the option delivery apparatus 112. When the trailing end of the sheet has passed through the conveying rollers 54, the option intermediate conveying apparatus 111 returns the speed to an original one, and receives a subsequent sheet from the image forming apparatus main body 100.

The option delivery apparatus 112 receives a print sheet from the option intermediate conveying apparatus 111, conveys it by conveying rollers 61 and 62, and discharges it to one of an upper delivery bin 63, middle delivery bin 64, and lower delivery bin 65. These delivery bins are vertically movable together, and are freely selected to discharge a print sheet. When discharging print sheets while switching the delivery bins in continuous printing, a print sheet is accelerated and conveyed in synchronization with the option intermediate conveying apparatus to widen the interval between the print sheet and a subsequent sheet. Meanwhile, the delivery bins are switched by moving them up and down, discharging the print sheets. A delivered sheet full sensor 66 can detect whether the delivery bin is full of print sheets.

<Functional Block Diagram of Image Forming Apparatus>

Figure 2C:
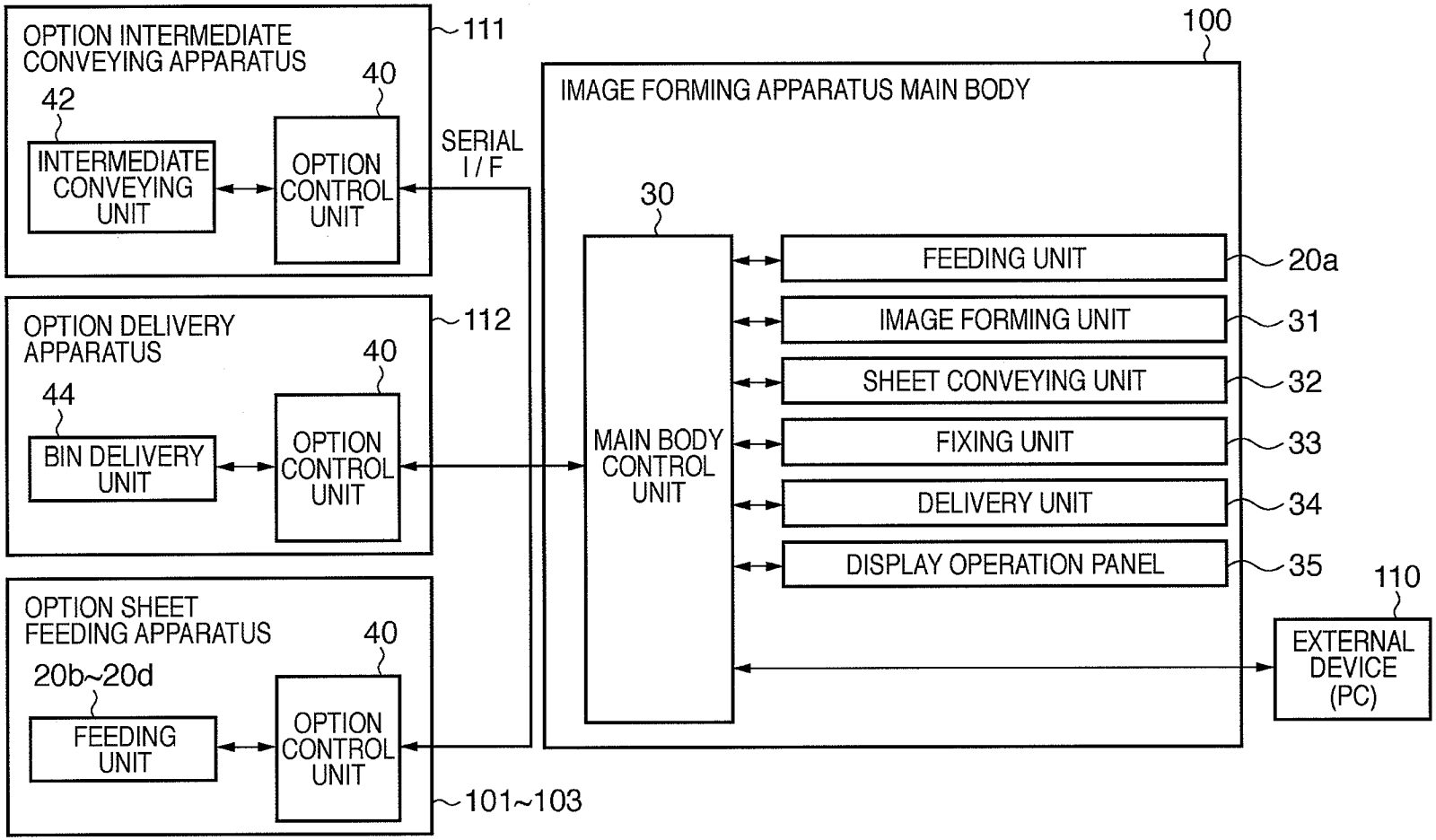

FIG. 2C represents the functional arrangement of the image forming apparatus.

The image forming apparatus main body 100 and the option sheet feeding apparatuses 101 to 103 are the same as those in the first exemplary embodiment, and a description thereof will not be repeated.

The option intermediate conveying apparatus 111 includes an option control unit 41, which is formed from a microcomputer (a control CPU 260 in FIG. 13).

While communicating with a main body control unit 30 via a serial interface, the option control unit 41 conveys a print sheet to an intermediate conveying unit 42 made up of the sensors 50 and 51 and the conveying rollers 52 to 54, transferring the print sheet from the image forming apparatus main body to the option delivery apparatus.

The option delivery apparatus 112 includes an option control unit 43, which is formed from a microcomputer (a control CPU 270 in FIG. 13). While communicating with the main body control unit 30 via a serial interface, the option control unit 43 conveys and delivers a print sheet to a bin delivery unit 44 made up of a sensor 60, the conveying rollers 61 and 62, the bins 63 to 65, and the sensor 66, thereby discharging the print sheet to the bin.

<Communication Interface Between Image Forming Apparatus Main Body and Option Apparatus>

FIG. 13 is also an interface view for explaining a communication interface. In FIG. 13, the option sheet feeding apparatus 104 in FIG. 1 is omitted, and the option intermediate conveying apparatus 111 and option delivery apparatus 112 are added.

In the option intermediate conveying apparatus 111, the control CPU 260 communicates with a control CPU 200 of the image forming apparatus main body using a CLK reception signal 261, CMD reception signal 262, STS transmission signal 263, and CMD interrupt signal 264.

In the option delivery apparatus 112, the control CPU 270 communicates with the control CPU 200 of the image forming apparatus main body using a CLK reception signal 271, CMD reception signal 272, STS transmission signal 273, and CMD interrupt signal 274.

The intermediate conveying apparatus 111 and option delivery apparatus 112 do not include a switch because they are connected directly via connectors. To the contrary, the option sheet feeding apparatuses are cascade-connected and connected to the image forming apparatus main body one by one via switches.

Upon power-on, the CMD signal is supplied to three option apparatuses, that is, the option intermediate conveying apparatus 111, option delivery apparatus 112, and option sheet feeding apparatus 101. The image forming apparatus main body 100 transmits the first ID registration command to the three option apparatuses simultaneously.

It is set in advance to accept only ID=1 by the option intermediate conveying apparatus 111, only ID=2 by the option delivery apparatus 112, and ID=one of 3, 4, 5 by the option sheet feeding apparatus. Upon power-on, none of the option apparatuses registers an ID. In this case, the switches of the option sheet feeding apparatuses are non-connected not to receive the CMD signal.

In other words, all the switches 215, 225, and 235 are open. The image forming apparatus main body 100 transmits a command designating ID=1 by the CMD signal. This process corresponds to steps S2001 to S2004 in FIG. 17.

The three, option intermediate conveying apparatus 111, option delivery apparatus 112, and option sheet feeding apparatus 101 can receive this command. In this case, only the option intermediate conveying apparatus 111 is set to accept ID=1. The option delivery apparatus 112 registers its ID=1, and transmits (sends back) the STS signal to the image forming apparatus main body 100 to notify it that the option intermediate conveying apparatus 111 has registered ID=1. A process of the image forming apparatus main body 100 for the reply corresponds to steps S2005 and S2006 in FIG. 17.

Then, the image forming apparatus main body 100 transmits a command designating ID=2. This process corresponds to steps S2007 to S2010 in FIG. 17.

The three, option intermediate conveying apparatus 111, option delivery apparatus 112, and option sheet feeding apparatus 101 can receive this command. In this case, only the option delivery apparatus 112 is set to accept ID=2. The option delivery apparatus 112 registers its ID=2, and transmits (sends back) the STS signal to the image forming apparatus main body 100 to notify it that the option delivery apparatus 112 has registered ID=2. A process of the image forming apparatus main body 100 for the reply corresponds to steps S2011 and S2012 in FIG. 17.

Subsequently, the image forming apparatus main body 100 transmits a command designating ID=3. This process corresponds to steps S601 to S604 in FIG. 17.

The three, option intermediate conveying apparatus 111, option delivery apparatus 112, and option sheet feeding apparatus 101 can receive this command. In this case, only the option sheet feeding apparatus 101 is set to accept ID=3. The option sheet feeding apparatus 101 registers its ID=3, connects the switch 215, and transmits (sends back) the STS signal to the image forming apparatus main body 100 to notify it that the option sheet feeding apparatus 101 has registered ID=3. A process of the image forming apparatus main body 100 for the reply corresponds to step S605 in FIG. 17.

The image forming apparatus main body 100 transmits a command designating ID=4. The four, option intermediate conveying apparatus 111, option delivery apparatus 112, and option sheet feeding apparatuses 101 and 102 can receive this command. It is set to accept ID=4 by the option sheet feeding apparatuses 101 and 102. Only the option sheet feeding apparatus 102 has not registered the ID, so it registers its ID=4. The option sheet feeding apparatus 102 connects the switch 225, and transmits (sends back) the STS signal to the image forming apparatus main body 100 to notify it that the option sheet feeding apparatus 102 has registered ID=4.

Finally, the image forming apparatus main body 100 transmits a command designating ID=5. All the option intermediate conveying apparatus 111, option delivery apparatus 112, and option sheet feeding apparatuses 101, 102, and 103 can receive this command. It is set to accept ID=5 by the option sheet feeding apparatuses 101, 102, and 103. Only the option sheet feeding apparatus 103 has not registered the ID, so it registers its ID=5. The option sheet feeding apparatus 103 connects the switch 235, and transmits (sends back) the STS signal to the image forming apparatus main body 100 to notify it that the option sheet feeding apparatus 103 has registered ID=5.

Upon receiving a registration notification status in response to registration of ID=5, the image forming apparatus main body 100 determines that option sheet feeding apparatuses exceeding the maximum number by two have been attached. The image forming apparatus main body 100 detects an excessive attaching error, and displays an error message to prompt the user to detach excessively attached option sheet feeding apparatuses. This process corresponds to step S1302 in FIG. 17.

<Simultaneous Driving of Option Apparatuses>

Figure 14:
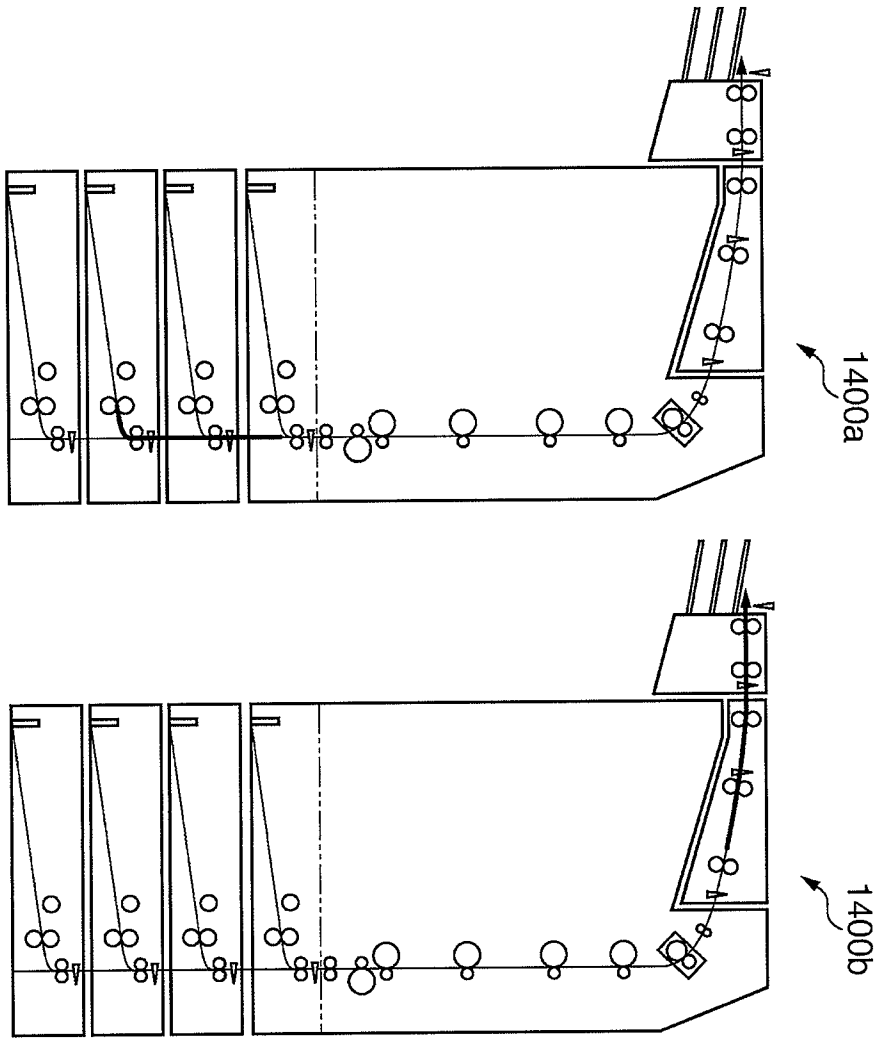
FIG. 14 is a view showing an exemplary embodiment of grouping driving of option apparatuses.

FIG. 14 is a view for explaining a method of designating and driving a plurality of option apparatuses at once by the image forming apparatus. Although reference numerals are omitted, the same reference numerals as those in FIG. 13 are assumed to be assigned.

In 1400*a* of FIG. 14, the option sheet feeding apparatus 102 feeds a print sheet. A print sheet indicated by a thick line extends over the option sheet feeding apparatuses 101 and 102, and the option sheet feeding apparatuses 101 and 102 are simultaneously driven to convey it. At this time, the ID is "7", as shown in FIG. 34.

In 1400*b*, the option intermediate conveying apparatus 111 and option delivery apparatus 112 are driven at once. A print sheet extends over the option intermediate conveying apparatus 111 and option delivery apparatus 112, so the option intermediate conveying apparatus 111 and option delivery apparatus 112 need to synchronously convey it. At this time, the ID is "6", as shown in FIG. 34.

Similar to the second exemplary embodiment, the option sheet feeding apparatus 103 causing an excessive attaching error is not targeted to the broadcast ID=0. FIG. 34 shows a list of IDs to be added to commands and target option apparatuses.

<Communication Timing Chart>

Figure 15A:
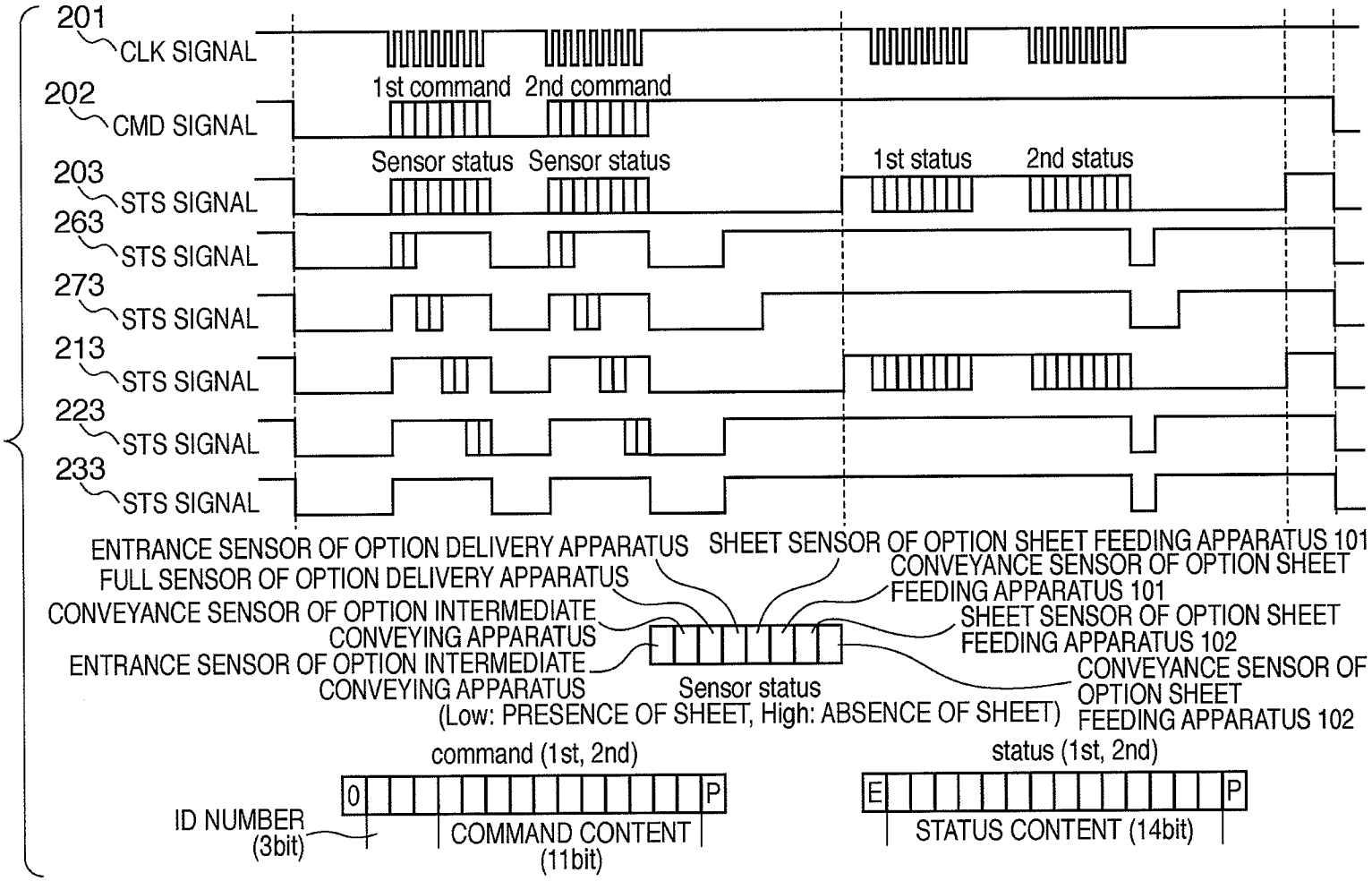
FIGS. 15A and 15B are communication timing charts between the image forming apparatus main body and option apparatuses.
Figure 15B:
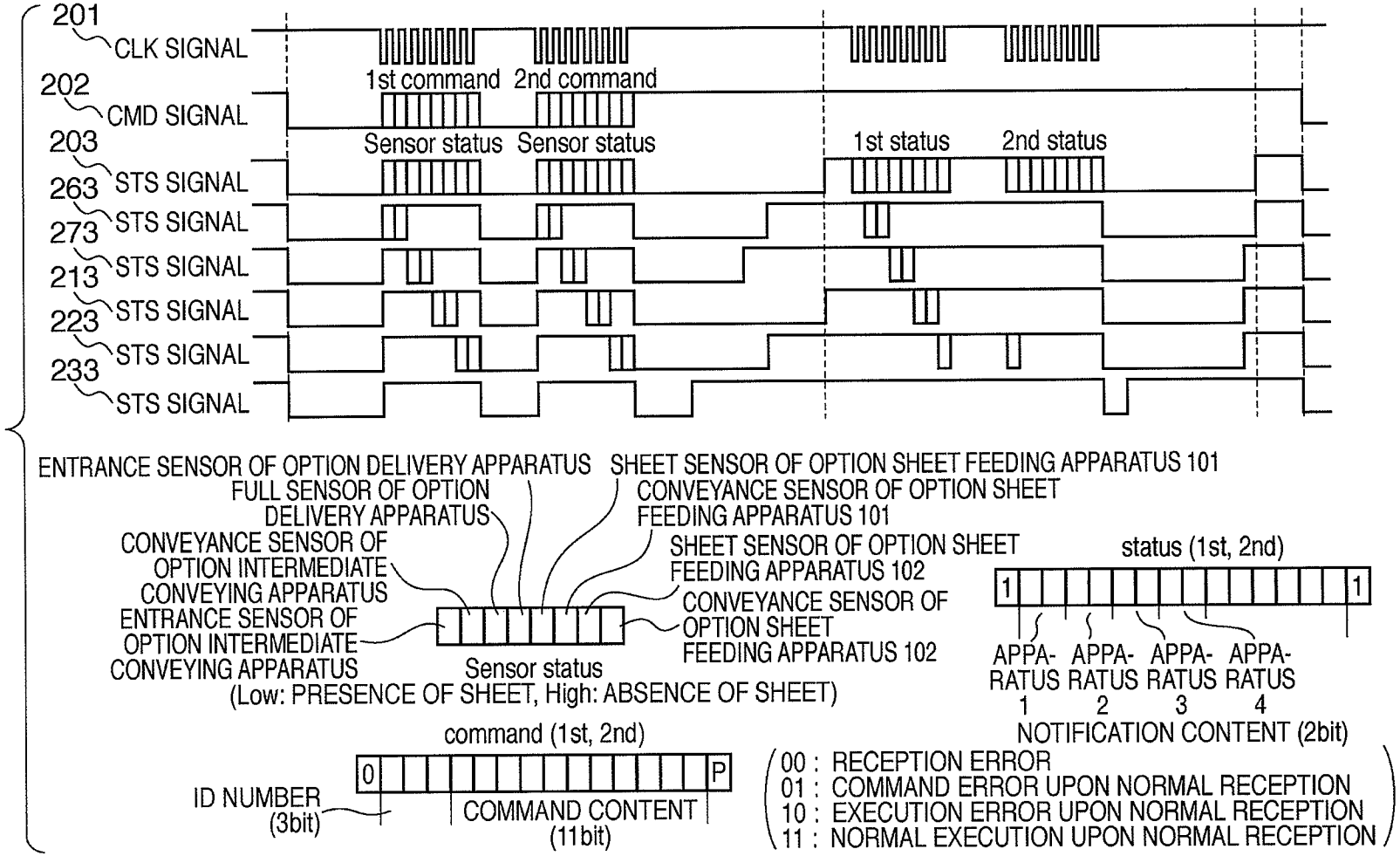

FIGS. 15A and 15B are communication timing charts.

A timing chart of FIG. 15A shows communication by designating the ID of only a specific option apparatus. As for five option apparatuses, attached option apparatuses differ from those in the timing chart 1000*a*. Thus, the STS signals in the timing chart 1000*a* are replaced with the STS signals 263, 273, 213, 223, and 233.

In the sensor status, 2 bits are assigned to the intermediate entrance sensor and intermediate conveyance sensor of the option intermediate conveying apparatus 111. Also, 2 bits are assigned to the delivery entrance sensor and full sensor of the option delivery apparatus 112. Similar to the first exemplary embodiment, 2 bits are assigned to the conveyance sensor and sheet sensor of each of the option sheet feeding apparatuses 101 and 102. The sensor status is made up of 8 bits for four option apparatuses.

The sensor status does not have a bit for assigning information on the conveyance sensor and sheet sensor of the option apparatus 103. The option apparatus 103 always outputs 0xff (all bits are at High) as the sensor status, preventing an adverse effect on the sensor statuses of the four remaining option apparatuses.

A communication timing chart of FIG. 15B shows broadcast communication. As for five option apparatuses, attached option apparatuses are different from that in the above-mentioned timing chart. Thus, the STS signals are replaced with the STS signals 263, 273, 213, 223, and 233. Bit assignment of the sensor status for each option apparatus and the response of the option sheet feeding apparatus 103 are the same as those in the timing chart of FIG. 15A.

As already described in the second exemplary embodiment, the option sheet feeding apparatus 103 is especially excluded from broadcast targets, and outputs 0xff (all bits are at High) as the status, preventing an adverse effect on notification information of the remaining option apparatuses.

Figure 16A:
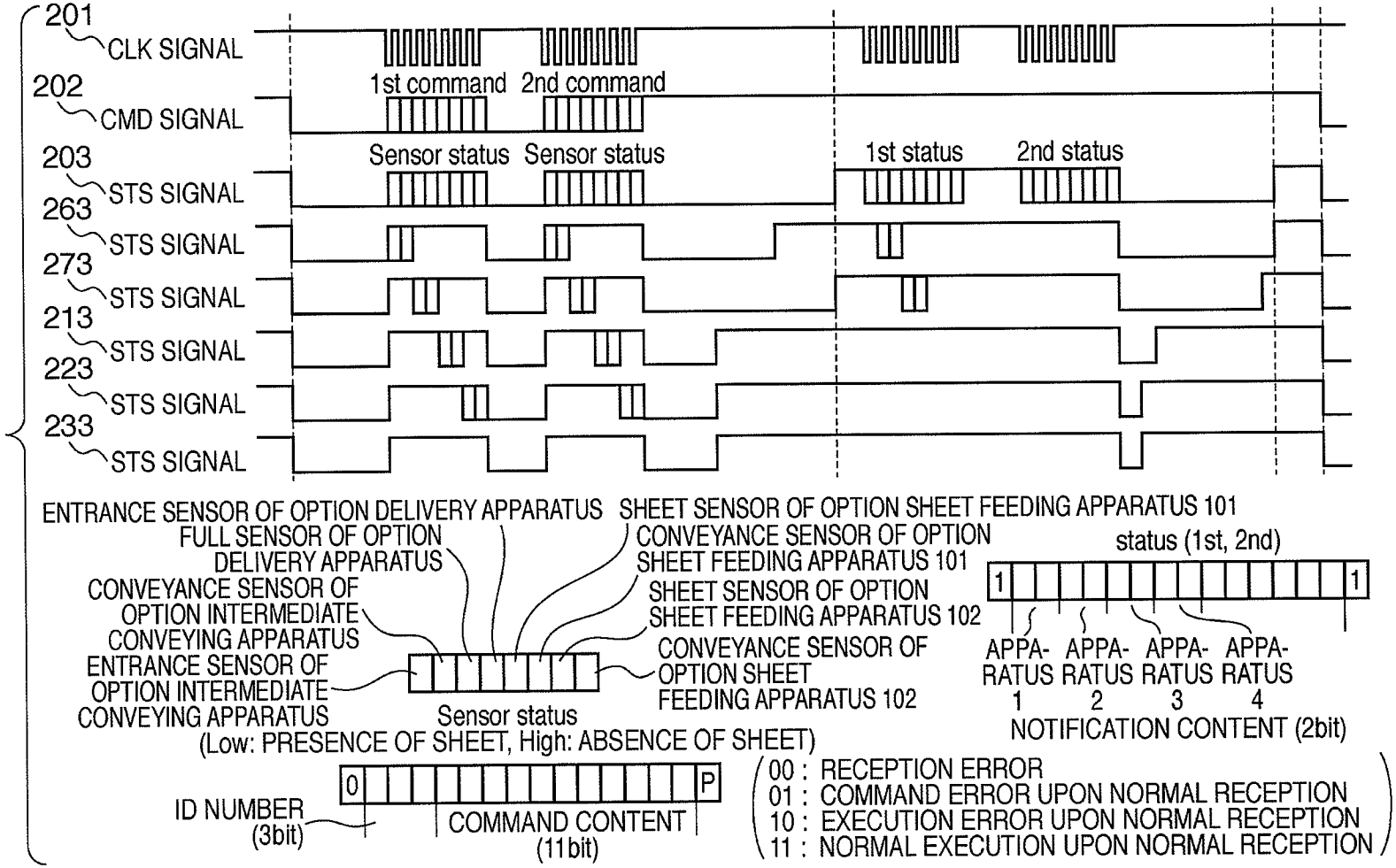
FIGS. 16A and 16B are communication timing charts between the image forming apparatus main body and option apparatuses.
Figure 16B:
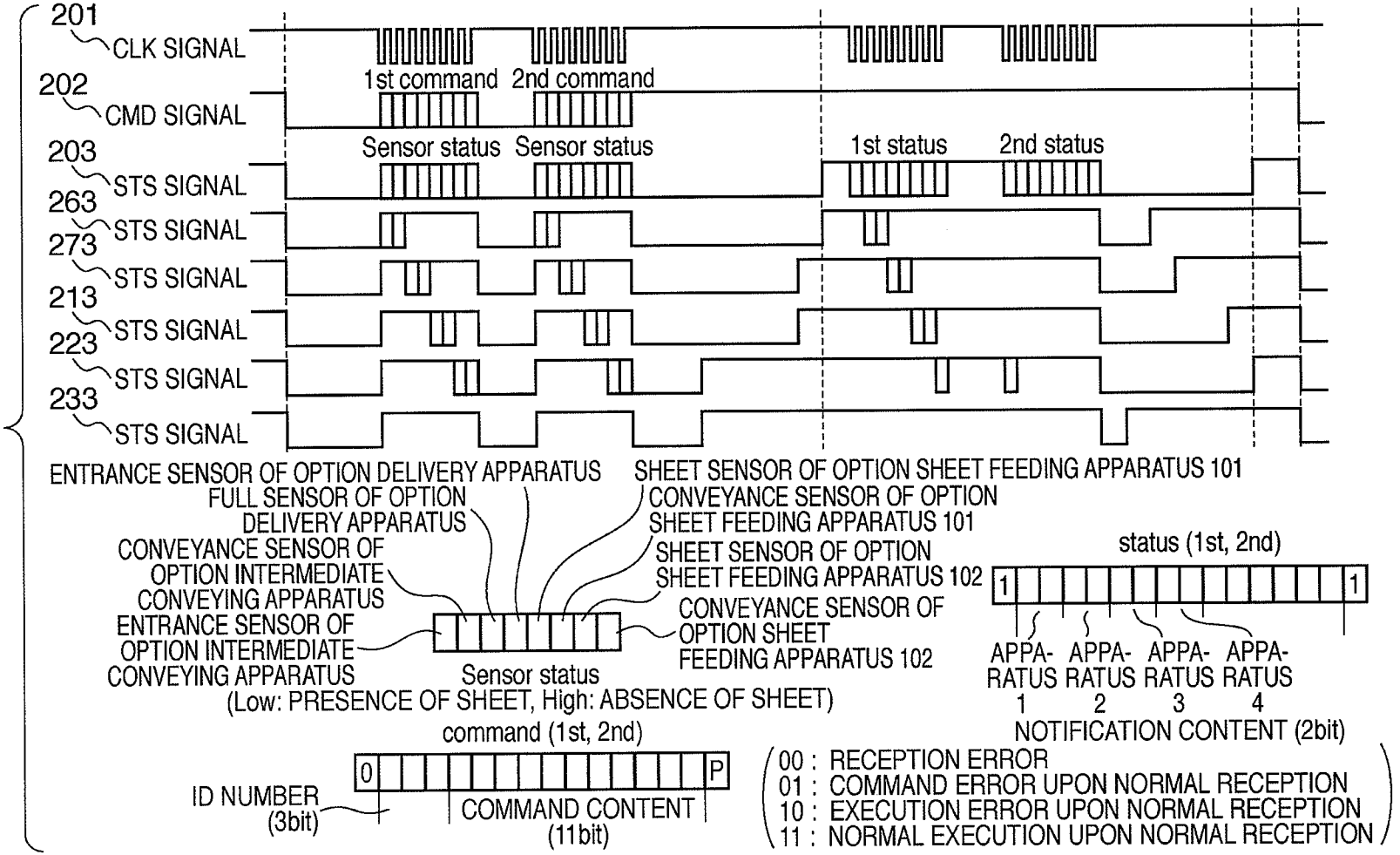

FIGS. 16A and 16B are timing charts of groupcast communication. As for five option apparatuses, attached option apparatuses differ from those in FIG. 10. Thus, the STS signals are replaced with the STS signals 263, 273, 213, 223, and 233.

In a timing chart of FIG. 16A, bit assignment of the sensor status and the response of the option sheet feeding apparatus 103 are the same as those in the timing chart of FIG. 15A.

In the third exemplary embodiment, the option intermediate conveying apparatus 111 and option delivery apparatus 112 belong to the first group, and the timing chart of FIG. 16A is premised on this grouping. The option sheet feeding apparatuses 101 and 102 belong to the second group, and a timing chart of FIG. 16B is premised on this grouping. The option sheet feeding apparatus 103 does not belong to any group, and sends back 0xff (all bits are at High) as the status.

<ID Registration Command Communication Control Flowchart>

Figure 17:
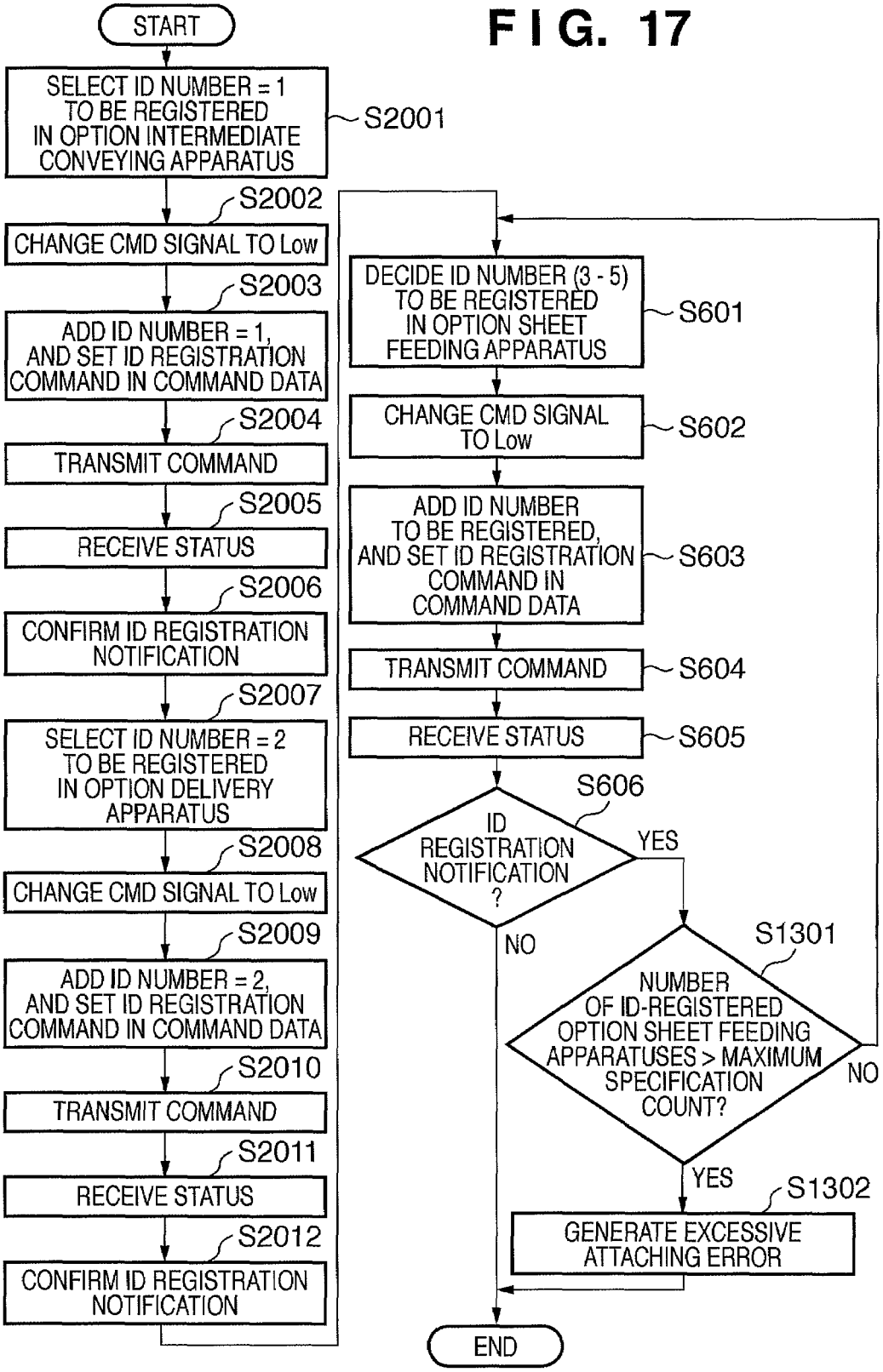
FIG. 17 is a flowchart of ID registration command communication control in the image forming apparatus main body.

FIG. 17 is a flowchart of ID registration command communication control in the image forming apparatus main body. This sequence is different from FIG. 11 in that steps S2001 to S2012 are added. The difference will be explained.

The option intermediate conveying apparatus 111 and option delivery apparatus 112 are not cascade-connected but directly connected to the image forming apparatus main body 100 in a detachable way. The image forming apparatus main body 100 cannot determine attachment repetitively until no ID registration notification is sent back upon connecting the switch, as described in the foregoing exemplary embodiments. As described above, the option intermediate conveying apparatus 111 is set to accept only ID=1. The option delivery apparatus 112 is set to accept only ID=2. The option sheet feeding apparatuses 101, 102, and 103 are set to accept ID=corresponding one of 3 to 5. Under these conditions, the image forming apparatus main body 100 first selects ID=1 (step S2001), changes the CMD signal to Low (step S2002), and creates an ID registration command of ID=1 (step S2003). The image forming apparatus main body 100 transmits the created command (step S2004), and receives a status (step S2005). The image forming apparatus main body 100 confirms whether the received status is an ID registration notification (step S2006). If the received status is an ID registration notification, the image forming apparatus main body 100 determines that the option intermediate conveying apparatus 111 has been attached and registered the ID. If the received status is not an ID registration notification, the image forming apparatus main body 100 determines that the option intermediate conveying apparatus 111 is not attached.

Then, the image forming apparatus main body 100 selects ID=2 (step S2007), changes the CMD signal to Low (step S2008), and creates an ID registration command of ID=2 (step S2009). The image forming apparatus main body 100 transmits the created command (step S2010), and receives a status (step S2011). The image forming apparatus main body 100 confirms whether the received status is an ID registration notification (step S2012). If the received status is an ID registration notification, the image forming apparatus main body 100 determines that the option delivery apparatus 112 has been attached and registered the ID. If the received status is not an ID registration notification, the image forming apparatus main body 100 determines that the option delivery apparatus 112 is not attached.

As described in the second exemplary embodiment, in steps S600 and subsequent steps, the image forming apparatus main body 100 selects ID=3 and registers it in the option sheet feeding apparatus 101. The image forming apparatus main body 100 selects ID=4 and registers it in the option sheet feeding apparatus 102. Further, the image forming apparatus main body 100 selects ID=5 and registers it in the option sheet feeding apparatus 103. The image forming apparatus main body 100 repeats this operation for all attached option sheet feeding apparatuses.

In the third exemplary embodiment, a maximum of two option sheet feeding apparatuses can operate. For this reason, if the image forming apparatus main body 100 receives an ID registration notification for ID=5, it determines in step S1301 that the option sheet feeding apparatuses exceed the maximum attachable count by two. The image forming apparatus main body 100 determines that an excessive attaching error has occurred (step S1302), and ends the process without registering ID=6.

Although not described in this flowchart, the image forming apparatus main body 100 may determine, for example, whether the option delivery apparatus 112 is attached and the option intermediate conveying apparatus 111 is not attached, that is, whether a combination error has occurred. If the combination error has occurred, a warning message is preferably displayed to notify the user to "attach the option intermediate conveying apparatus".

<Command Communication Control Flowchart>

Figure 18:
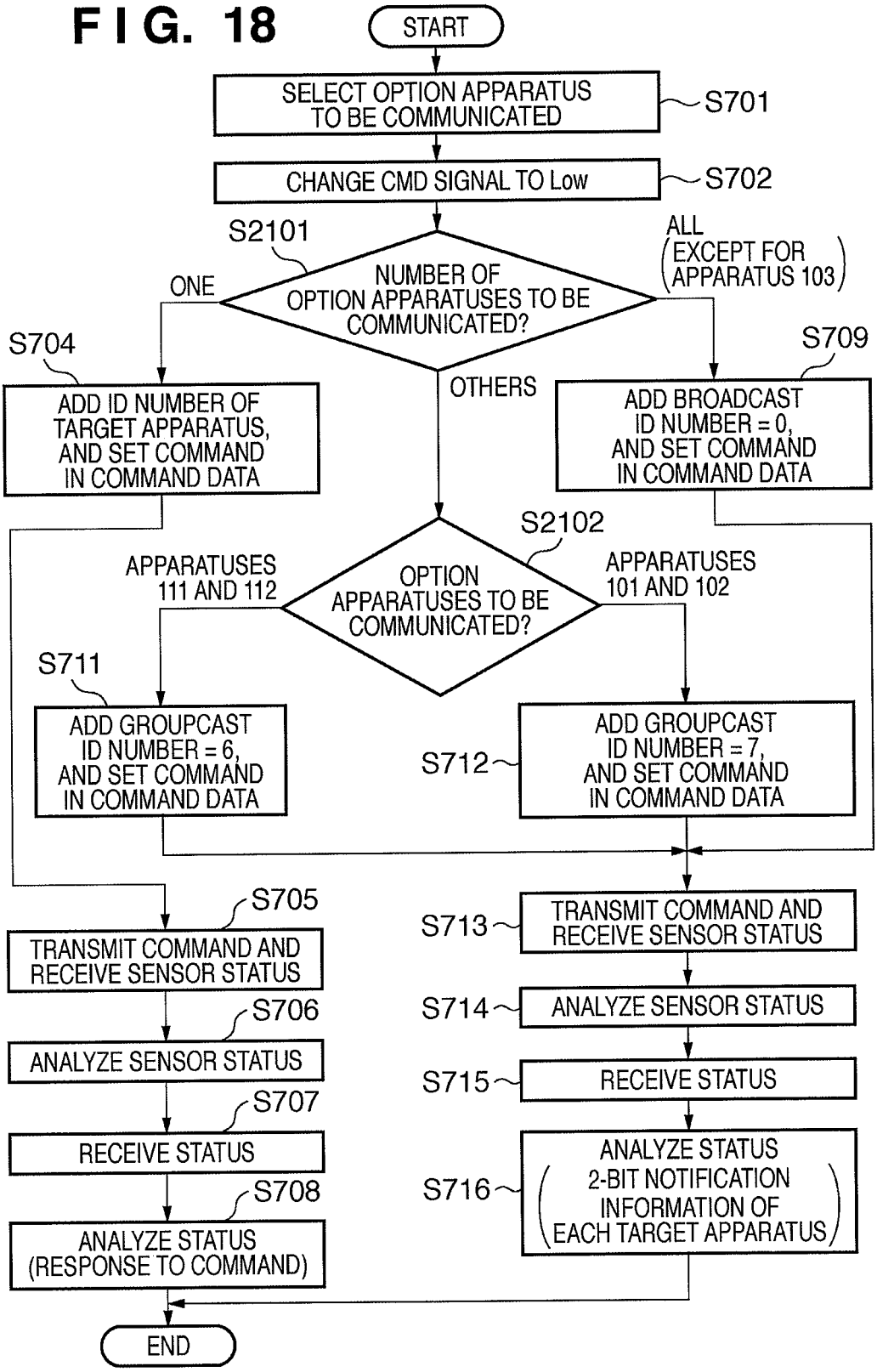
FIG. 18 is a flowchart of communication command transmission control in the image forming apparatus main body.

FIG. 18 is a flowchart of command communication control in the image forming apparatus main body. A difference from FIG. 7 will be explained.

In step S2101, "all" as a choice of step S703 in FIG. 7 is rewritten into "all (except for the apparatus 103)" to target all option apparatuses for broadcasting except for one causing an excessive attaching error.

In step S2102, the option intermediate conveying apparatus 111 and option delivery apparatus 112 are designated by ID=6 in "apparatuses 111 and 112" as a choice of step S710 in FIG. 7 because grouping of option apparatuses differs from FIG. 7. Also, the option sheet feeding apparatuses 101 and 102 are designated by ID=7 in "apparatuses 101 and 102".

<Communication Command Execution Control Flowchart 1 in Option Apparatus>

FIGS. 19A, 19B, 20A and 20B are flowcharts of communication command execution control in option apparatuses.

In the option intermediate conveying apparatus 111, the option control unit 41 executes one control program. In the option delivery apparatus 112, the option control unit 43 executes one control program. In the option sheet feeding apparatuses 101, 102, and 103, the option control units 40 execute one common control program. That is, there are three types of control programs, each of which will be explained below.

Figure 19A:
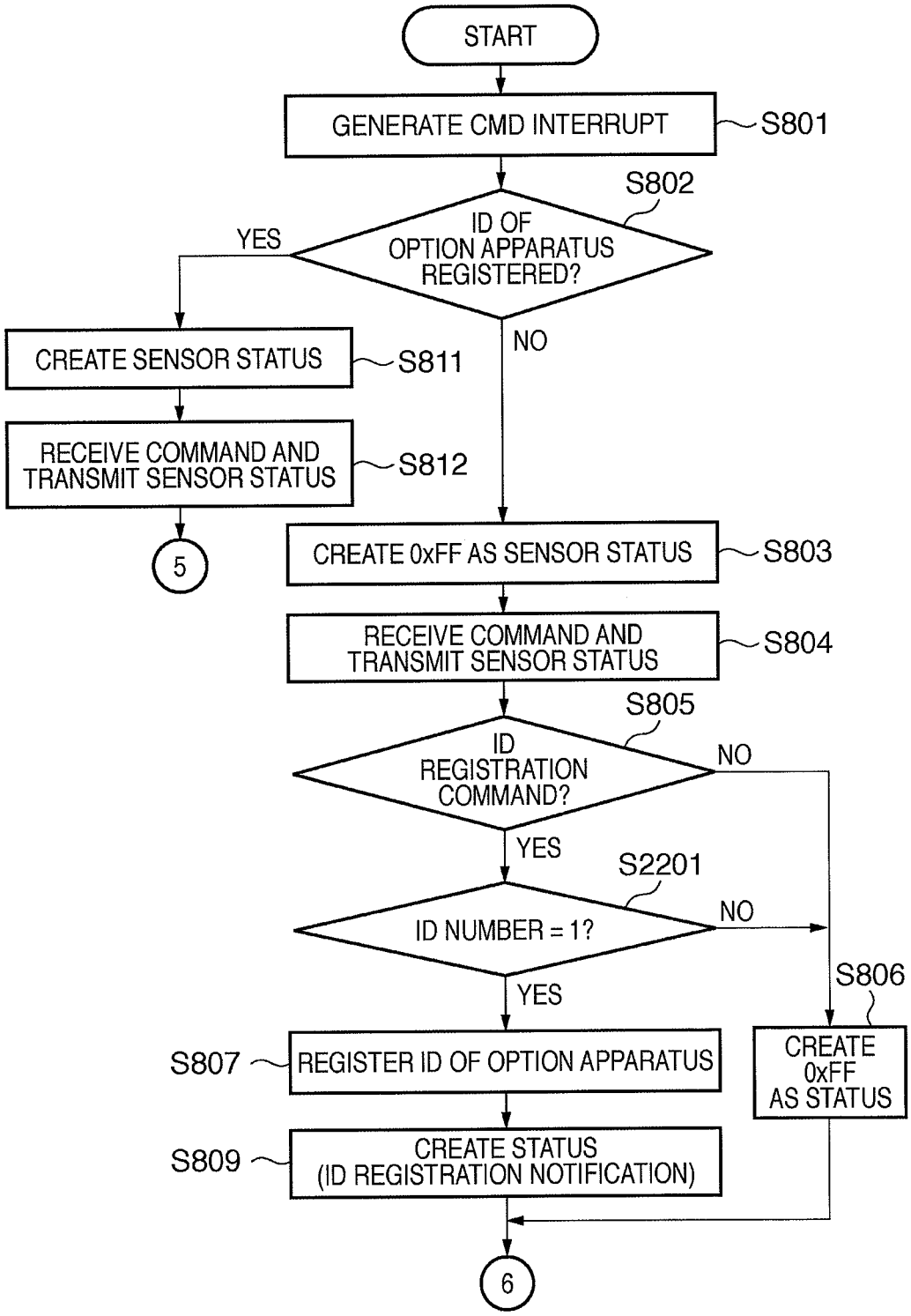
FIGS. 19A and 19B are flowcharts of communication command execution control in an option intermediate conveying apparatus.
Figure 19B:
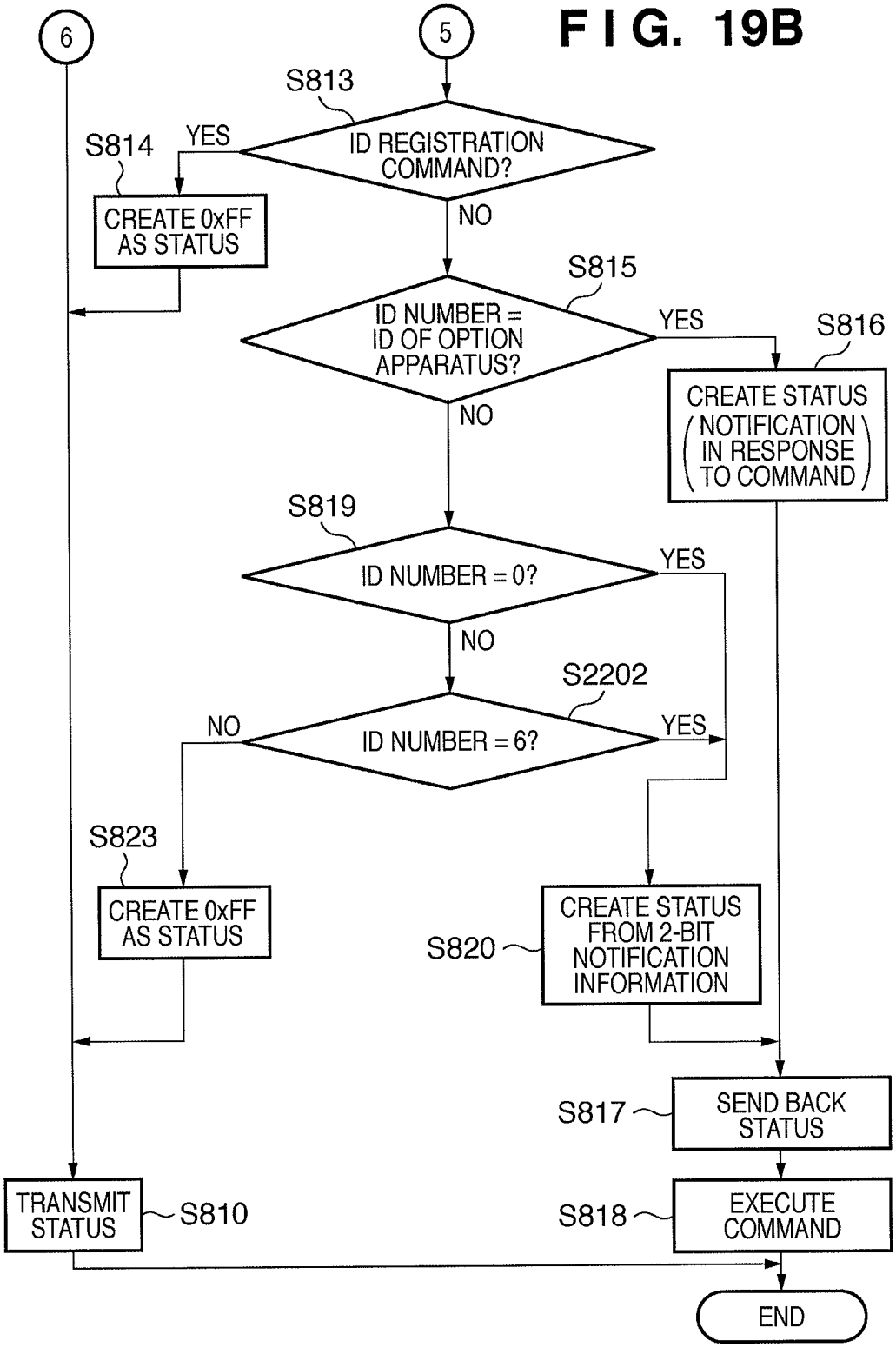

FIGS. 19A and 19B are flowcharts of the option intermediate conveying apparatus 111. This sequence is different from FIGS. 8A and 8B in that step S2201 is added, step S808 is omitted, and steps S821 and S822 are changed to step S2202.

The option intermediate conveying apparatus 111 is set to accept only ID=1. The sequence adds control to determine whether the received command is an ID registration command of ID=1 (step S2201), if ID=1, accept and register the ID, and if ID≠1, not accept it. The option intermediate conveying apparatus 111 is not cascade-connected via a switch but directly connected to the image forming apparatus main body 100. Hence, step S808 to connect the switch to the next apparatus is omitted. The option intermediate conveying apparatus 111 is subjected to only groupcasting designated by the groupcast ID=6. The control is changed to omit steps S821 and S822, determine whether ID=6 (step S2202), and perform groupcasting. Since only one option intermediate conveying apparatus is attachable, no excessive apparatus error need be detected.

<Communication Command Execution Control Flowchart 2 in Option Apparatus>

Figure 20A:
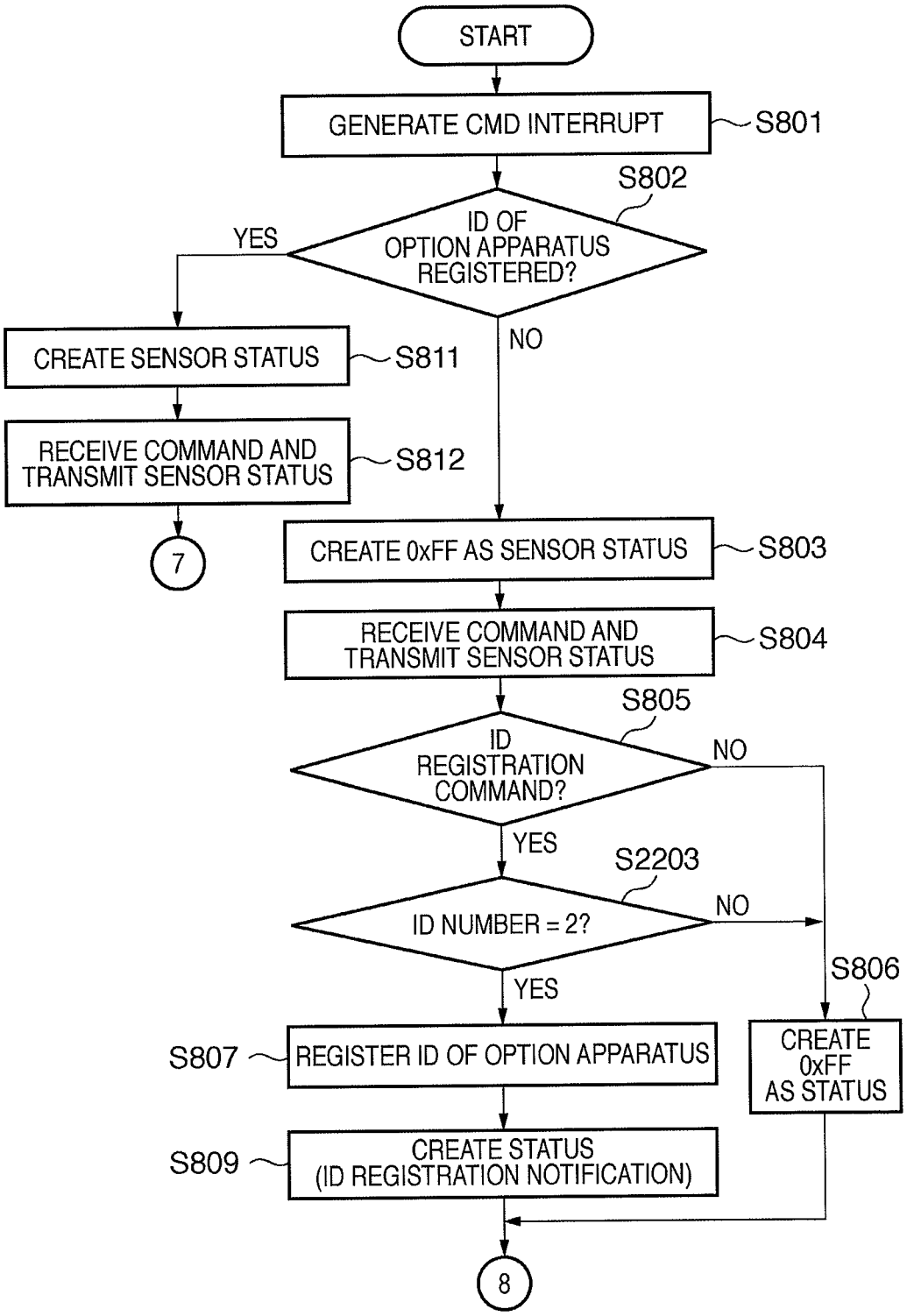
FIGS. 20A and 20B are flowcharts of communication command execution control in an option delivery apparatus.
Figure 20B:
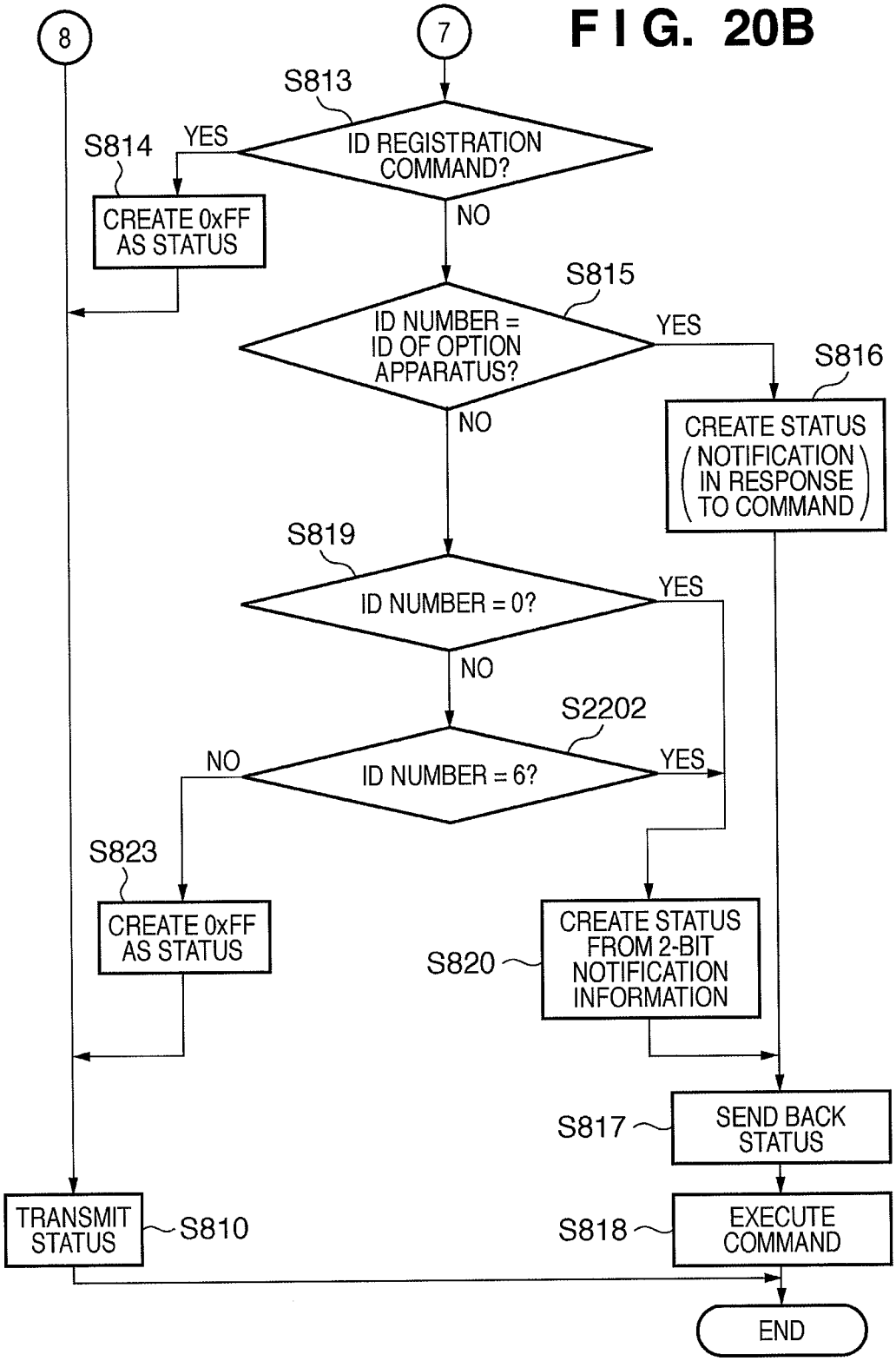

FIGS. 20A and 20B are flowcharts of the option delivery apparatus 112. This sequence is different from FIGS. 19A and 19B in that step S2201 is changed to step S2203. The option delivery apparatus 112 is set to accept only ID=2, so the control is changed to determine whether the received command is an ID registration command of ID=2 (step S2203). The remaining steps are the same as those for the option intermediate conveying apparatus 111.

Figure 21A:
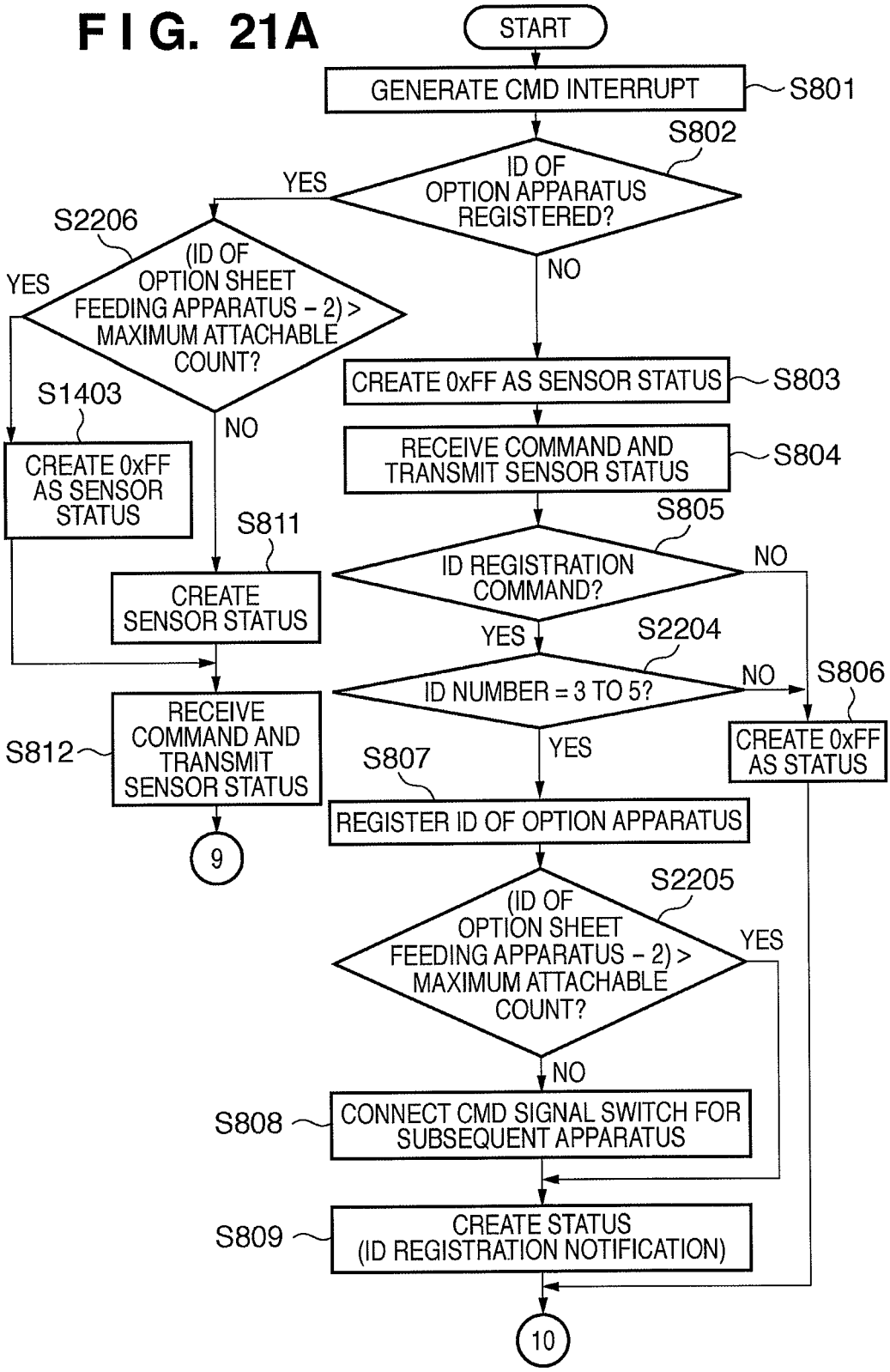

FIGS. 21A and 21B are flowcharts of the option sheet feeding apparatuses 101, 102, and 103. This sequence is different from FIGS. 12A and 12B in that step S2204 is added, steps S1401, S1402, and S1404 are changed to steps S2205, S2206, and S2207, and steps S821 and S822 are changed to step S2208.

Each option sheet feeding apparatus is set to accept ID=one of 3 to 5. The sequence adds control to determine whether the received command is an ID registration command of ID=one of 3 to 5 (step S2204); if ID=one of 3 to 5, accept and register the ID, and if ID $ one of 3 to 5, not accept it. Since the option sheet feeding apparatus is cascade-connected, an excessive attaching error is detected similarly to the second exemplary embodiment. Since the ID ranges from 3 to 5 and does not start from "1", steps S2205, S2206, and S2207 are changed to determine "(ID−2)>maximum attachable count?". The option sheet feeding apparatus is subjected to only groupcasting designated by the groupcast ID=7. The control is changed to omit steps S821 and S822, determine whether ID=7 (step S2208), and perform groupcasting.

<Effects>

As described above, a control instruction is issued by serial communication via a common communication line to simultaneously designate and drive not all but two or more option apparatuses other than an option sheet feeding apparatus. A print sheet can be conveyed stably without pulling or thrusting it between various kinds of option apparatuses.

A fourth exemplary embodiment will be described as follows.

The above-described exemplary embodiments define in advance the correspondence between the group ID (group identifier) and a plurality of option apparatuses. The fourth exemplary embodiment updates the group ID depending on the situation. Note that the arrangement of an image forming apparatus is the same as that shown in FIGS. 1 and 2.

Figure 22:
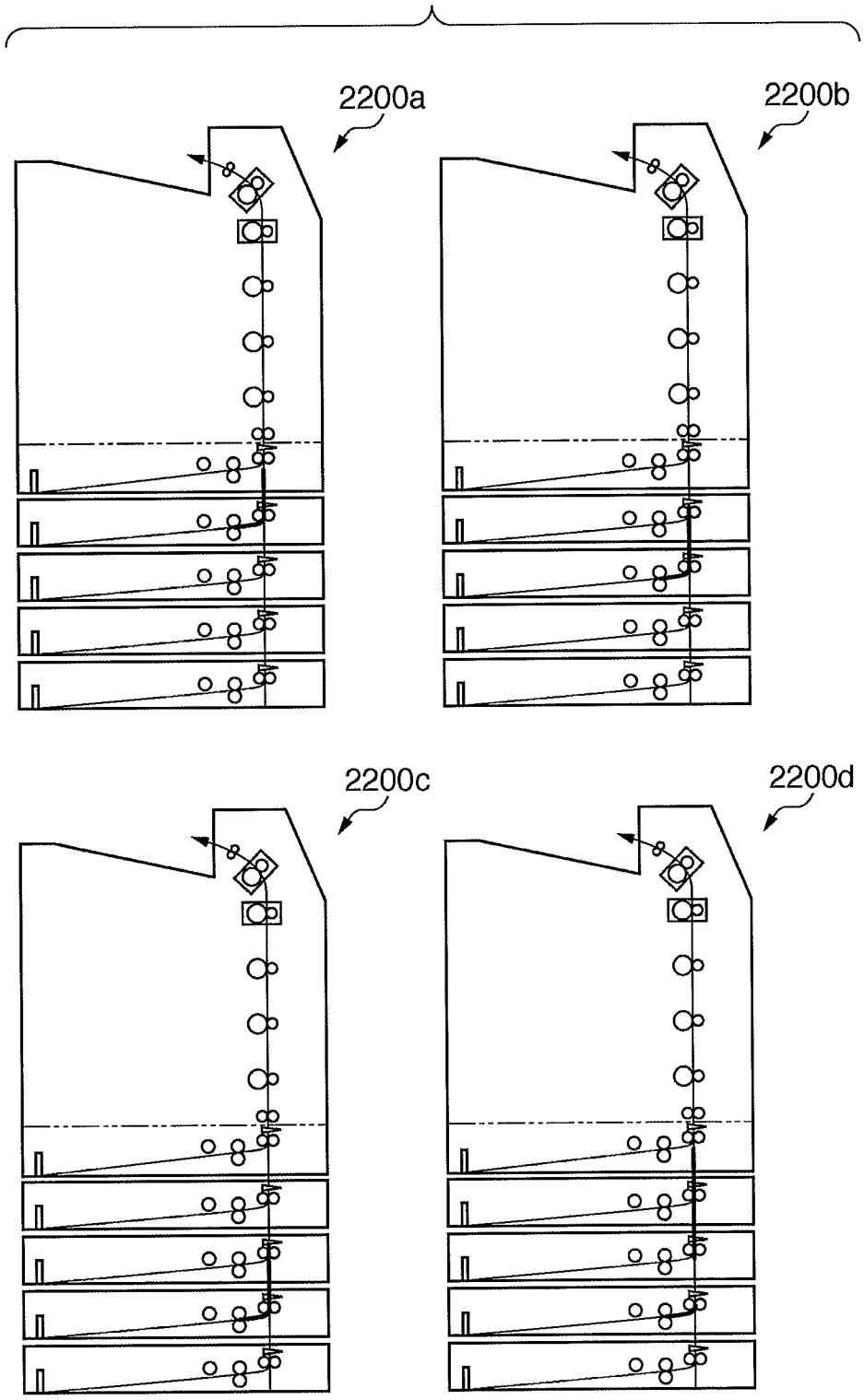
FIG. 22 is a view showing an exemplary embodiment of grouping driving of option apparatuses.
Figure 23:
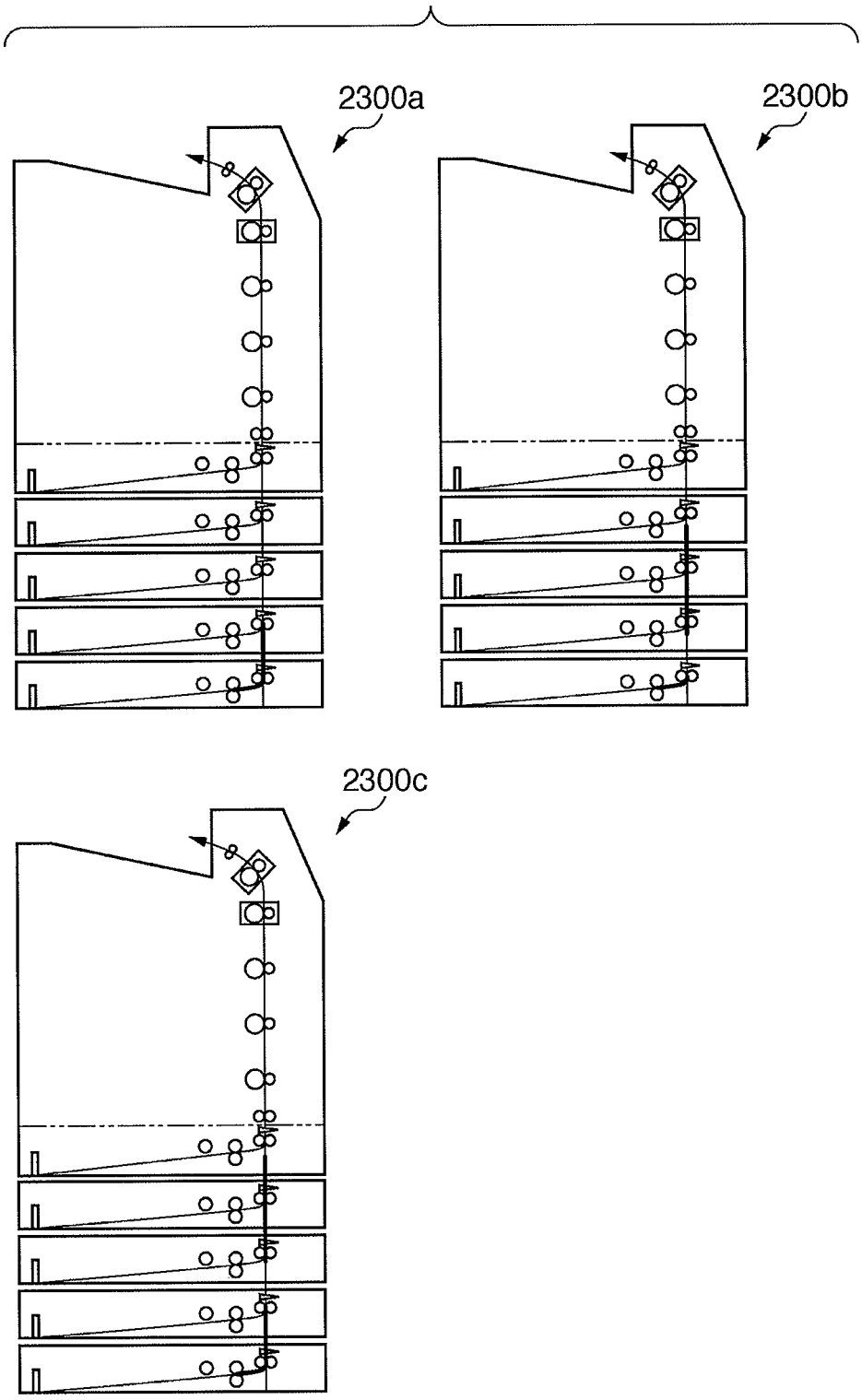
FIG. 23 is a view showing an exemplary embodiment of grouping driving of option apparatuses.

FIGS. 22 and 23 are views for explaining a method of designating and driving a plurality of option apparatuses at once by the image forming apparatus. This method Will be described by referring to FIGS. 4A and 4B, too. Although reference numerals are omitted, the same reference numerals as those in FIG. 1 are assumed to be assigned.

<Simultaneous Driving of Option Apparatuses>

When conveying a long print sheet, option apparatuses are driven simultaneously as shown in FIGS. 4A and 4B. When conveying a short print sheet, option apparatuses are driven simultaneously as shown in FIGS. 22 and 23. The case of FIGS. 4A and 4B has been described in the first embodiment, and a description thereof will not be repeated. The case of FIG. 22 will be explained in detail.

In a section 2200*a*, an option sheet feeding apparatus 101 causes a feeding unit 20*b* to feed a short print sheet. A thick line represents a fed print sheet. Only the option sheet feeding apparatus 101 among a plurality of option sheet feeding apparatuses conveys the print sheet.

In a section 2200*b*, an option sheet feeding apparatus 102 causes a feeding unit 20*c* to feed a short print sheet. A thick line represents a fed print sheet. The option sheet feeding apparatuses 101 and 102 among a plurality of option sheet feeding apparatuses convey the print sheet.

In sections 2200*c* and 2200*d*, an option sheet feeding apparatus 103 causes a feeding unit 20*d* to feed a short-print sheet. A thick line represents a fed print sheet. First, the option sheet feeding apparatuses 102 and 103 among a plurality of option sheet feeding apparatuses convey a print sheet, as shown in the section 2200*c*. Then, the option sheet feeding apparatuses 101 and 102 convey the preceding sheet, and the option apparatus 103 conveys a succeeding sheet, as shown in the section 2200*d*.

FIG. 23 is a sectional view showing feeding of a short print sheet by a feeding unit 20*e* of an option sheet feeding apparatus 104. A thick line represents a fed print sheet.

First, the option sheet feeding apparatuses 103 and 104 convey a print sheet, as shown in 2300*a*. Then, the option sheet feeding apparatuses 102 and 103 convey the preceding sheet, and the option apparatus 104 conveys a succeeding sheet, as shown in 2300*b*.

After that, the option sheet feeding apparatuses 101 and 102 convey the preceding sheet, and the option apparatuses 103 and 104 convey the succeeding sheet, as shown in 2300*c*.

In this manner, when print sheets are short, they are successively fed for high-speed printing. A combination of option sheet feeding apparatuses to undergo simultaneous driving control differs from that in FIGS. 4A and 4B for a long print sheet.

The fourth exemplary embodiment allows flexibly reregistering (updating) a combination of option sheet feeding apparatuses to be grouped in consideration of the difference in the combination of option sheet feeding apparatuses between feeding of a long print sheet and that of a short print sheet.

A group pan be freely registered (reregistered) in response to a change of various conditions including the length of a print sheet. A groupcast instruction can be issued to appropriate option sheet feeding apparatuses to synchronously convey a print sheet.

FIG. 35 shows a correspondence list of IDs to be added to commands and target option sheet feeding apparatuses when simultaneously driving a plurality of option sheet feeding apparatuses. A long sheet is fed by registering and using a group shown in a table 3500*a*. A short sheet is fed by registering and using a group shown in a table 3500*b*. Each table holds not only the individual ID but also group ID of each option sheet feeding apparatus.

<Communication Timing Chart>

Figure 24A:
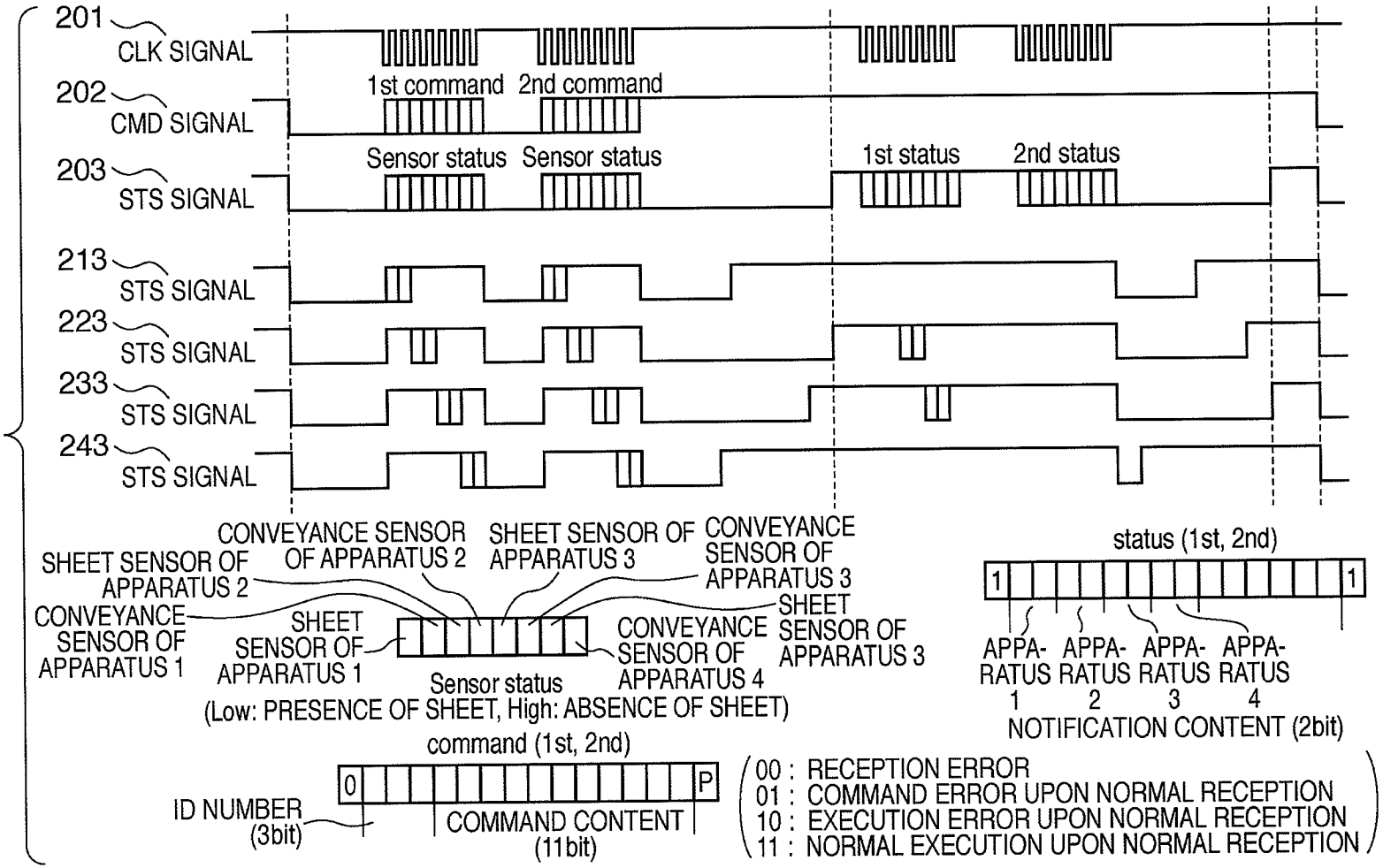
FIGS. 24A and 24B are communication timing charts between the image forming apparatus main body and option apparatuses.
Figure 24B:
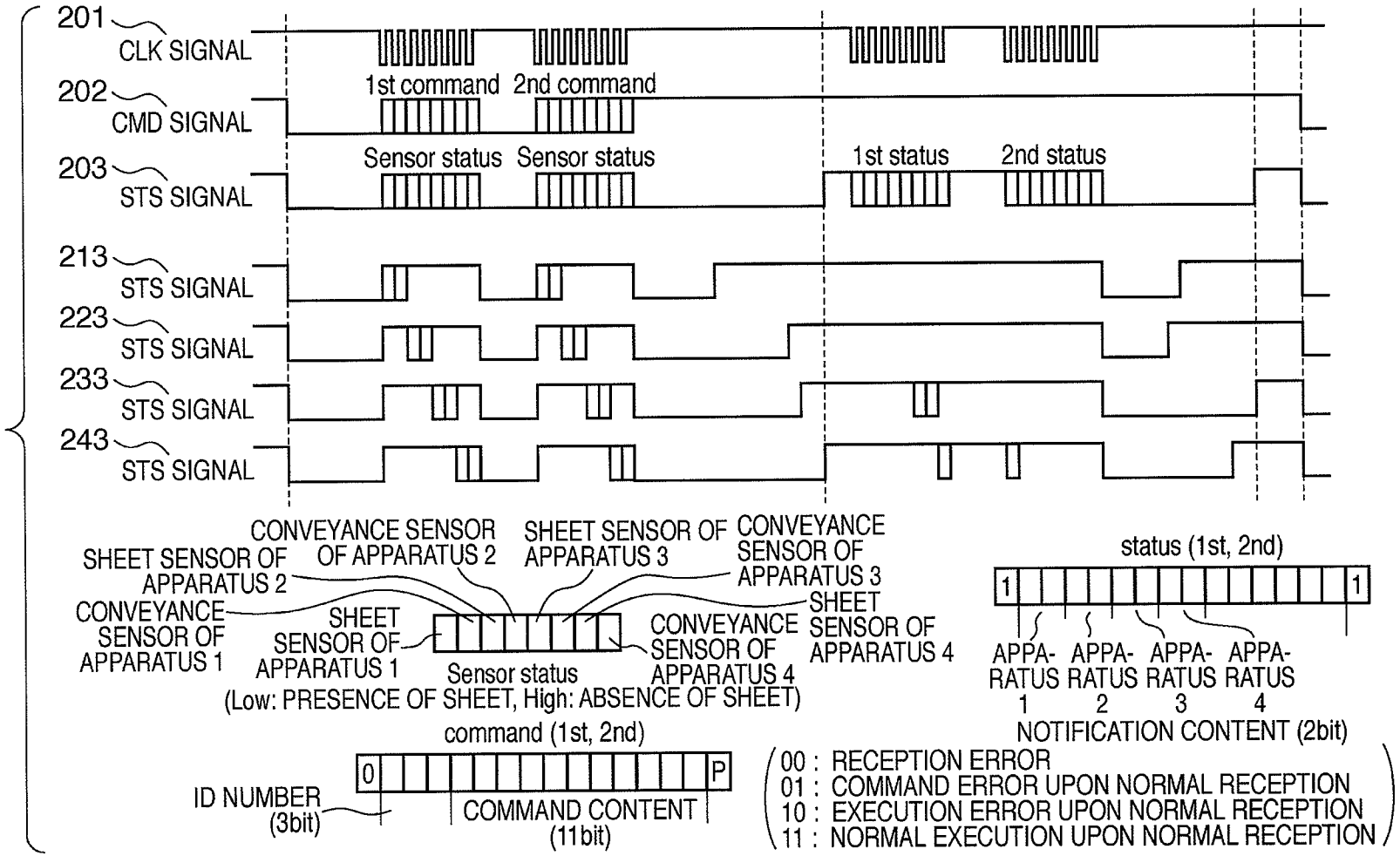

FIGS. 24A and 24B are communication timing charts of the image forming apparatus. A communication timing charts corresponding to FIGS. 4A and 4B have been explained with reference to FIGS. 4A, 4B, 5A and 5B, and a detailed description thereof will not be repeated.

The timing chart of groupcast communication for the group ID=5 (option sheet feeding apparatuses 101 and 102) for a short print sheet is the same as 500*c*.

A timing chart of FIG. 24A shows groupcast communication for a short print sheet and the group ID=6 (option sheet feeding apparatuses 102 and 103). A timing chart of FIG. 24B shows groupcast communication for a short print sheet and the group ID=7 (option sheet feeding apparatuses 103 and 104). Target option sheet feeding apparatuses similarly send back notification information and execute a command.

<Command Communication Control Flowchart>

Figure 25:
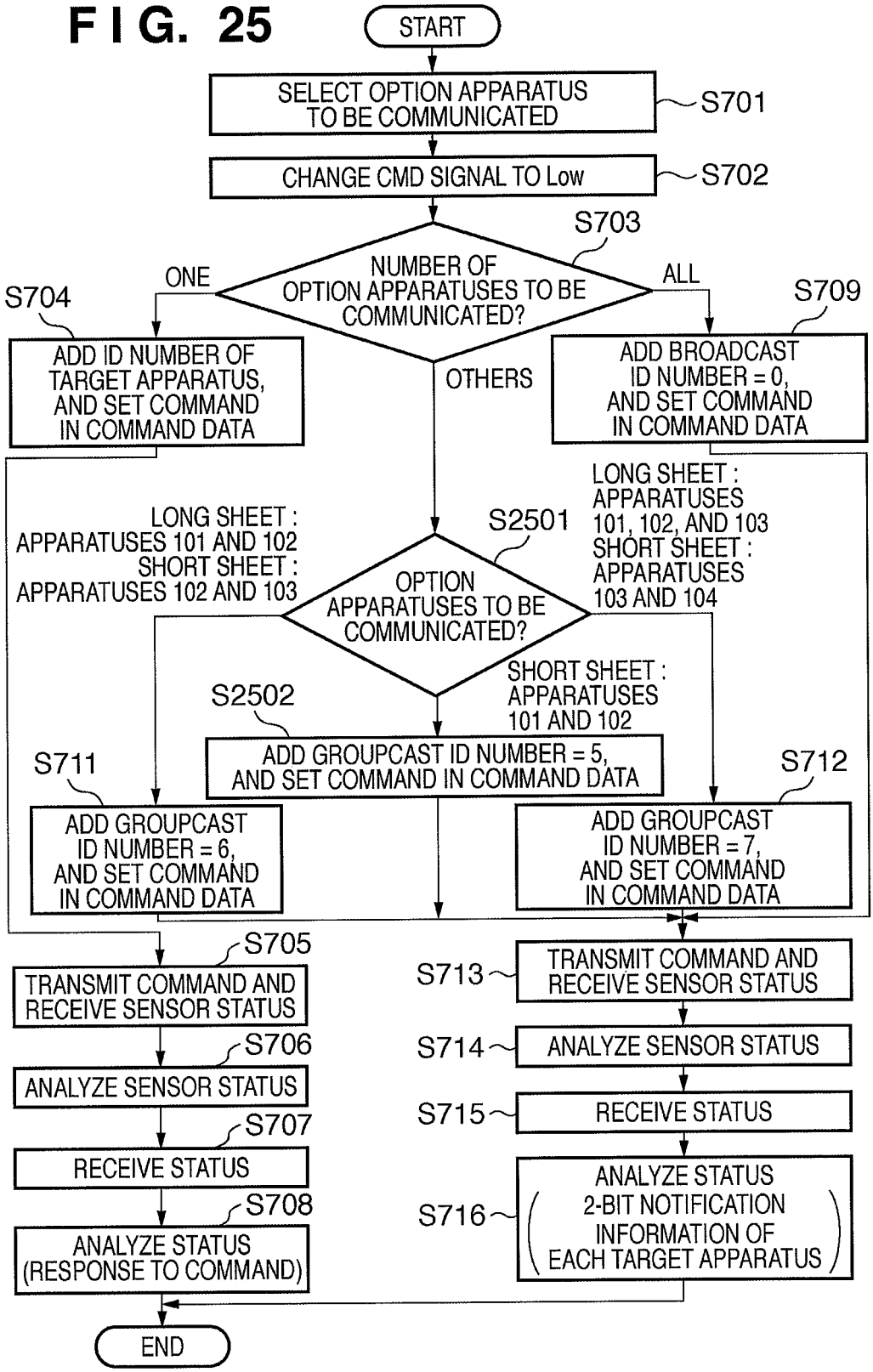
FIG. 25 is a flowchart of communication command transmission control in the image forming apparatus main body.

FIG. 25 is a flowchart of command communication control in the image forming apparatus main body. This sequence is different from FIG. 7 in that step S710 is changed to step S2501 and step S2502 is added.

The fourth exemplary embodiment changes the group ID between long and short sheets. In step S2501, the determination of the group ID is changed to determine "long sheet: apparatuses 101 and 102, short sheet: apparatuses 102 and 103", "long sheet: apparatuses 101, 102, and 103, short sheet: apparatuses 103 and 104", and "short sheet: apparatuses 101 and 102". Since the group ID=5 is also used, creation of a command with group ID=5 is also added in step S2502.

<ID Registration Command Communication Control Flowchart>

Figure 26:
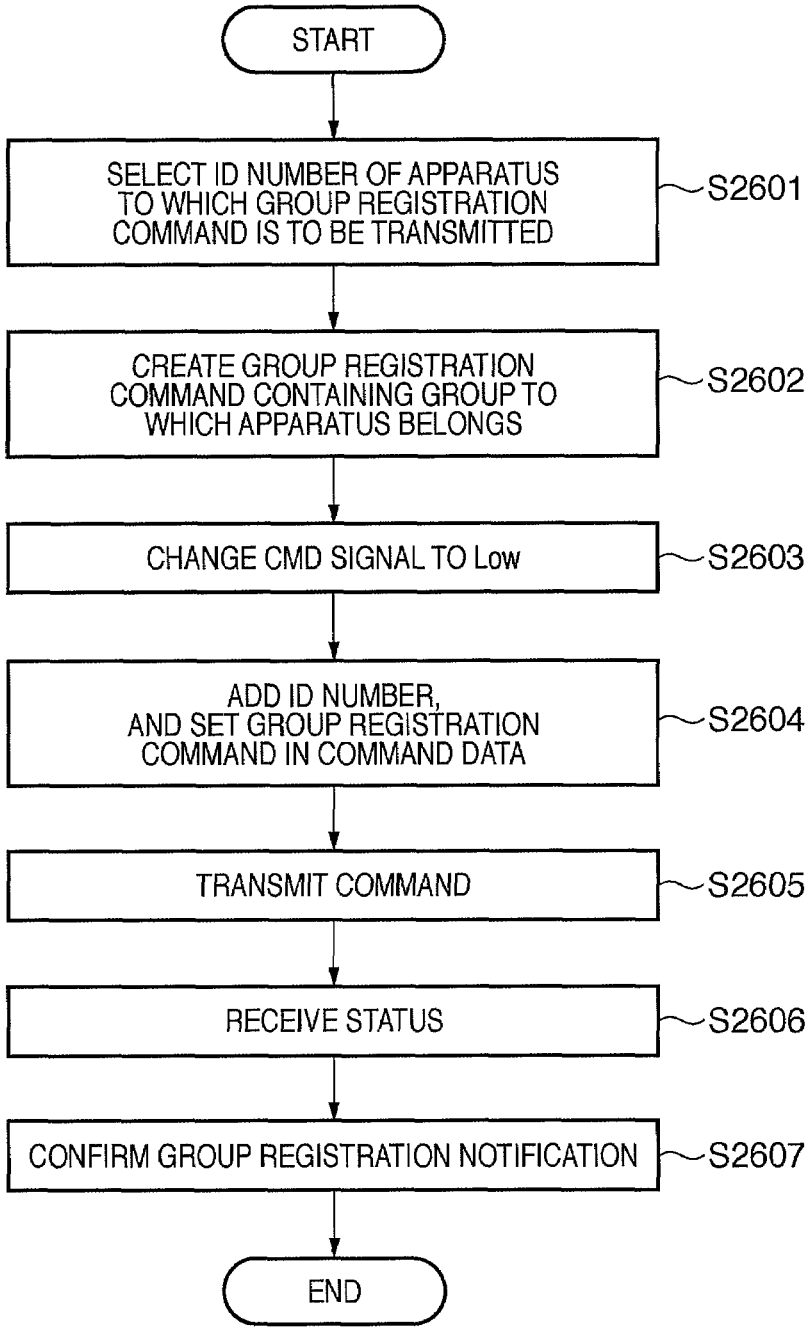
FIG. 26 is a flowchart of ID registration command communication control in the image forming apparatus main body.

FIG. 26 is a flowchart of group registration command communication control in the image forming apparatus main body. This sequence is executed when a group ID in the right column of the table 3500*a* or 3500*b* is registered in advance depending on a print sheet (long or short sheet) to be conveyed by the option sheet feeding apparatus.

The image forming apparatus main body selects the ID of an option sheet feeding apparatus serving as the destination of a command (step S2601), and creates a group registration command containing the ID and group of the option sheet feeding apparatus (step S2602).

The command contains an 11-bit command content in addition to the 3-bit ID. In the 11-bit command content, for example, the upper 8 bits represent a specific code value meaning group registration. As for the lower 3 bits, group ID=5, group ID=6, and group ID=7 are assigned from an upper bit. Each bit holds a command content "1" when the option sheet feeding apparatus belongs to the target group, and "0" when it does not belong to the target group. A method of assigning IDs of 3 bits to respective option sheet feeding apparatuses is the same as that in the first embodiment, and a detailed description thereof will not be repeated.

The image forming apparatus main body changes the CMD signal to Low (step S2603), adds an ID to transmit a group registration command, and creates the prepared group registration command content as command data (step S2604). The image forming apparatus main body transmits the command data created in step S2604 via a serial communication line (step S2605).

The image forming apparatus main body receives a status from each option sheet feeding apparatus (step S2606). The image forming apparatus main body analyzes the group registration notification of the status to confirm whether the group has been registered correctly (step S2607). Then, the process ends.

Every time feeding is switched between long and short sheets, the image forming apparatus main body transmits a group registration command to all option apparatuses so as to belong to a group shown in the table 3500*a* or 3500*b*. The image forming apparatus main body uses the registered group to transmit a conveyance command and simultaneously drive option sheet feeding apparatuses (conveyance control).

<Communication Command Execution Control Flowchart in Option Sheet Feeding Apparatus>

Figure 27A:
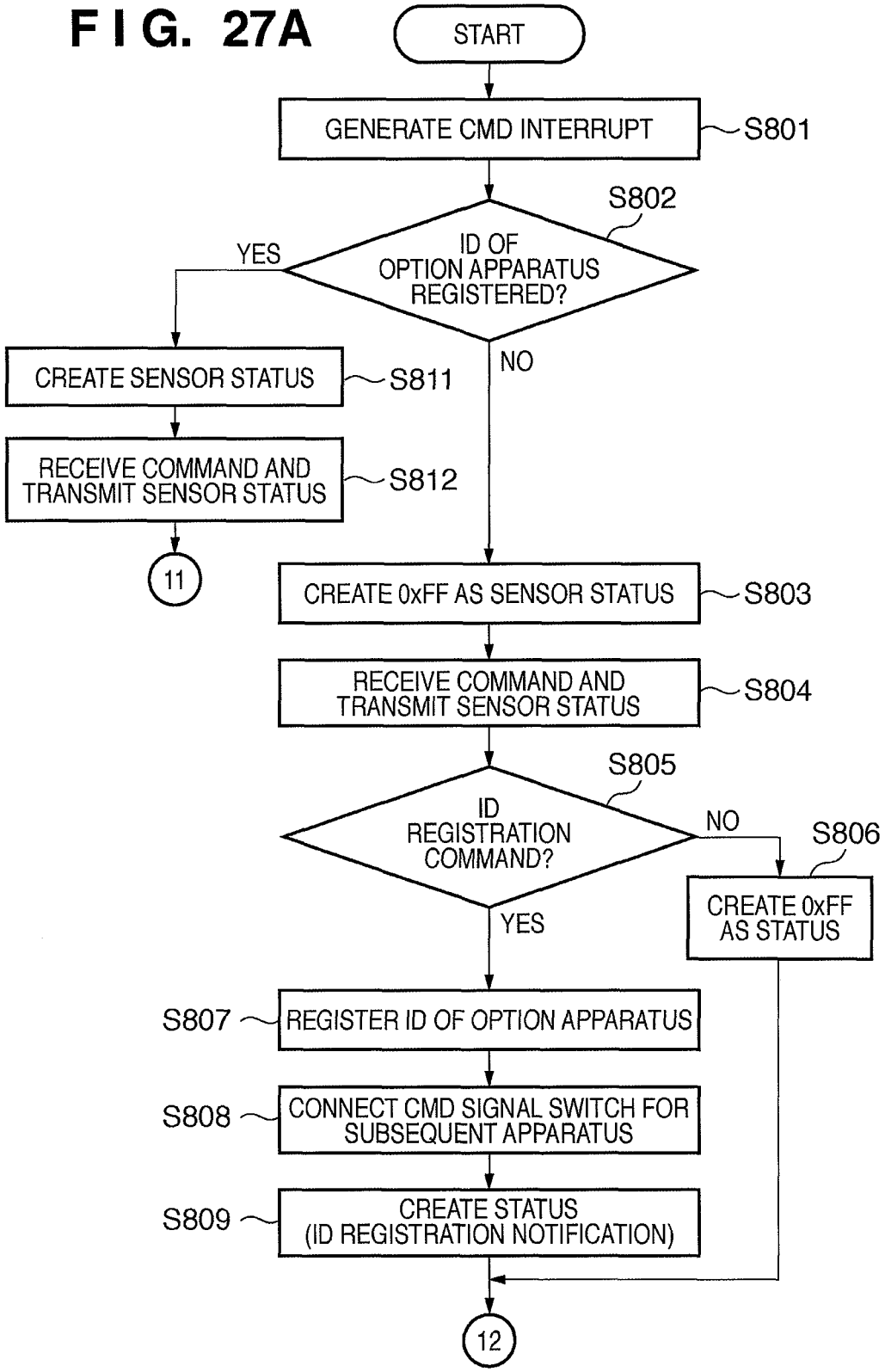

FIGS. 27A and 27B are flowcharts of communication command execution control in the option sheet feeding apparatus. This sequence is different from FIGS. 8A and 8B in that steps S821 and S822 are changed to step S2705 and steps S2701 to S2704 are added.

In the flowcharts of FIGS. 27A and 27B, the option sheet feeding apparatus processes a group registration command from an image forming apparatus main body 100.

That is, each option sheet feeding apparatus newly executes a group registration command that designates an ID assigned to the option sheet feeding apparatus, which has been described in the first embodiment. More specifically, when each option sheet feeding apparatus receives a command from the image forming apparatus main body 100 to determine that the command designates the ID of the option sheet feeding apparatus, it determines whether the command content represents a group registration command (step S2701).

If the command content represents a group registration command, the option sheet feeding apparatus registers the group (group ID) to which it belongs (step S2702). In registration, a designated group ID is stored/set in the memory (not shown) of the option control unit so as to be able to refer it to later.

Then, the option sheet feeding apparatus creates a group registration notification status representing that group registration has normally been completed (step S2703). The option sheet feeding apparatus sends back the status to a control CPU 200 of the image forming apparatus main body 100 (step S2704).

Whether groupcasting is designated is determined by determining whether the ID designated by the command matches the group registered by the option sheet feeding apparatus (step S2705).

Instead of a predetermined group, a group is registered to execute a groupcast command every time a group registration command is received. Thus, option sheet feeding apparatuses can be freely grouped.

<Effects>

As described above, the image forming apparatus main body registers a groupcast ID for some option apparatuses to undergo synchronous conveyance control, including the start, stop, and acceleration/deceleration of conveyance of a print sheet. When the group ID becomes unnecessary, the image forming apparatus main body reregisters a group ID for another combination of option apparatuses to undergo synchronous conveyance control. Groupcast communication can be done by freely changing grouping by a group registration command without fixing option apparatuses to a predetermined group. Even if a combination of option sheet feeding apparatuses over which a print sheet extends changes depending on the difference in the length of a print sheet, conveyance mode type, or the like, a group (group ID) of option sheet feeding apparatuses can be reregistered to perform synchronous conveyance control. A print sheet can be stably conveyed at high speed without pulling or thrusting it between apparatuses.

In the fourth exemplary embodiment, an excessive apparatus error generated when more than a maximum number of apparatuses are attached is not detected, but may also be detected additionally.

A fifth exemplary embodiment will be described as follows.

In the foregoing exemplary embodiments, the individual ID, groupcast ID, and broadcast ID are designated by numerical values (group IDs). In the fifth exemplary embodiment, 1 bit of the ID is assigned to one option sheet feeding apparatus.

More specifically, the ID is formed from 4-bit information. For example, an option sheet feeding apparatus 101 corresponds to ID=1 (0001 by binary notation), and an option sheet feeding apparatus 102 corresponds to ID=2 (0010 by binary notation). An option sheet feeding apparatus 103 corresponds to ID=4 (0100 by binary notation), and an option sheet feeding apparatus 104 corresponds to ID=8 (1000 by binary notation).

When bits assigned to the respective option sheet feeding apparatuses are "1" in the broadcast ID=15 (1111 by binary notation) targeting all the option sheet feeding apparatuses, the apparatuses serve as communication targets.

Similarly, for example, when bits assigned to the option sheet feeding apparatuses 103 and 104 are "1" in the group ID=12 (1100 by binary notation) targeting the option sheet feeding apparatuses 104 and 103, the apparatuses serve as communication targets. Since bits are assigned in the order of conveyance, the group has a feature of holding "1" at adjacent bits.

Figure 28:
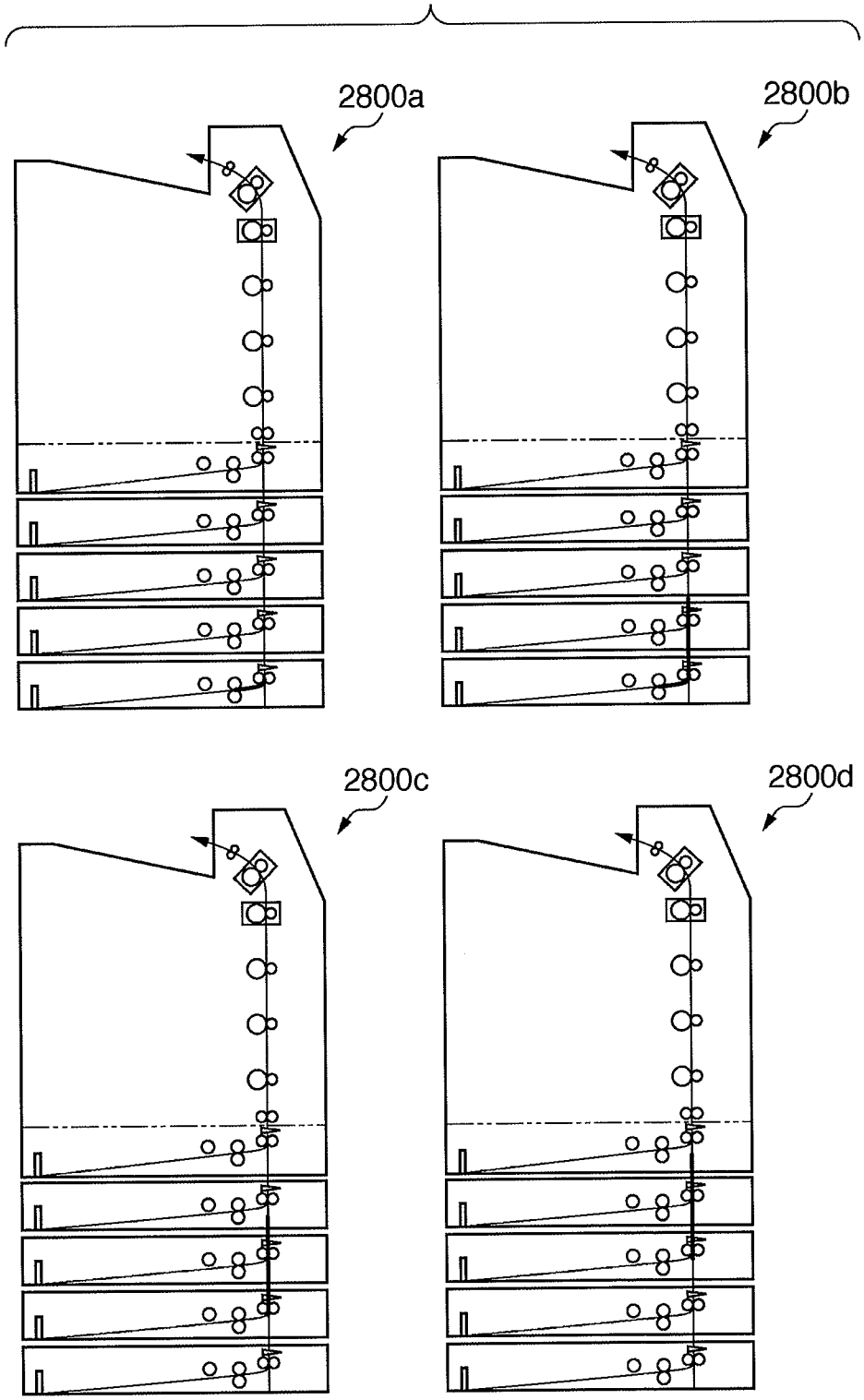
FIG. 28 is a view showing an exemplary embodiment of grouping driving of option apparatuses.
Figure 29:
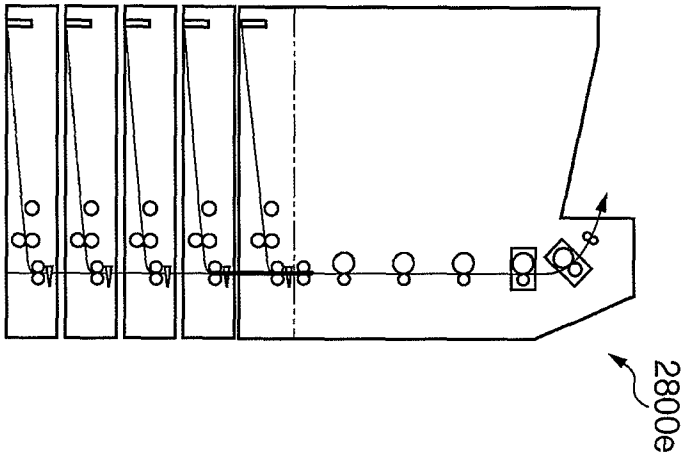
FIG. 29 is a view showing an exemplary embodiment of grouping driving of option apparatuses.

When feeding a short sheet extending over two option sheet feeding apparatuses from the option sheet feeding apparatus 104, a main body control unit 30 issues a conveyance instruction as follows. More specifically, the main body control unit 30 controls conveyance such that only the apparatus 104 in 2800*a*→the apparatuses 104 and 103 in 2800*b*→the apparatuses 103 and 102 in 2800*c*→the apparatuses 102 and 101 in 2800*d*→only the apparatus 101 in 2800*e*. Although reference numerals are omitted in FIGS. 28 and 29, the same reference numerals as those in FIG. 1 are assumed to be assigned.

At this time, the image forming apparatus main body synchronously issues conveyance instructions such as ID=8→ID=12→ID=6→ID=3→ID=1 to the respective option sheet feeding apparatuses from the first one while changing the ID to change the target, as represented by 3600*a* in FIG. 36.

As is apparent from gray cells "1" in 3600*a*, a short sheet (sheet length extending over two option apparatuses) is fed from the option sheet feeding apparatus 104 by shifting bits "1" one by one to subsequent option apparatuses. The ID is changed such that the number of adjacent bits is two (because a short sheet extends over two option apparatuses).

In this fashion, when feeding a print sheet from a given option sheet feeding apparatus, the image forming apparatus main body 100 adds, to a command, an ID holding "1" at a bit corresponding to the option sheet feeding apparatus, as shown in FIG. 36 or 37. As the print sheet is conveyed, option sheet feeding apparatuses over which the print sheet extends change sequentially. At a timing to drive option apparatuses, the image forming apparatus main body 100 designates a group ID holding "1"s at bits corresponding to sequentially changed option sheet feeding apparatuses over which the print sheet extends. The fifth exemplary embodiment can control driving of option sheet feeding apparatuses at smaller power, compared to the above-described embodiments.

<ID Registration Command Communication Control Flowchart>

The flowchart of ID registration command communication control in the image forming apparatus main body according to the fifth exemplary embodiment is the same as that in FIG. 6, and a detailed description thereof will not be repeated.

When deciding an ID in step S601, 1 bit is assigned to each option apparatus in the connection order in the conveyance direction. More specifically, the ID number is set to ID=1 (0001 by binary notation), ID=2 (0010 by binary notation), ID=4 (0100 by binary notation), and ID=8 (1000 by binary notation).

<Command Communication Control Flowchart>

Figure 30:
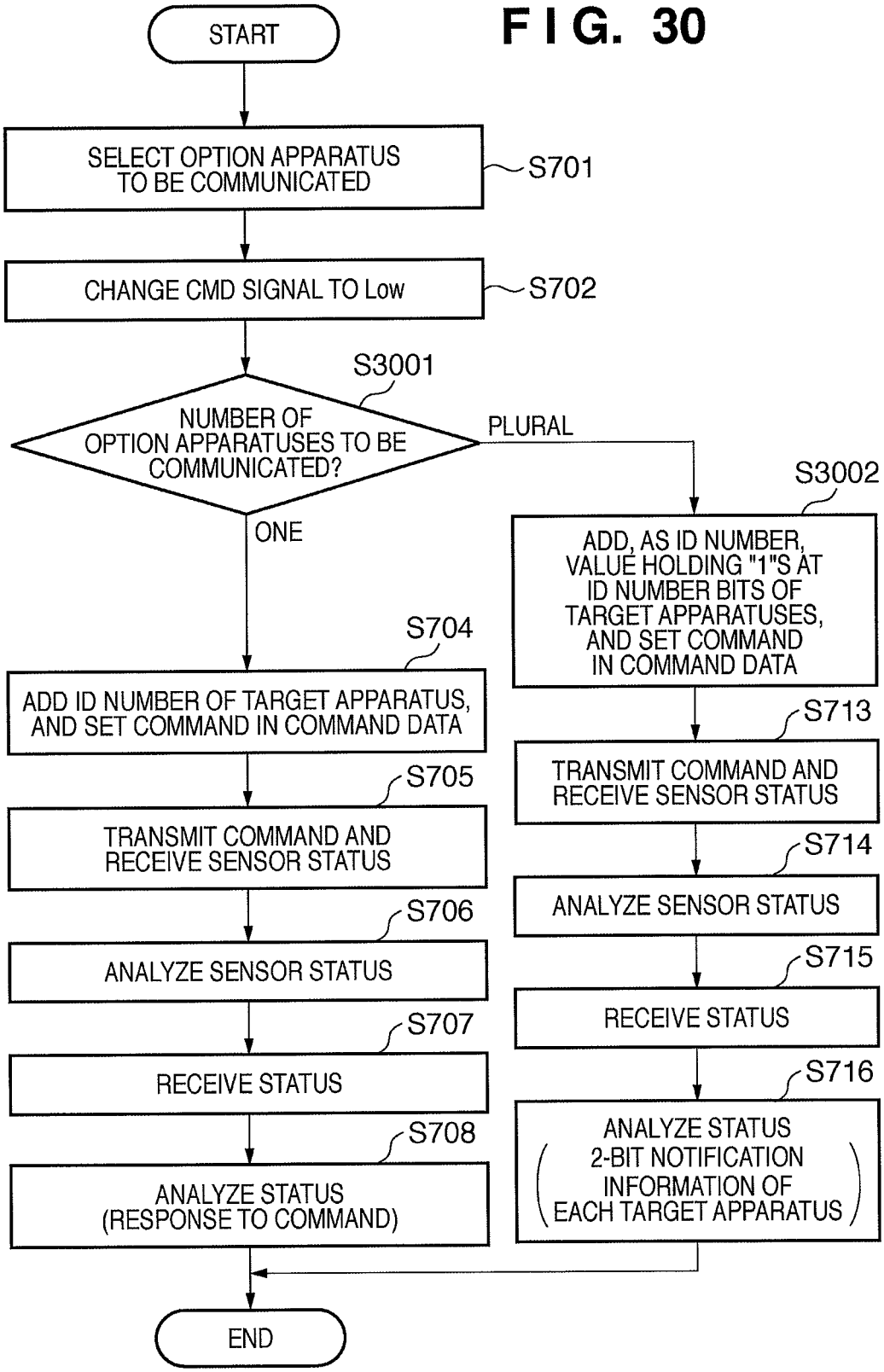
FIG. 30 is a flowchart of communication command transmission control in the image forming apparatus main body.

FIG. 30 is a flowchart of command communication control in the image forming apparatus main body.

This sequence is different from FIG. 7 in that step S703 is changed to step S3001 and steps S710, 711, 712, and 713 are replaced with step S3002. The ID in the command is made up of 3 bits in FIGS. 5A and 5B, but 4 bits in the fifth exemplary embodiment.

In the fifth exemplary embodiment, 1 bit is assigned as an ID to one option apparatus. In step S3001, the image forming apparatus main body determines the number of target apparatuses. If one apparatus is targeted, the image forming apparatus main body adds the ID of the target apparatus (step S704), similar to the first embodiment.

If a plurality of apparatuses are targeted in step S3001, the image forming apparatus main body adds an ID holding "1"s at all the ID bits of the target apparatuses (step S3002). Both broadcasting and groupcasting are processed similarly.

<Communication Command Execution Control Flowchart in Option Sheet Feeding Apparatus>

Figure 31A:
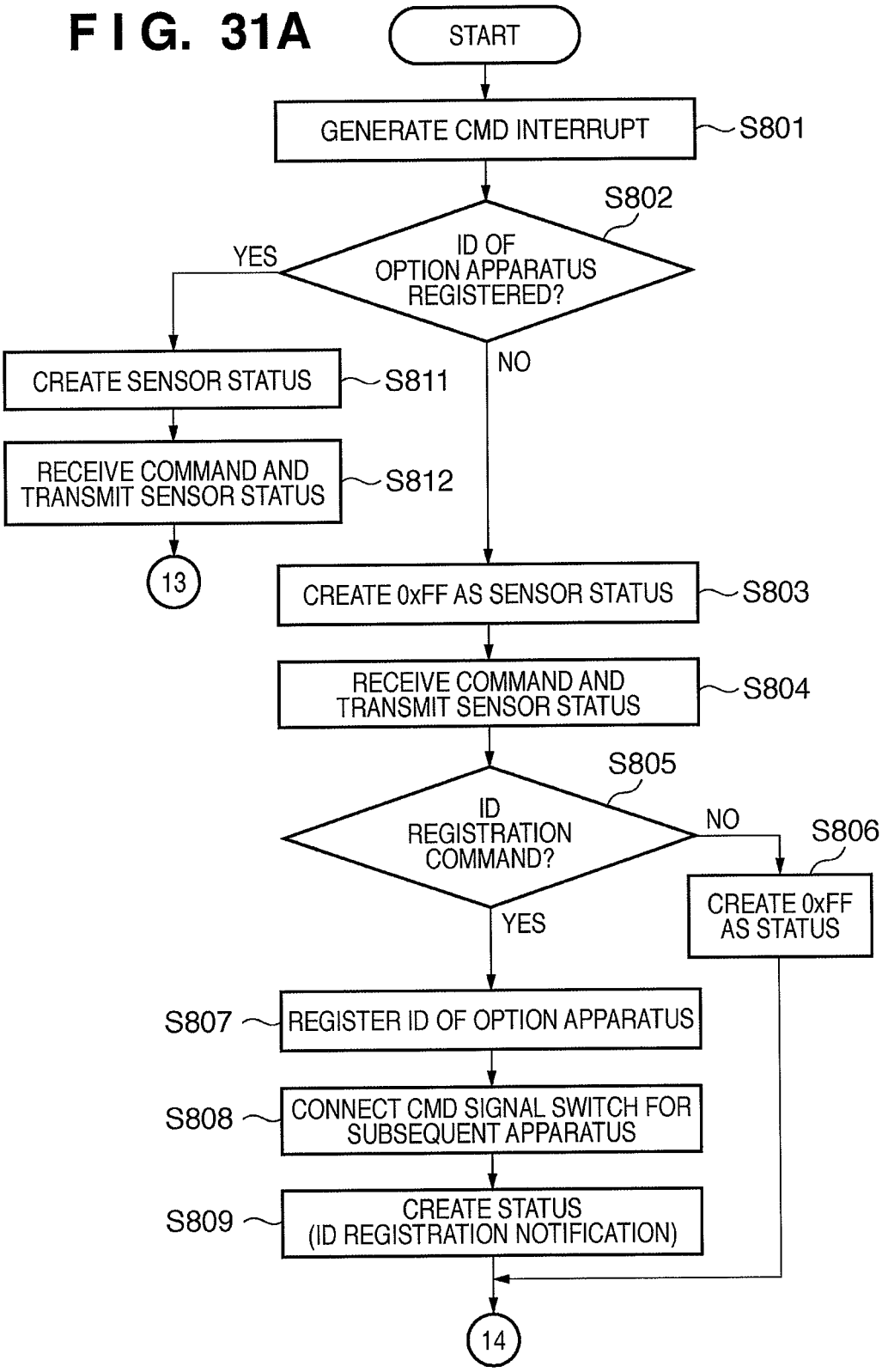
FIGS. 31A and 31B are flowcharts of communication command execution control in an option sheet feeding apparatus.
Figure 31B:
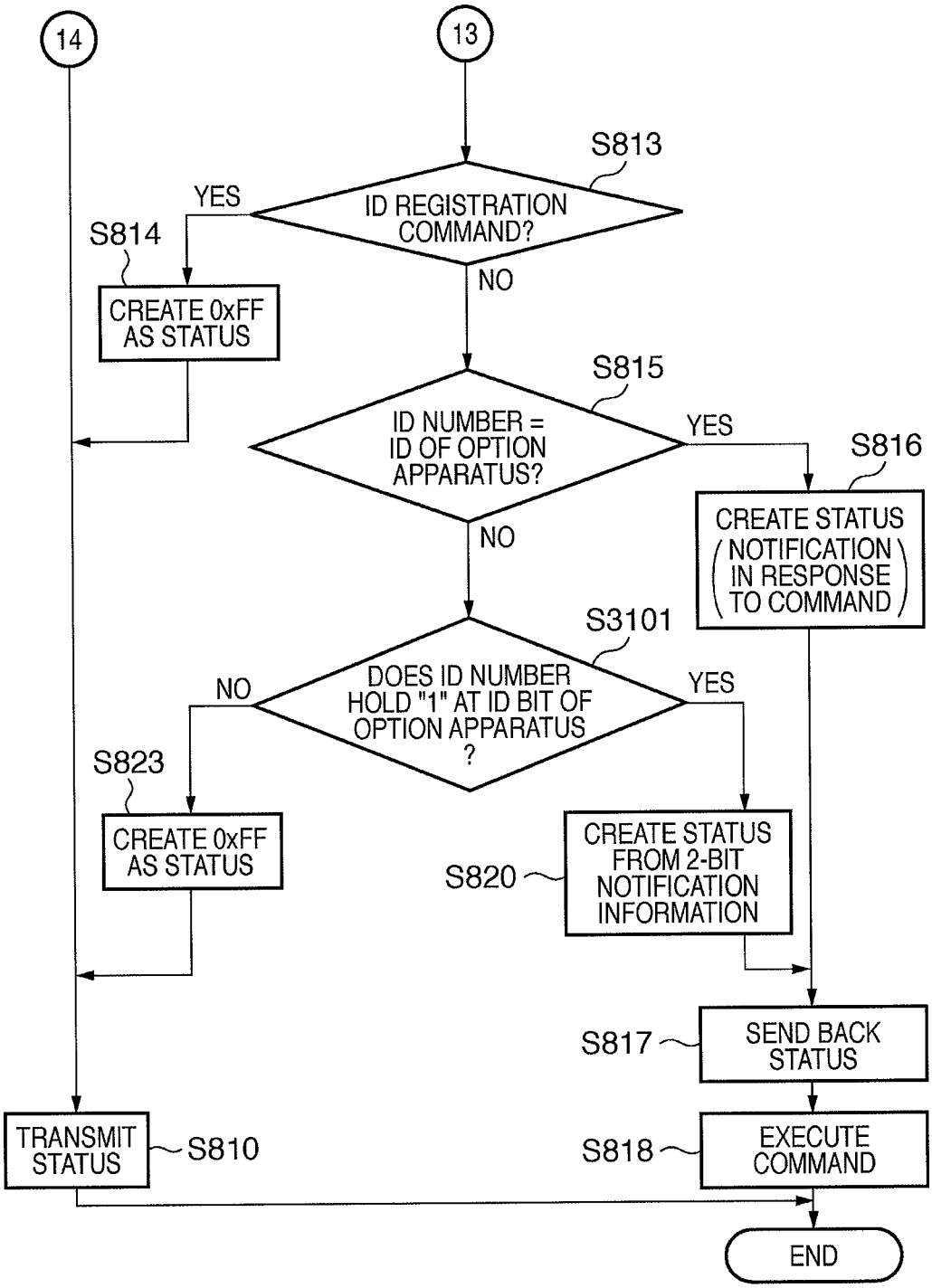

FIGS. 31A and 31B are flowcharts of communication command execution control in the option sheet feeding apparatus. This sequence is different from FIGS. 8A and 8B in that steps S819, S821, and S822 are changed to step S3101. In the fifth exemplary embodiment, which of broadcasting and groupcasting is designated is determined based on whether the ID bit of each option sheet feeding apparatus in an ID is "1". For this purpose, in step S3101, the option sheet feeding apparatus determines whether its ID bit in the ID is "1". An option control unit 40 (control CPU) of each option sheet feeding apparatus makes this determination in step S1301.

In the fifth exemplary embodiment, an excessive apparatus error generated when more than a maximum number of apparatuses are attached is not detected, but may also be detected additionally.

If detection of an excessive apparatus error is added in the fifth exemplary embodiment, all the bits of the broadcast ID take active values, so an excessively attached option apparatus suffices to ignore a command received with the broadcast ID. The remaining apparatuses can normally convey a print sheet, similar to the first embodiment.

<Effects>

As described above, the ID is defined as a value in which 1 bit is actively assigned to one option apparatus. Bits corresponding to option apparatuses which successively convey a print sheet are aligned to easily group the option apparatuses and perform synchronous conveyance control. Accordingly, an appropriate group can execute synchronous conveyance control at smaller power in accordance with the length of a print sheet.

A sixth exemplary embodiment will be described as follows.

In the above-described exemplary embodiments, the image forming apparatus main body 100 uses a command containing a group ID to drive not all but two or more option apparatuses at once.

As another exemplary embodiment, an image forming apparatus main body 100 may issue an instruction considering a time lag with an ID individually assigned to each option apparatus to the option apparatus belonging to an option group to be driven according to the flowchart of FIG. 6 or the like.

More specifically, the image forming apparatus main body 100 issues an instruction to drive option apparatuses except for a finally designated one after waiting until the timing to drive the finally designated option apparatus.

Assume that the option group includes option sheet feeding apparatuses 101, 102, and 103 in FIG. 1. In this case, when feeding a print sheet from the option sheet feeding apparatus 103, the image forming apparatus main body 100 outputs a command to instruct the option sheet feeding apparatuses 102 and 101 to start driving after waiting until the option sheet feeding apparatus 103 starts driving. Also, the image forming apparatus main body 100 outputs a command to make the option sheet feeding apparatus 102 wait longer than the option sheet feeding apparatus 101.

The same effects as those of the above-described exemplary embodiments can be obtained even when the command is created to drive not all but two or more option apparatuses at once.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-189811, filed Jul. 23, 2008 which is hereby incorporated by reference herein in its entirety.

What is claimed is:

1. An image forming apparatus which allows connecting at least three option apparatuses each having a conveying unit for conveying a recording medium, and communicates with the at least three option apparatuses via a common serial communication line, the image forming apparatus comprising:

an instruction unit configured to transmit a command, which instructs each of the at least three option apparatuses on an operation, via the common serial communication line; and a selection unit configured to select at least two option apparatuses, which are smaller in number than a total number of the option apparatuses, from the at least three option apparatuses, wherein, when conveying a recording medium by driving the selected at least two option apparatuses, the instruction unit transmits a command, which instructs the selected at least two option apparatuses on an operation, to the at least three option apparatuses.

2. The image forming apparatus according to claim 1, wherein the at least three option apparatuses sequentially respond by outputting bit data each representing a status in synchronization with reception of respective bits of a command transmitted from the instruction unit via the common serial communication line.

3. The image forming apparatus according to claim 1, wherein the selection unit selects, from the at least three option apparatuses, an option apparatus group including at least two option apparatuses, which are smaller in number than a total number of the option apparatuses, to be driven simultaneously, and wherein the instruction unit outputs, via the common serial communication line, a command to which an instruction on the option apparatus group selected by the selection unit is added.

4. The image forming apparatus according to claim 1, further comprising:

a determination unit which determines, in accordance with a response from each option apparatus, whether option apparatuses are connected more than a predetermined maximum connection count; and a notification unit which, when the determination unit determines that option apparatuses are connected more than the predetermined maximum connection count, notifies a user that the option apparatuses are connected more than the predetermined maximum connection count.

5. The image forming apparatus according to claim 4, wherein when the option apparatuses are connected more than the predetermined maximum connection count, an option apparatus exceeding the predetermined maximum connection count does not respond to a command from the instruction unit.

6. The image forming apparatus according to claim 4, wherein when the number of option apparatuses connected is more than the predetermined maximum connection count, an option apparatus exceeding the maximum connection count ignores a broadcast command from the instruction unit.

7. The image forming apparatus according to claim 4, wherein when the number of option apparatuses connected is more than the predetermined maximum connection count, an option apparatus exceeding the maximum connection count includes a maintenance unit which maintains a non-connected communication state to an option apparatus cascade-connected on a downstream side.

8. The image forming apparatus according to claim 1, wherein the option apparatuses include an intermediate conveying apparatus.

9. The image forming apparatus according to claim 1, wherein when conveying a recording medium by driving the at least two option apparatuses which are smaller in number than all the option apparatuses, the instruction unit outputs a command to which a group identifier is added to designate and drive an option apparatus group including the at least two option apparatuses which are smaller in number than all the option apparatuses.

10. The image forming apparatus according to claim 9, further comprising an update unit which updates correspondence between the group identifier and the option apparatus group including the at least two option apparatuses which are smaller in number than all the option apparatuses.

11. The image forming apparatus according to claim 1, further comprising a setting unit which sets an option apparatus identifier for each of the option apparatuses to be connected, wherein the option apparatus decides, in accordance with an option apparatus identifier set for the option apparatus, a group identifier to which the option apparatus responds.

12. The image forming apparatus according to claim 1, wherein a bit assigned to each option apparatus is set in the command to drive at once the at least two option apparatuses which are smaller in number than all the option apparatuses.

13. The image forming apparatus according to claim 1, wherein the option apparatus is a sheet feeding apparatus or a delivery apparatus.

14. An image forming apparatus which allows connecting at least three option apparatuses each having a conveying unit for conveying a recording medium and having an individual option apparatus identifier assigned, the image forming apparatus comprising:

a recognition unit which recognizes, from responses from the at least three option apparatuses, that option apparatuses are connected more than a predetermined maximum connection count; and a notification unit which notifies, based on recognition by the recognition unit, a user that the option apparatuses are connected more than the predetermined maximum connection count.

15. The image forming apparatus according to claim 14, wherein when the number of option apparatuses connected is more than the predetermined maximum connection count, an option apparatus exceeding the predetermined maximum connection count does not respond to a command from the instruction unit.

16. The image forming apparatus according to claim 14, wherein when the number of option apparatuses connected is more than the predetermined maximum connection count, an option apparatus exceeding the predetermined maximum connection count ignores a broadcast command from the instruction unit.

17. The image forming apparatus according to claim 14, wherein when the number of option apparatuses connected is more than the predetermined maximum connection count, an option apparatus exceeding the maximum connection count includes a maintenance unit which maintains a non-connected communication state to an option apparatus cascade-connected on a downstream side.

18. The image forming apparatus according to claim 14, wherein the option apparatus is a sheet feeding apparatus or a delivery apparatus.

19. An image forming apparatus which allows connecting at least three option apparatuses each having a conveying unit for conveying a recording medium and having an individual option apparatus identifier assigned, the image forming apparatus comprising:

a recognition unit which recognizes, from responses from the at least three option apparatuses, that the number of option apparatuses connected is more than a predetermined maximum connection count; and a setting unit which sets, when the recognition unit recognizes that the number of option apparatuses connected is more than the predetermined maximum connection count, the predetermined maximum connection count as the number of the option apparatuses to be targets of a broadcasted command.

20. The image forming apparatus according to claim 19, wherein the option apparatus is a sheet feeding apparatus or a delivery apparatus.

21. An image forming apparatus which allows connecting at least three option apparatuses each having a conveying unit for conveying a recording medium and having an individual option apparatus identifier assigned, the image forming apparatus comprising:

a transmission unit which transmits a command to the at least three option apparatuses via a common serial communication line, wherein when the number of option apparatuses connected is more than a predetermined maximum connection count, an option apparatus exceeding the predetermined maximum connection count does not respond to a command from the transmission unit.

22. The image forming apparatus according to claim 21, wherein the option apparatus determines that the option apparatus itself is an option apparatus exceeding the predetermined maximum connection count when the number of the ID number assigned to the option apparatus exceeds the predetermined maximum connection count.

23. The image forming apparatus according to claim 21, wherein the option apparatus exceeding the predetermined maximum connection count does not respond to a command specifying the option apparatus.

24. The image forming apparatus according to claim 21, wherein the option apparatus is a sheet feeding apparatus or a delivery apparatus.

25. An option apparatus comprising:

a unit for connecting to an image forming apparatus, wherein the option apparatus communicates with the image forming apparatus via a serial communication line; and a unit for responding to commands transmitted from the image forming apparatus, wherein when a number of option apparatuses which are connected to the image forming apparatus is more than a predetermined maximum connection count, the option apparatus does not respond to a command transmitted from the image forming apparatus when the option apparatus itself is an option apparatus exceeding the predetermined maximum connection count.

26. The option apparatus according to claim 25, wherein the option apparatus determines that the option apparatus itself is an option apparatus exceeding the predetermined maximum connection count when the number of the ID number assigned to the option apparatus exceeds the predetermined maximum connection count.

27. The option apparatus according to claim 25, wherein the option apparatus does not respond to a command specifying the option apparatus.

28. The option apparatus according to claim 25, wherein the option apparatus is a sheet feeding apparatus or a delivery apparatus.

29. An image forming apparatus which allows connecting to at least three option apparatuses, and to communicate with the at least three option apparatuses via a common serial communication line, the image forming apparatus comprising:

an instruction unit configured to transmit a command, which instructs each of the at least three option apparatuses on an operation, via the common serial communication line; and a selection unit configured to select at least two option apparatuses, which are smaller in number than a total number of the option apparatuses, from the at least three option apparatuses, wherein the instruction unit transmits a command including information, which indicates that the selected at least two option apparatuses are to be instructed by the command, to the at least three option apparatuses.

30. The image forming apparatus according to claim 29, wherein the option apparatus is a sheet feeding apparatus or a delivery apparatus.

31. An option apparatus which allows connecting to an image forming apparatus, and to communicate with the image forming apparatus via a serial communication line, in a case that at least three option apparatuses are connected to the image forming apparatus, and a command, which causes the at least two option apparatuses which are smaller in number than all the option apparatuses to drive, is transmitted from the image forming apparatus to all the option apparatus via the serial communication line, the option apparatus starts to drive if the option apparatus itself is designated in the command, and does not start to drive if the option apparatus itself is not designated in the command.

32. The option apparatus according to claim 31, wherein the option apparatus is a sheet feeding apparatus or a delivery apparatus.

33. An option apparatus which allows connecting to an image forming apparatus, and to communicate with the image forming apparatus via a serial communication line, in a case that at least three option apparatuses are connected to the image forming apparatus, and a command including information, which indicates that at least two option apparatuses which are smaller in number than all the option apparatuses are designated as target to be instructed by the command, is transmitted from the image forming apparatus to all the option apparatuses via the serial communication line, the option apparatus responds to the command if the option apparatus itself is designated as the target in the command, and does not respond to the command if the option apparatus itself is not designated as the target in the command.

34. The option apparatus according to claim 33, wherein the option apparatus is a sheet feeding apparatus or a delivery apparatus.

* * * * *